US008770633B2

(12) United States Patent
Stango

(10) Patent No.: US 8,770,633 B2
(45) Date of Patent: Jul. 8, 2014

(54) LATCH ACTUATOR AND LATCH USING SAME

(75) Inventor: James Christopher Stango, Chicago, IL (US)

(73) Assignee: Southco, Inc., Concordville, PA (US)

( * ) Notice: Subject to any disclaimer, the term of this patent is extended or adjusted under 35 U.S.C. 154(b) by 761 days.

(21) Appl. No.: 12/250,347

(22) Filed: Oct. 13, 2008

(65) Prior Publication Data

US 2009/0115196 A1 May 7, 2009

Related U.S. Application Data

(60) Provisional application No. 61/025,812, filed on Feb. 3, 2008, provisional application No. 60/998,649, filed on Oct. 13, 2007.

(51) Int. Cl.
*E05C 5/04* (2006.01)

(52) U.S. Cl.
USPC ..... 292/61

(58) Field of Classification Search
CPC .... E05B 63/0056; E05B 65/006; E05B 83/30
USPC ..... 292/137, 159, 170, 169, 169.17, 140, 292/144, 336.3
See application file for complete search history.

(56) References Cited

U.S. PATENT DOCUMENTS

| | | | | |
|---|---|---|---|---|
| 3,748,878 | A * | 7/1973 | Balzano et al. | 70/218 |
| 4,079,605 | A * | 3/1978 | Bartels | 70/277 |
| 4,177,657 | A * | 12/1979 | Aydin | 70/278.2 |
| 5,421,178 | A * | 6/1995 | Hamel et al. | 70/283 |
| 5,592,838 | A * | 1/1997 | Clark et al. | 70/303 A |
| 5,862,692 | A * | 1/1999 | Legault et al. | 70/278.1 |
| 6,098,433 | A * | 8/2000 | Maniaci | 70/278.1 |
| 6,112,563 | A * | 9/2000 | Ramos | 70/278.1 |
| 6,502,438 | B1 * | 1/2003 | Miller et al. | 70/303 A |
| 6,622,537 | B2 * | 9/2003 | Rodriguez | 70/432 |
| 6,865,916 | B2 * | 3/2005 | Goldman | 70/472 |
| 2010/0126240 | A1 | 5/2010 | Pollabauer | |

FOREIGN PATENT DOCUMENTS

| | | | |
|---|---|---|---|
| DE | 29703559 | U1 | 2/1997 |
| DE | 10053019 | C1 | 10/2000 |
| FR | 2728613 | A1 | 12/2004 |
| WO | WO2008154664 | A1 | 12/2008 |

OTHER PUBLICATIONS iButton Brochure, by Dallas Semiconductor, 2005.

Examination Report issued in the counterpart GB application No. GB1005988.9, dated Feb. 22, 2013.

* cited by examiner

*Primary Examiner* — Kristina Fulton
*Assistant Examiner* — Nathan Cumar
(74) *Attorney, Agent, or Firm* — RatnerPrestia

(57) ABSTRACT

The latch actuating mechanism uses both an electric motor and a cylinder lock as alternative means for selectively locking a handle to a cam that in turn can operate a latch mechanism in order to allow the handle to be used to open the latch mechanism. A biasing means urges the handle to the closed position.

15 Claims, 119 Drawing Sheets

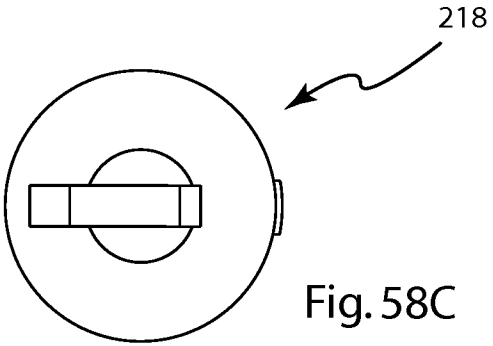
Fig. 58C
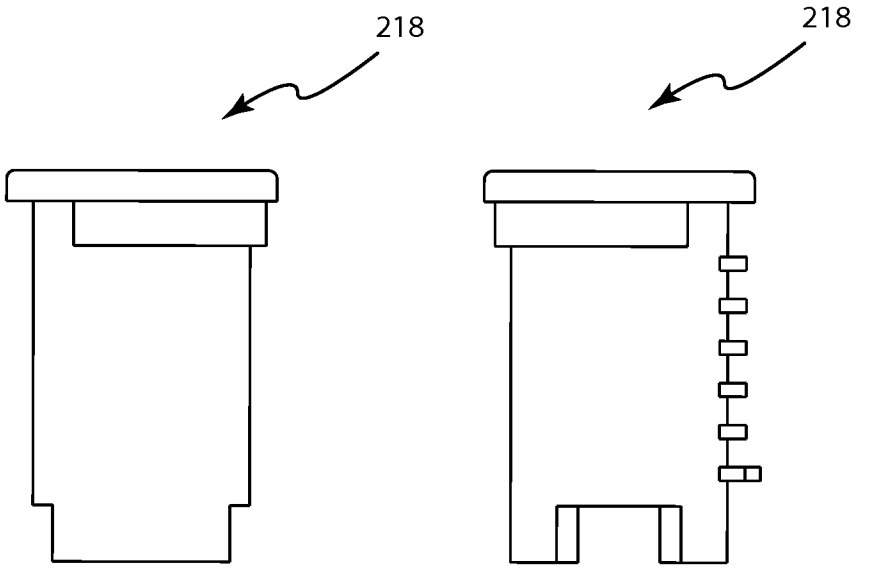
Fig. 58D
Fig. 58E
Fig. 58F 243
245
245

246
245
243

245
246
245
245
243

LATCH ACTUATOR AND LATCH USING SAME

CROSS REFERENCE TO RELATED APPLICATIONS

This application is a non-provisional of U.S. Provisional Application for patent Ser. No. 60/998,649, filed on Oct. 13, 2007, and U.S. Provisional Application for Patent Ser. No. 61/025,812, filed on Feb. 3, 2008, which are incorporated by reference herein in their entirety.

BACKGROUND OF THE INVENTION

1. Field of the Invention

The present invention relates to a latch for releasably securing a first member, such as a door, panel, drawer, or the like, relative to a second member such as a doorframe, keeper, striker, cabinet frame, another door, another panel, or the like.

2. Description of the Prior Art

Latches are used to releasably secure panels, covers, doors, drawers, electronic modules, and the like to other structures such as compartments, cabinets, containers, doorframes, other doors or panels, frames, racks, etc. Although many latch designs are known in the art, none offers the advantages of the present invention. The advantages of the present invention will be apparent from the attached detailed description and drawings.

SUMMARY OF THE INVENTION

The present invention is directed to improvements in latches and latch actuators. The illustrated embodiment exemplifying the several inventive concepts of the present invention is a sliding pawl latch provided with a latch actuator that can be accessed on the exterior of the member, such as a door, drawer, panel or the like, which is secured by the latch. The illustrated embodiment of the latch has a sliding pawl, biasing means, and an actuating mechanism. The pawl moves rectilinearly along a straight line axis between an extended position and a retracted position. The extended position corresponds to the latched position of the pawl, and the retracted position corresponds to the unlatched position of the pawl. The pawl is biased toward the latched position by the biasing means. The actuating mechanism includes a knob or handle and is capable of selectively being placed in an engaged configuration and a disengaged configuration. A user can cause the actuating mechanism to assume the engaged configuration either manually using a key or electrically. Once in the engaged configuration, the user can manually operate the actuating mechanism to move the pawl to the retracted position, which in turn allows the first member to be moved to the open position. With the actuating mechanism in the engaged configuration, rotating the handle causes rotation of a cam that engages the pawl and moves it to the retracted position.

The handle of the actuating mechanism can be moved rotationally between a latched or closed position and an unlatched or open position. When the actuating mechanism is in the disengaged configuration, the handle can be rotated between the closed and open positions without moving the cam, and thus without moving the sliding pawl or bolt of the latch. The handle carries a lock cylinder that can be rotated relative to the handle using a key to rotate the lock cylinder between locked and unlocked positions relative to the handle. The lock cylinder operates a lock bolt between retracted and extended positions. When the lock bolt is in the extended position, the actuating mechanism is in a first engaged configuration and the handle is locked to the cam such that rotating the handle from the closed position to the open position moves the cam, and thus moves the sliding pawl to the retracted position in order to allow the opening of, for example, a drawer secured by the latch.

In addition, the handle carries an electrically-powered motor that is attached to the handle such that it rotates with the handle as the handle is rotated between the open position and the closed position. The motor has a second bolt, also referred to as the motor bolt, which can move rectilinearly between retracted and extended positions. The motor bolt is biased toward the extended position and has beveled sides. The motor bolt projects into a slot in the cam when the handle is in the closed position. When the motor is not energized, the motor bolt is free to move to the retracted position. When the motor is not energized, the sides of the slot in the cam act on the beveled surfaces of the motor bolt such that the motor bolt is moved to the retracted position as the handle is rotated toward the open position with the result that the cam will not rotate to the open position with the handle. When the motor is energized the motor bolt is prevented from moving out of the extended position, thus placing the actuating mechanism in a second engaged configuration. When the motor bolt is prevented from moving out of the extended position by the energized motor, the handle is locked to the cam such that rotating the handle from the closed position to the open position moves the cam from the closed position to the open position, and thus moves the sliding pawl to the retracted position in order to allow the opening of, for example, a drawer secured by the latch. Thus, the lock cylinder and the motor provide two independent means of rotationally connecting the handle to the cam in order to allow the opening of a member secured by the latch.

In the preferred embodiment, the actuating mechanism includes a proximity sensor operated by an electronic key. The motor is energized in response to a signal from the proximity sensor that is generated when the proximity sensor senses the presence of the electronic key held near the proximity sensor. The motor and proximity sensor allow relatively quick access to the contents of any compartment secured by the latch, for example a drawer, during emergencies. The cylinder lock allows a manual override in the event of sensor, motor, or power failure.

The actuating mechanism consumes very little power, because the majority of the time, i.e. during periods when the actuating mechanism is in the disengaged configuration, the motor is not energized. Preferably, the actuating mechanism also includes a second biasing means for biasing the handle to return to its closed position.

Accordingly, one object of the present invention is to provide a latch actuating mechanism that allows relatively quick access to the interior of a compartment secured by a latch.

Another object of the present invention is to provide a latch actuating mechanism that can be used with a wide variety of latch mechanisms.

These and other objects of the invention will become apparent from the appended drawings and the detailed description provided below.

BRIEF DESCRIPTION OF THE DRAWINGS

FIGS. 58A-58F are views of the cylinder lock of the actuating mechanism of FIGS. 44A-44G.

Similar reference characters denote corresponding features consistently throughout the attached drawings.

DETAILED DESCRIPTION OF THE PREFERRED EMBODIMENTS

Figure 1:
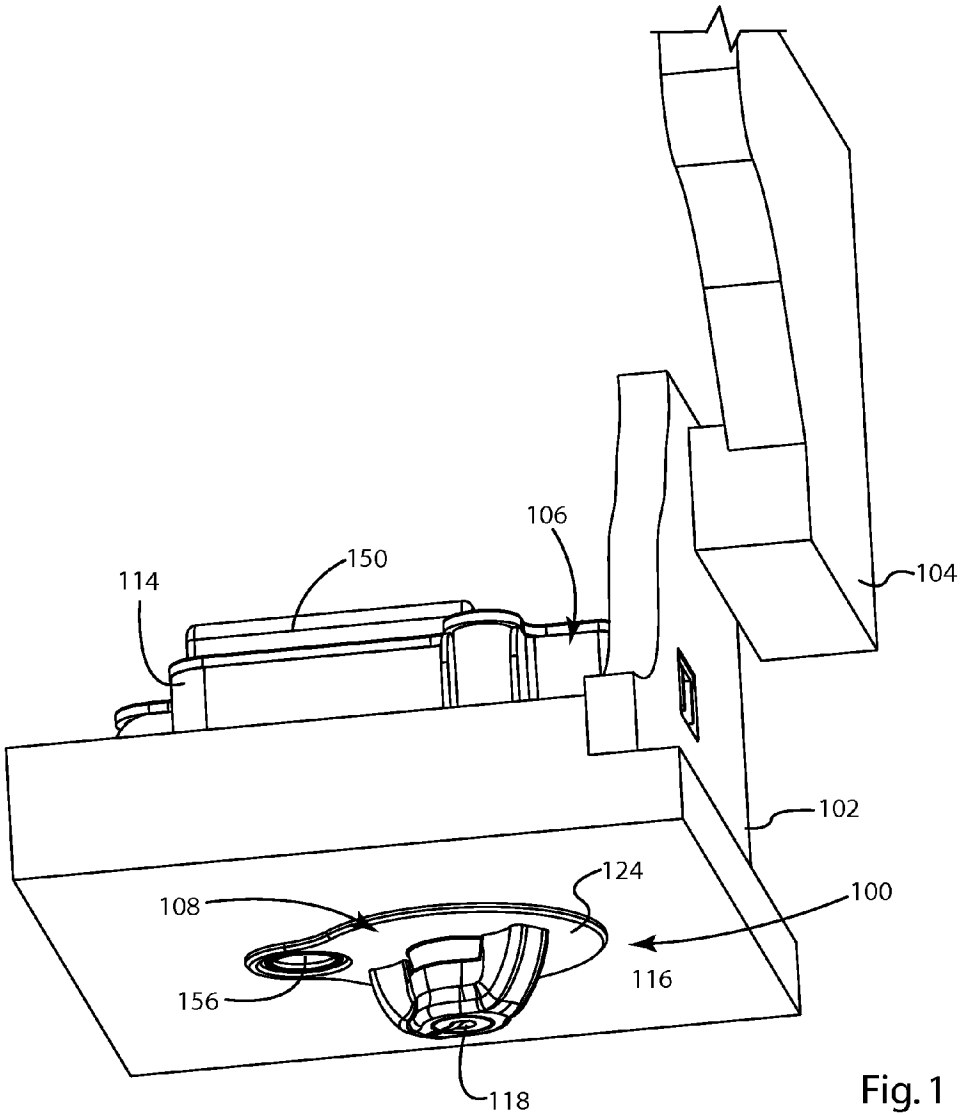
FIGS. 1-3 are environmental views of a latch according to the present invention shown installed to a drawer.
Figure 2:
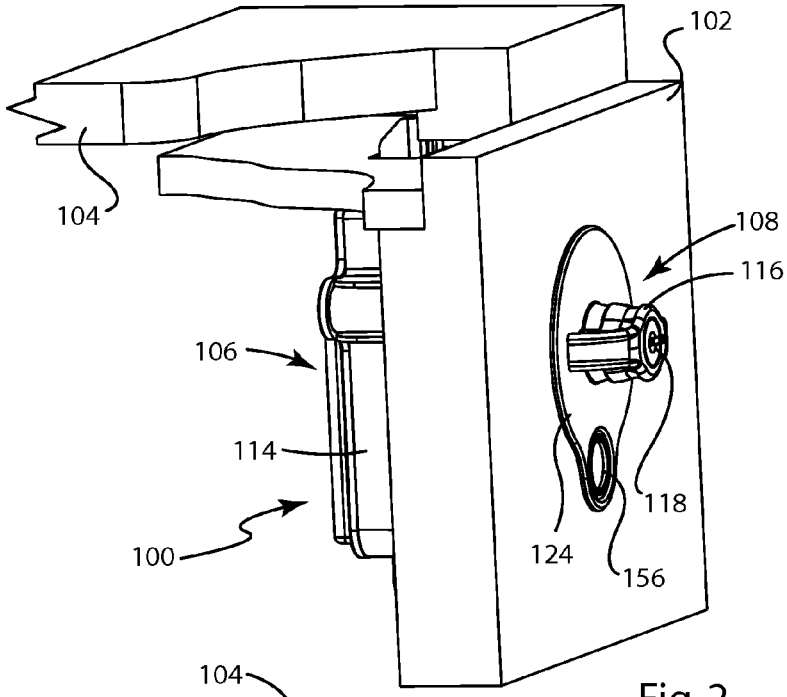
Figure 3:
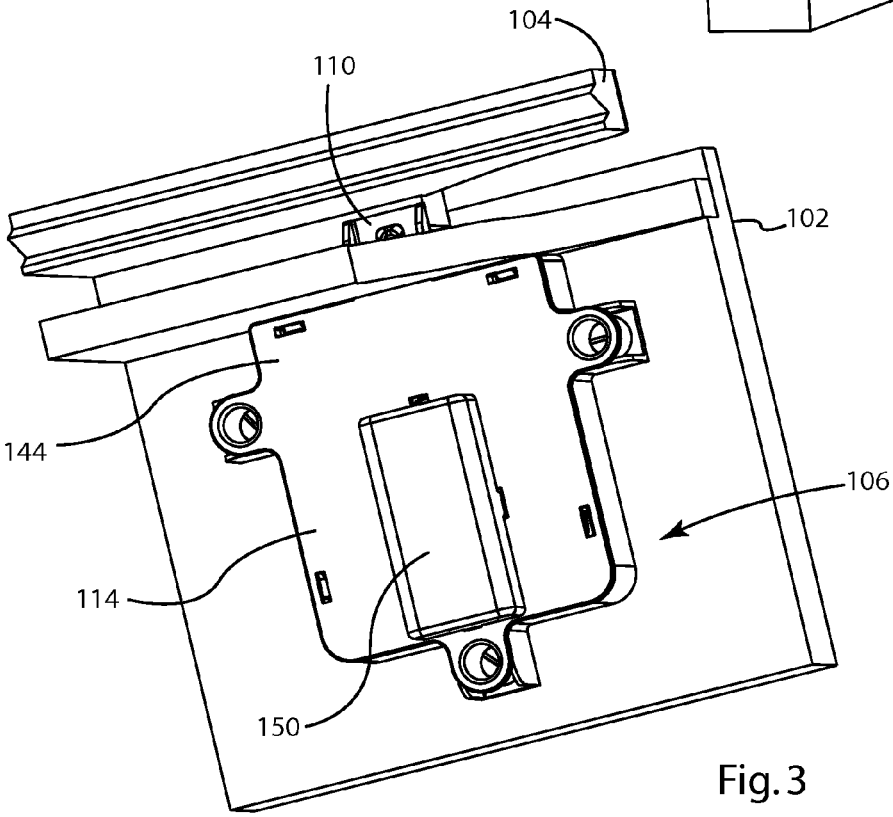
Figure 4:
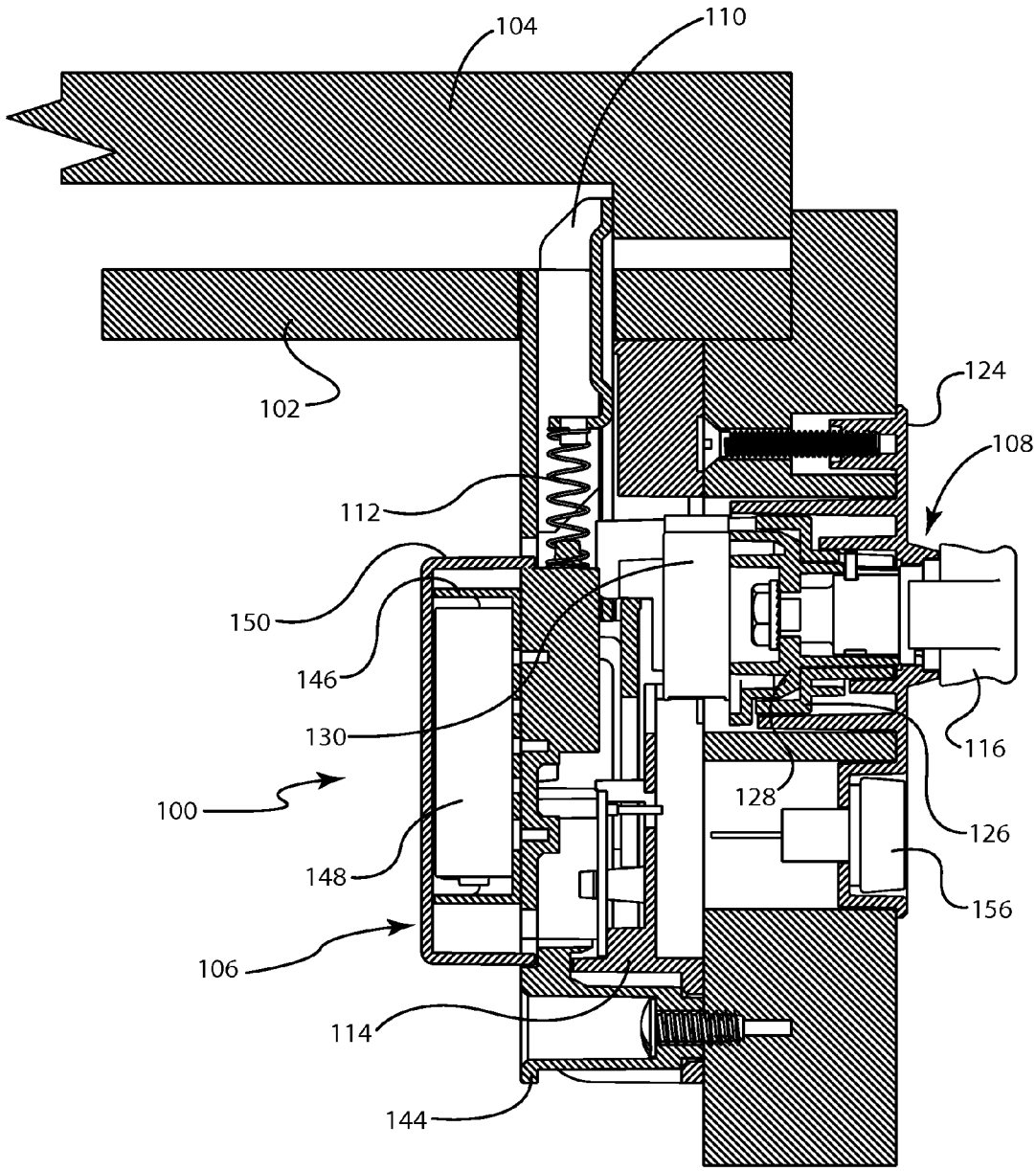
FIG. 4 is a cross sectional view a latch according to the present invention shown installed to a drawer.
Figure 5A:
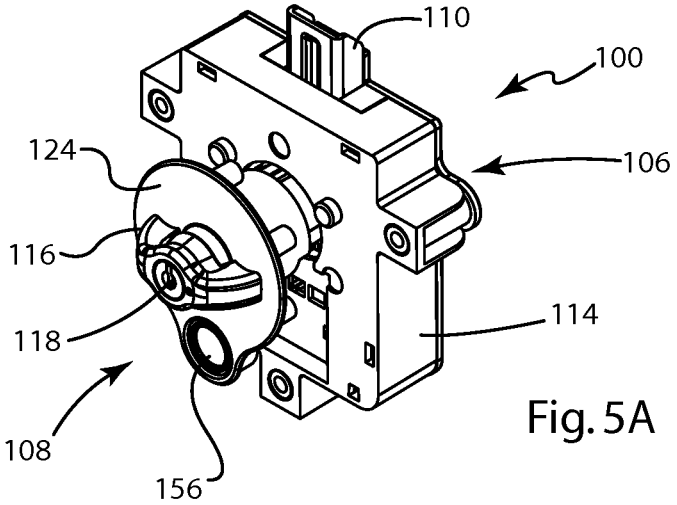
FIGS. 5A-5G are views of a latch according to the present invention including an actuating mechanism and a latch mechanism.
Figure 5B:
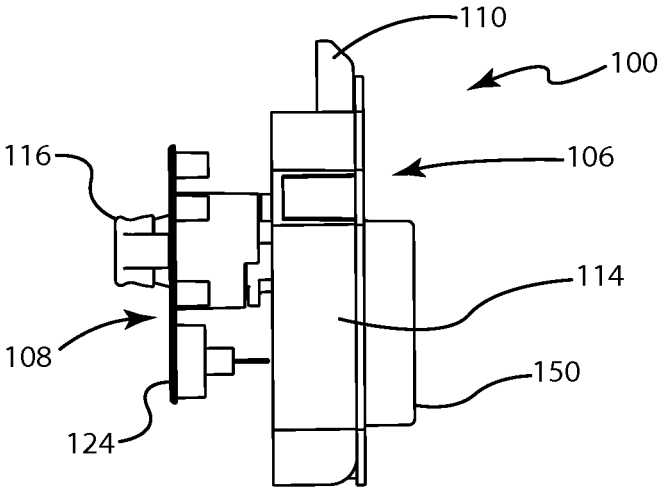
Figure 5C:
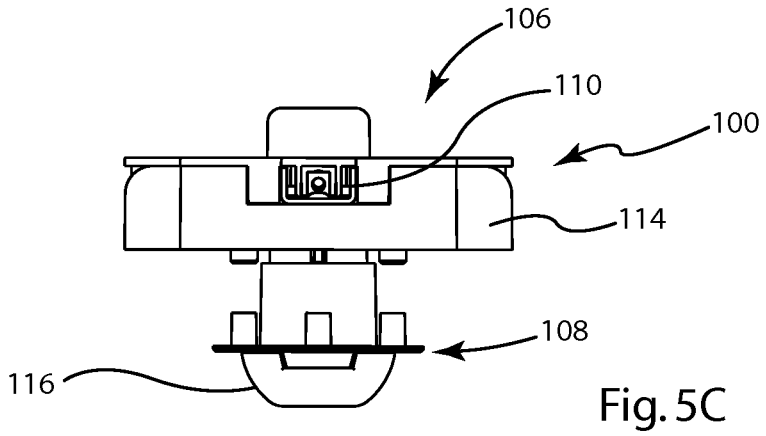
Figure 5D:
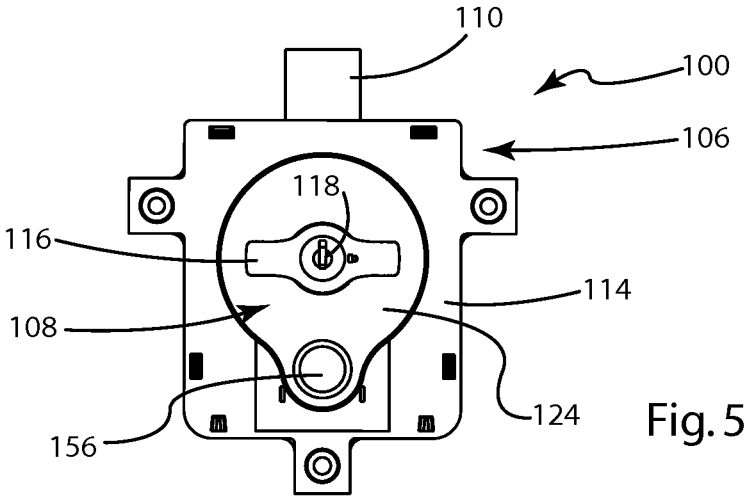
Figure 5E:
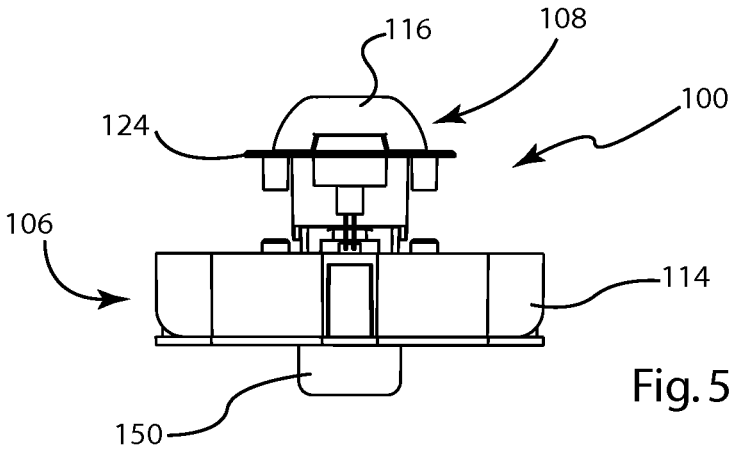
Figure 5F:
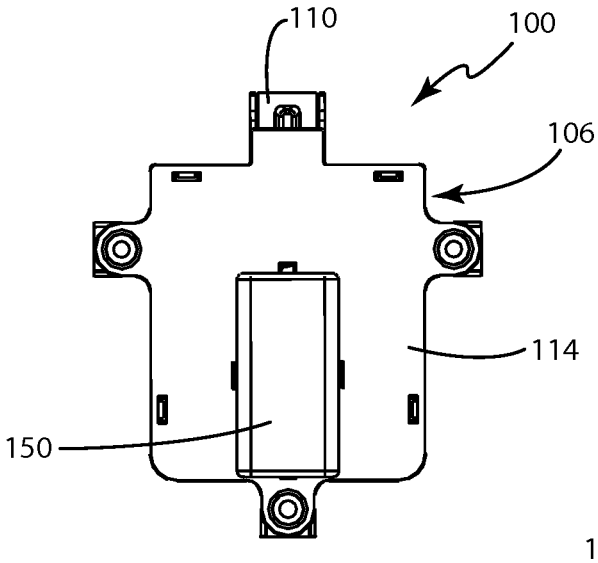
Figure 5G:
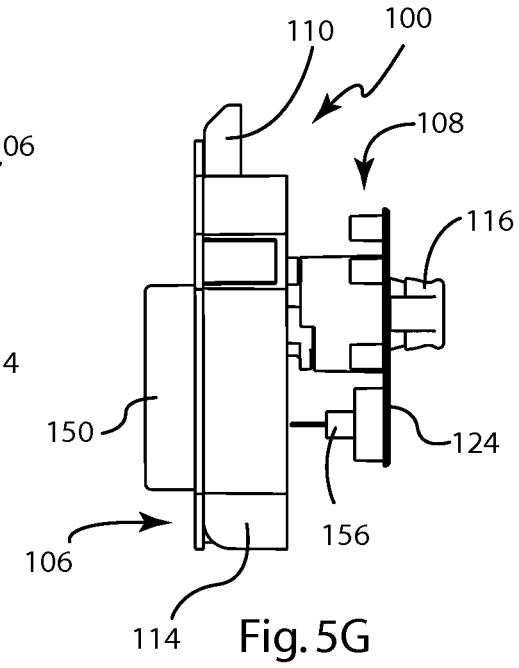
Figure 6A:
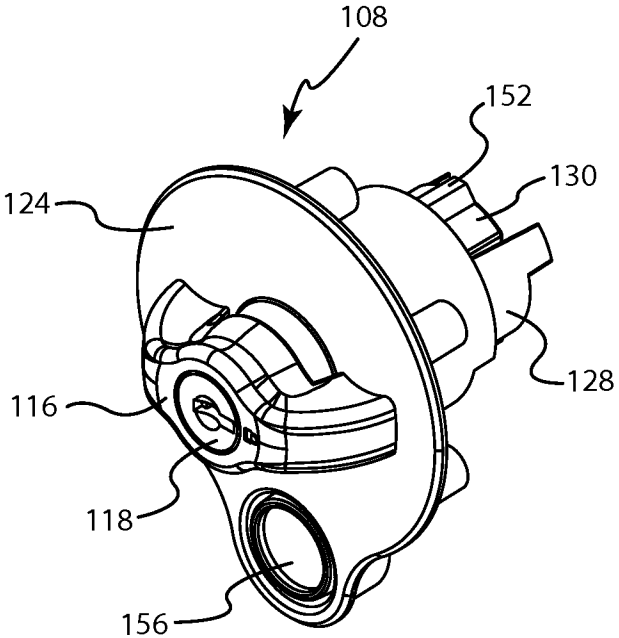
FIGS. 6A-6G are views of an actuating mechanism according to the present invention.
Figure 6B:
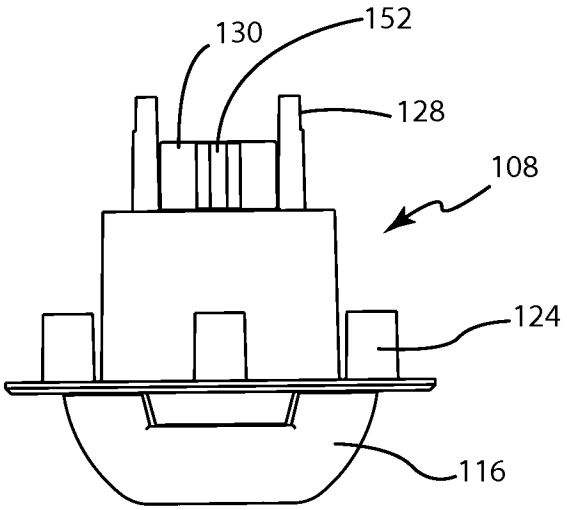
Figure 6C:
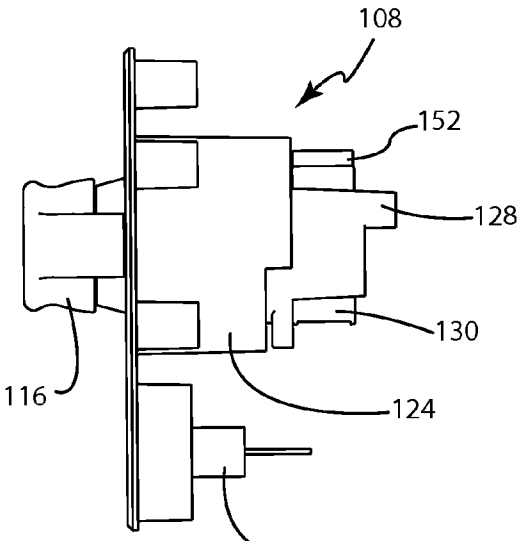
Figure 6D:
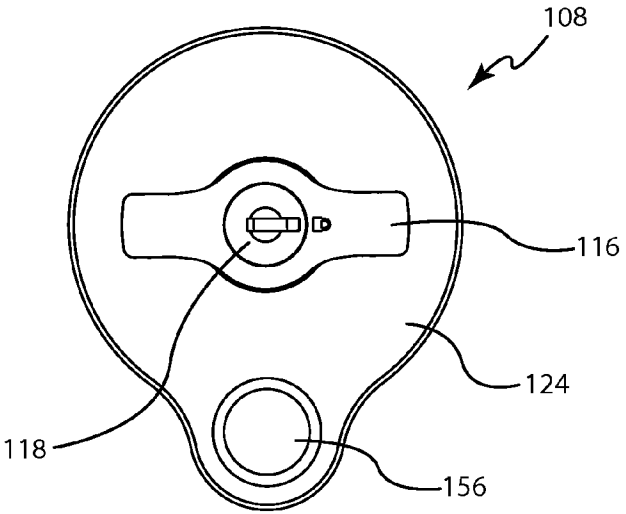
Figure 6E:
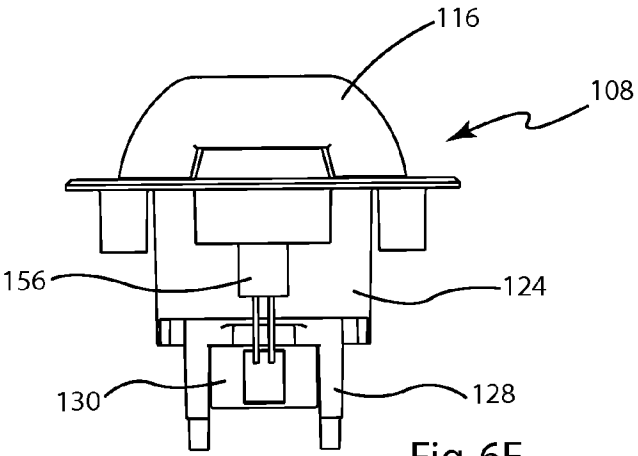
Figure 6G:
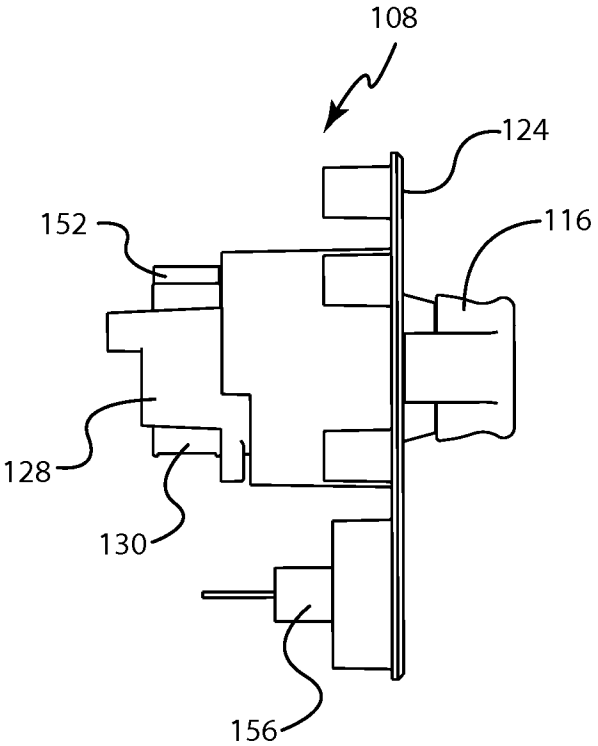
Figure 6F:
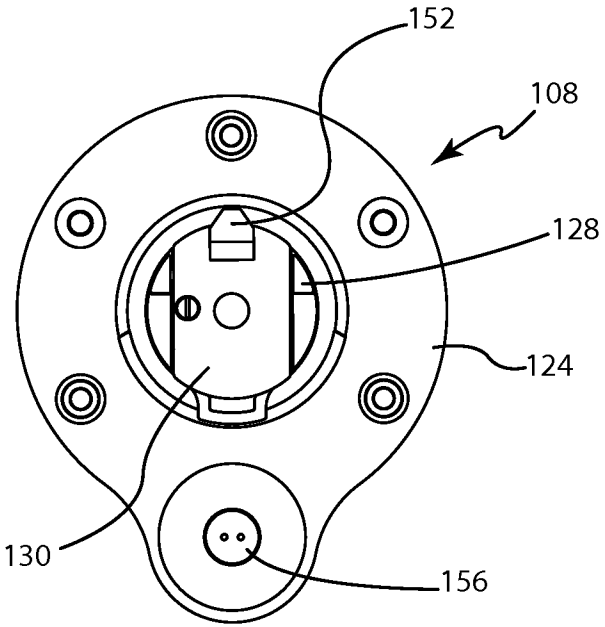
Figure 7A:
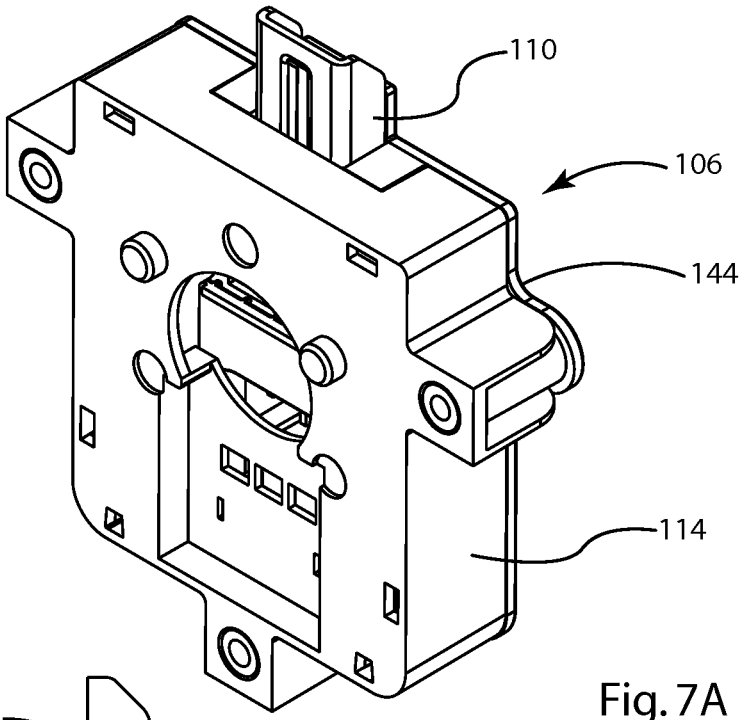
FIGS. 7A-7G are views of a latch mechanism according to the present invention and adapted for use with the actuating mechanism of FIGS. 6A-6G.
Figure 7B:
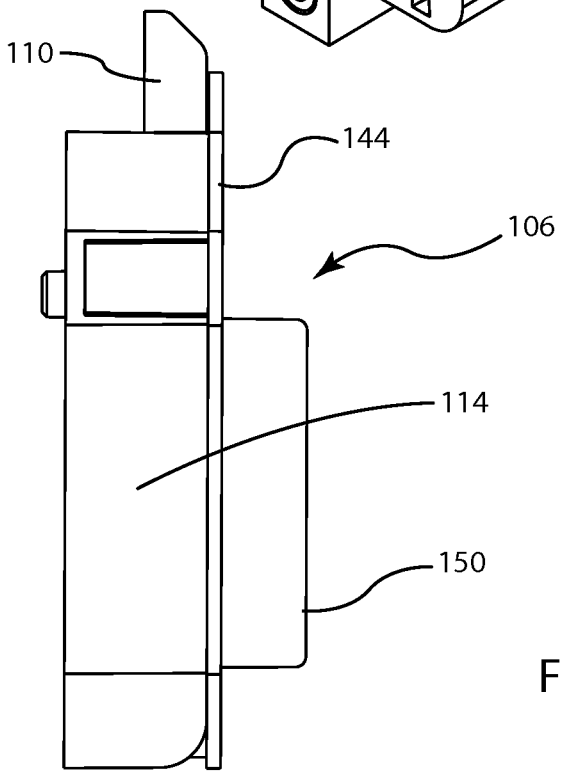
Figure 7C:
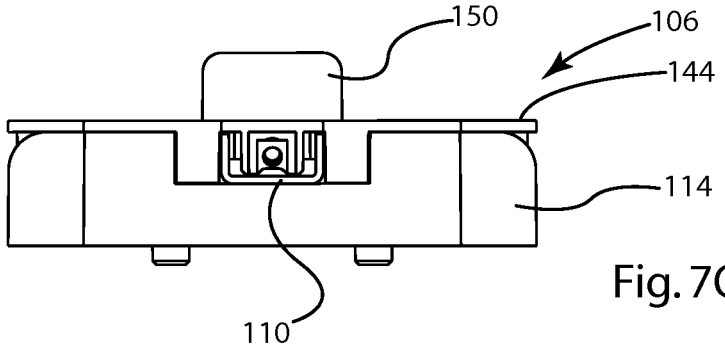
Figure 7D:
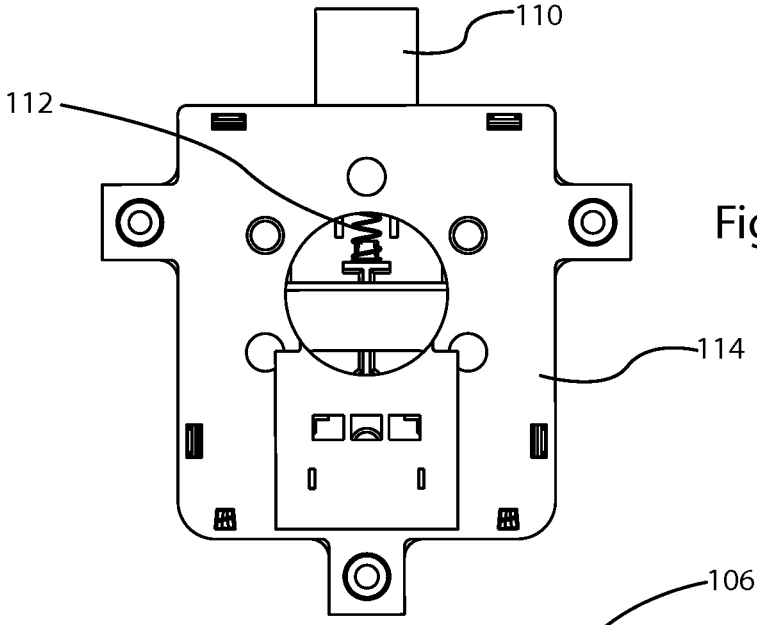
Figure 7E:
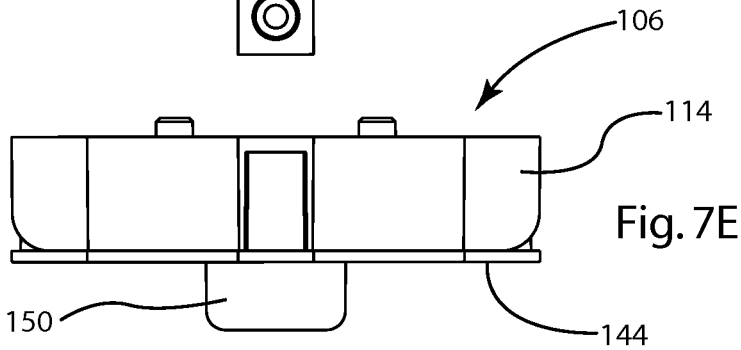
Figure 7F:
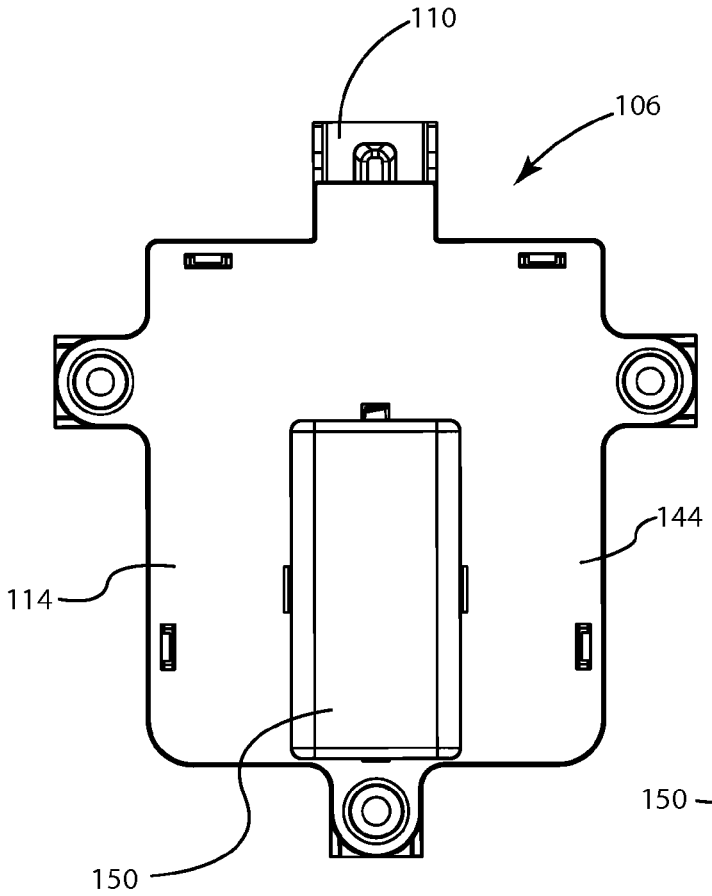
Figure 7G:
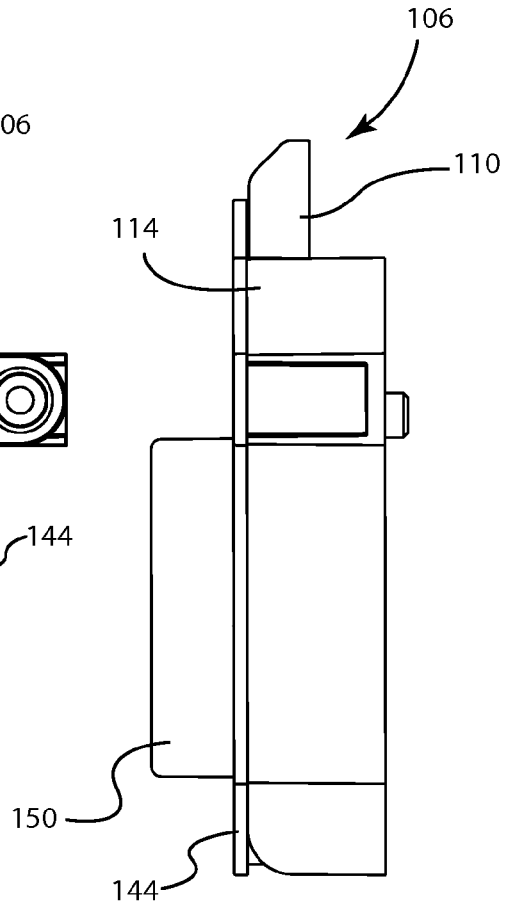
Figure 8:
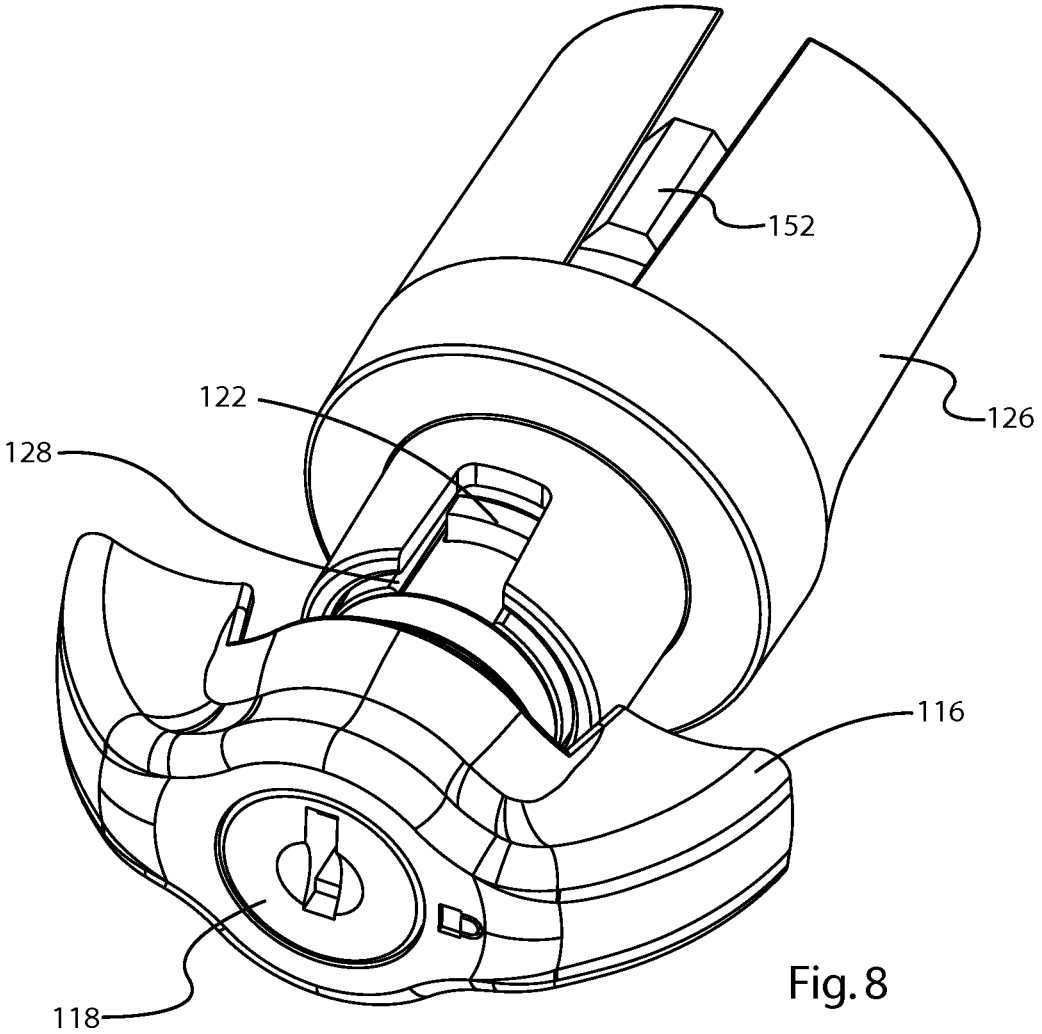
FIG. 8 is a fragmentary view showing the handle of the actuating mechanism of FIGS. 6A-6G with the cylinder lock in the locked position.

Referring to FIGS. 1-38E, the present invention is directed to a latch that is particularly suited for releasably securing a first member relative to a second member. In the illustrated example, the illustrative embodiment 100 of the latch of the present invention is shown being used to secure a drawer, however, it should be readily apparent that the latch 100 can be used to releasably secure a wide variety of types of closure members in the closed position. For example, the latch 100 can be used to secure any type of door in a closed position against a closed position relative to a chest or cabinet 104.

The present invention is directed to improvements in latches and latch actuators. The illustrated embodiment exemplifying the several inventive concepts of the present invention is a latch 100 that includes a sliding pawl latch mechanism 106 provided with a latch actuating mechanism 108 that can be accessed on the exterior of the member, such as a door, drawer, panel or the like, which is secured by the latch 100. The illustrated embodiment of the latch mechanism 106 includes a housing 114, a sliding pawl 110, and a biasing means 112. The pawl 110 moves rectilinearly along a straight line axis between an extended position and a retracted position. The extended position corresponds to the latched position of the pawl 110, and the retracted position corresponds to the unlatched position of the pawl 110. The pawl 110 is biased toward the latched position, i.e. extended position, by the biasing means 112, which is a compression coil spring 112 in the illustrated embodiment.

Figure 9:
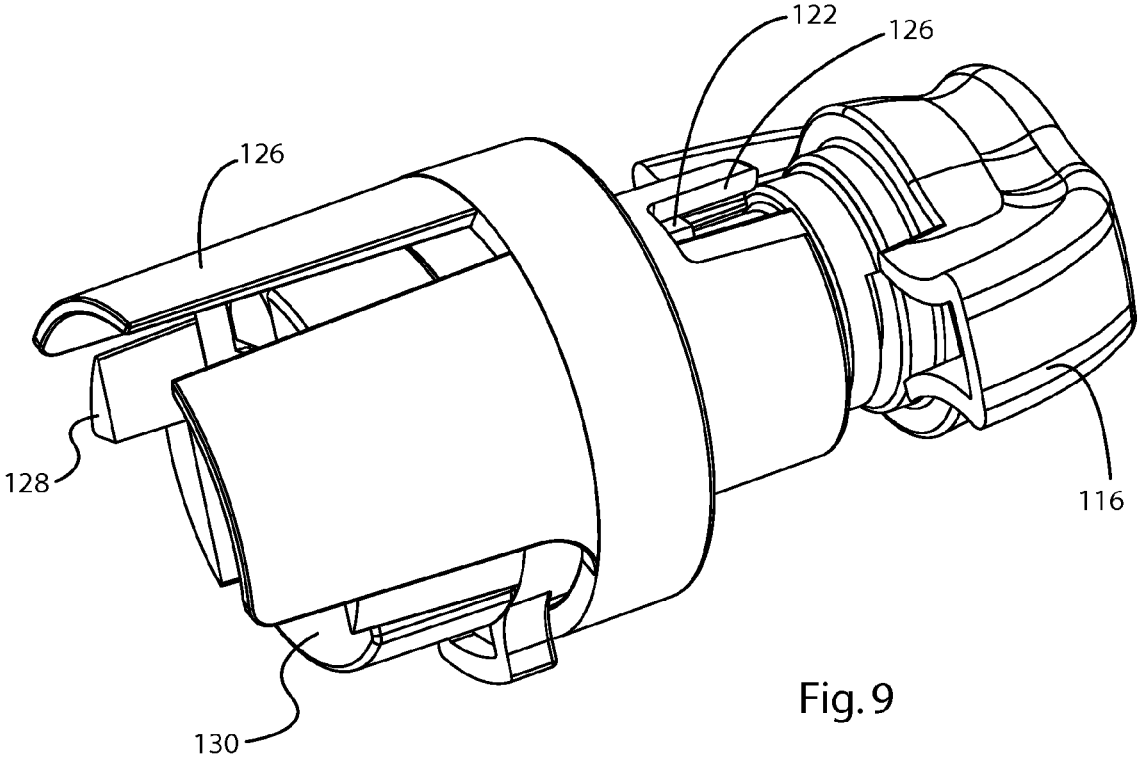
FIG. 9 is a fragmentary view showing the handle of the actuating mechanism of FIGS. 6A-6G disconnected from the outer cam.
Figure 10:
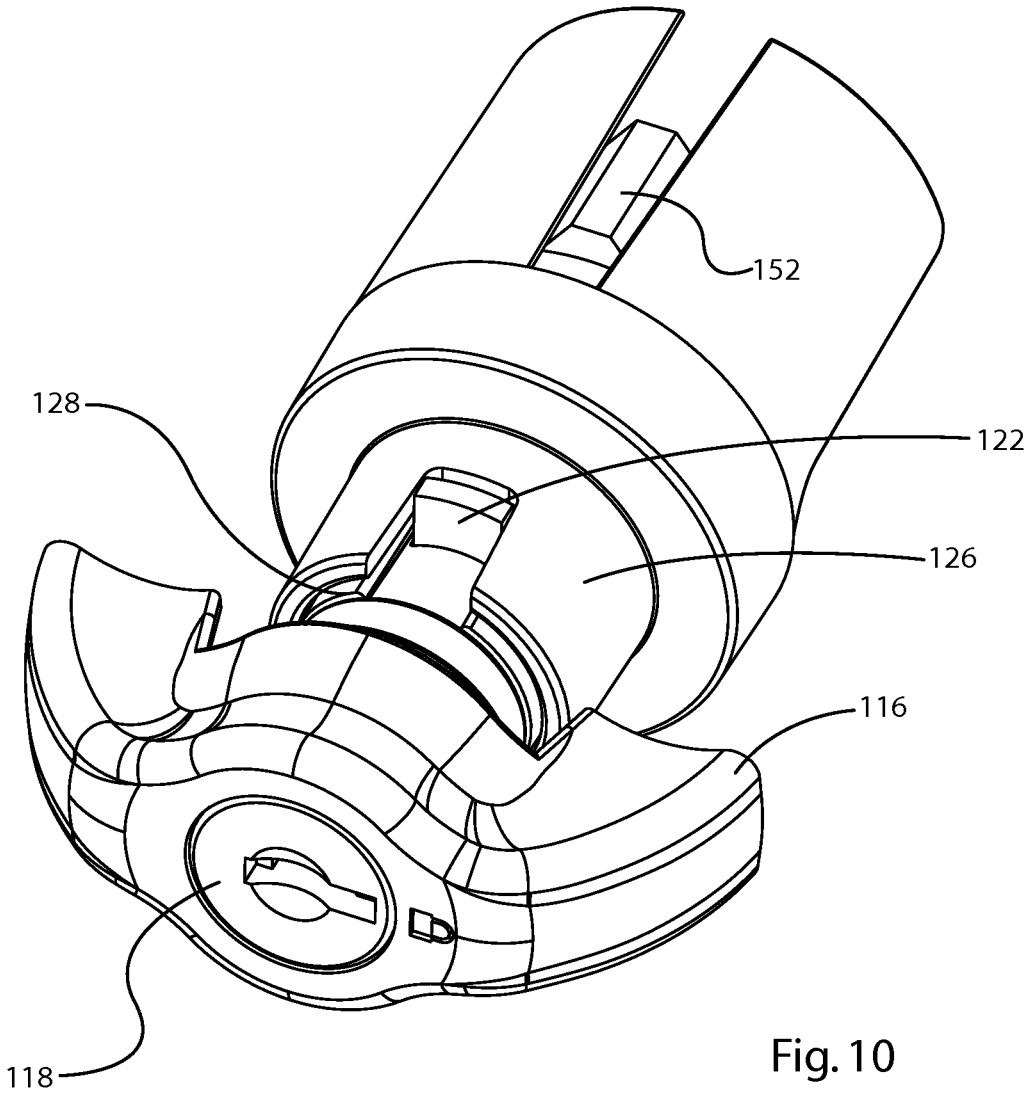
FIG. 10 is a fragmentary view showing the handle of the actuating mechanism of FIGS. 6A-6G connected to the outer cam.
Figure 11:
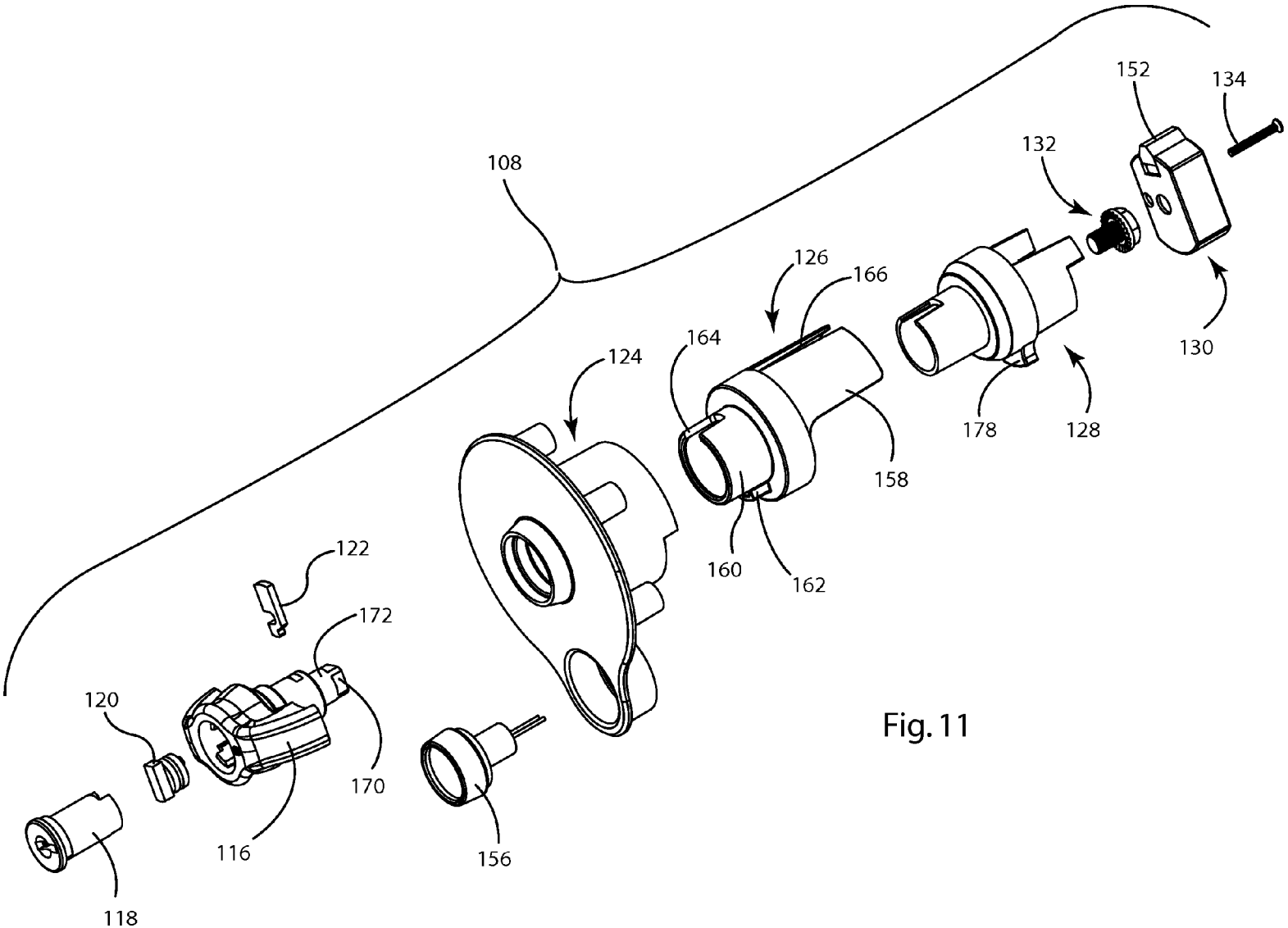
FIG. 11 is an exploded view of the actuating mechanism of FIGS. 6A-6G.
Figure 12:
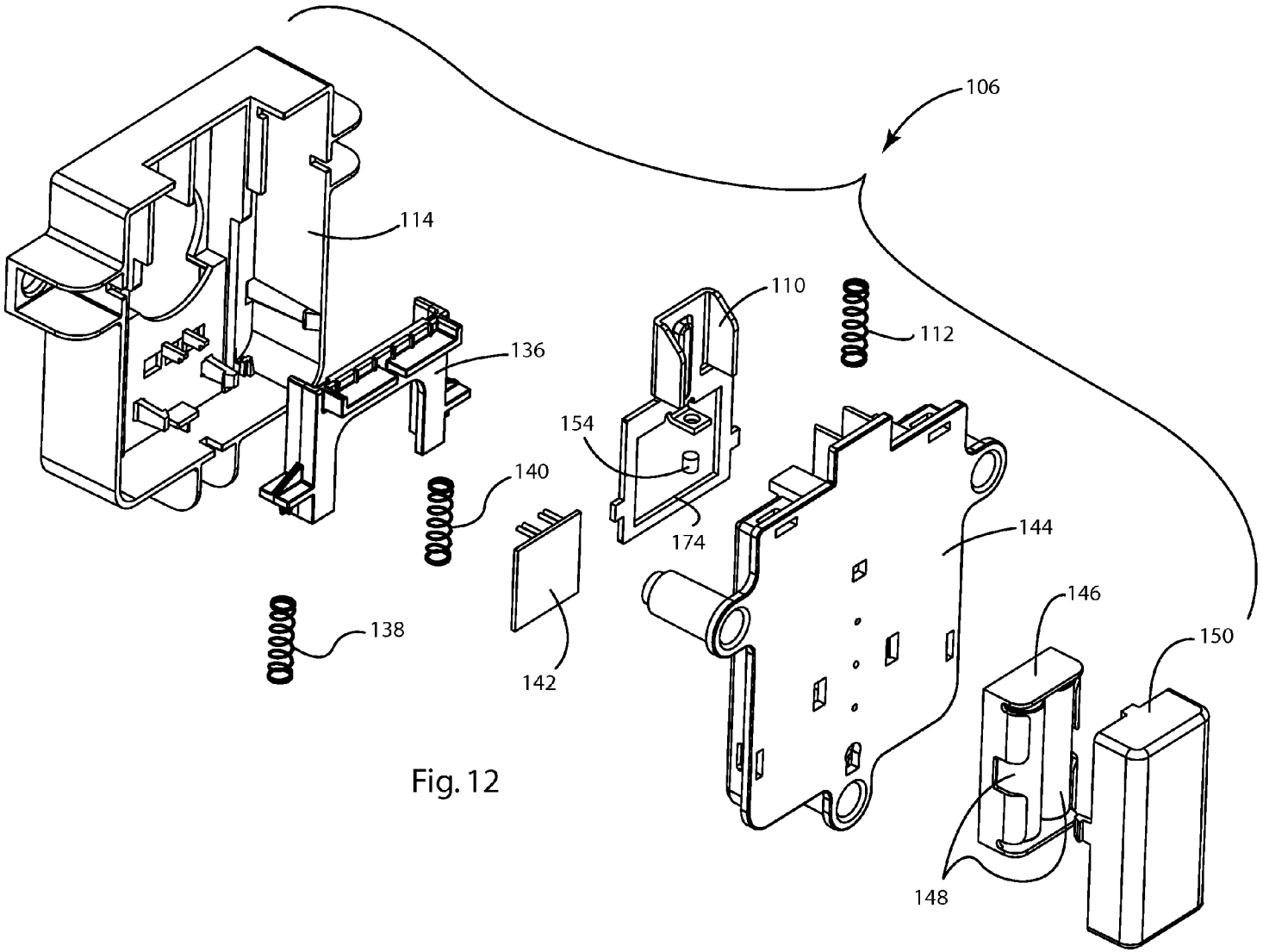
FIG. 12 is an exploded view of the latch mechanism of FIGS. 7A-7G.
Figure 14:
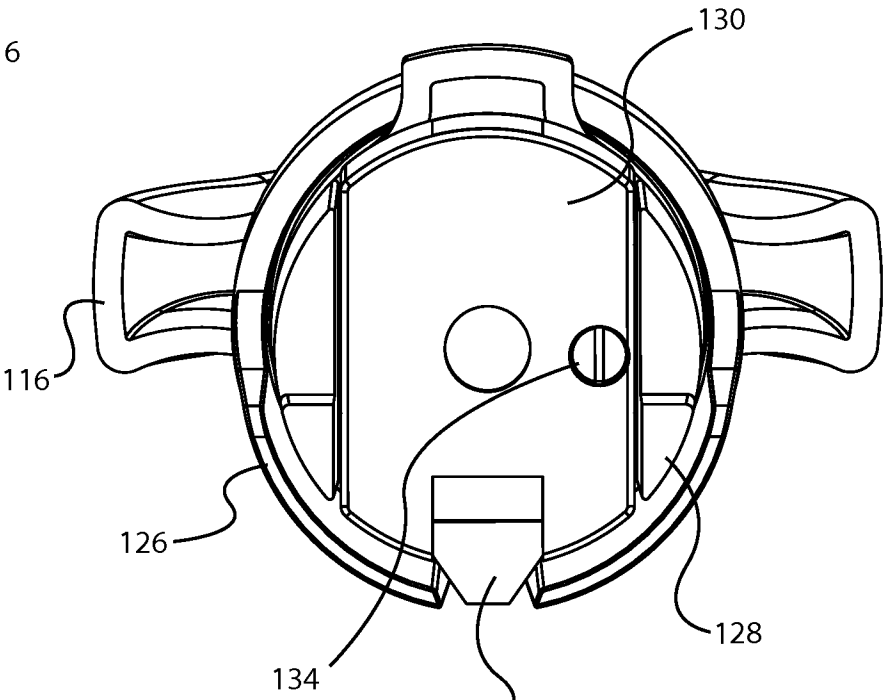
FIG. 14 is a fragmentary view of the actuating mechanism of FIGS. 6A-6G showing the motor bolt in the extended position.
Figure 13:
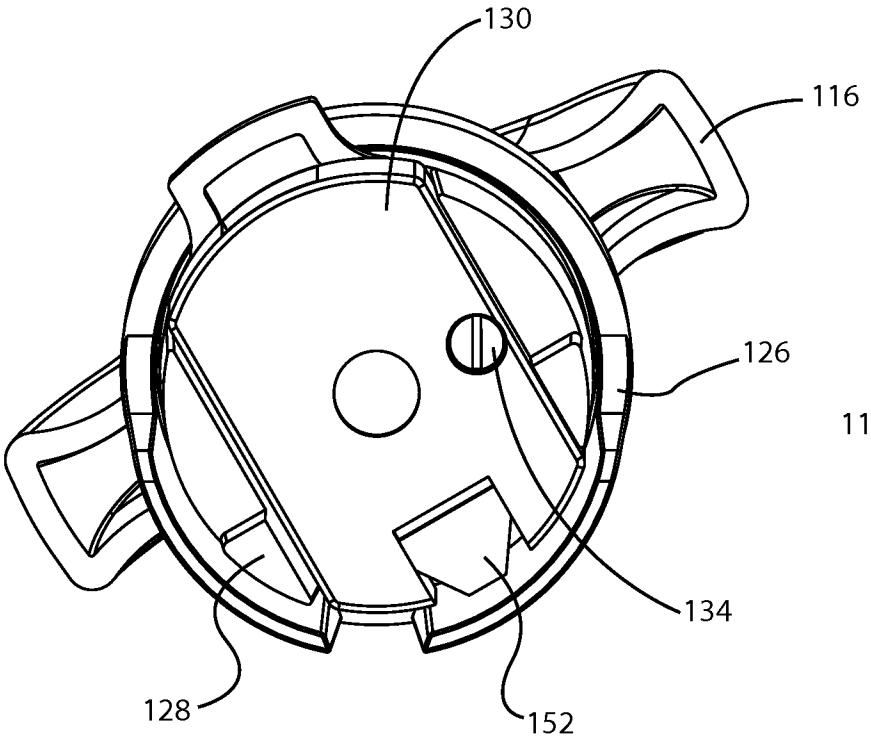
FIG. 13 is a fragmentary view of the actuating mechanism of FIGS. 6A-6G showing the motor bolt in the retracted position.
Figure 15:
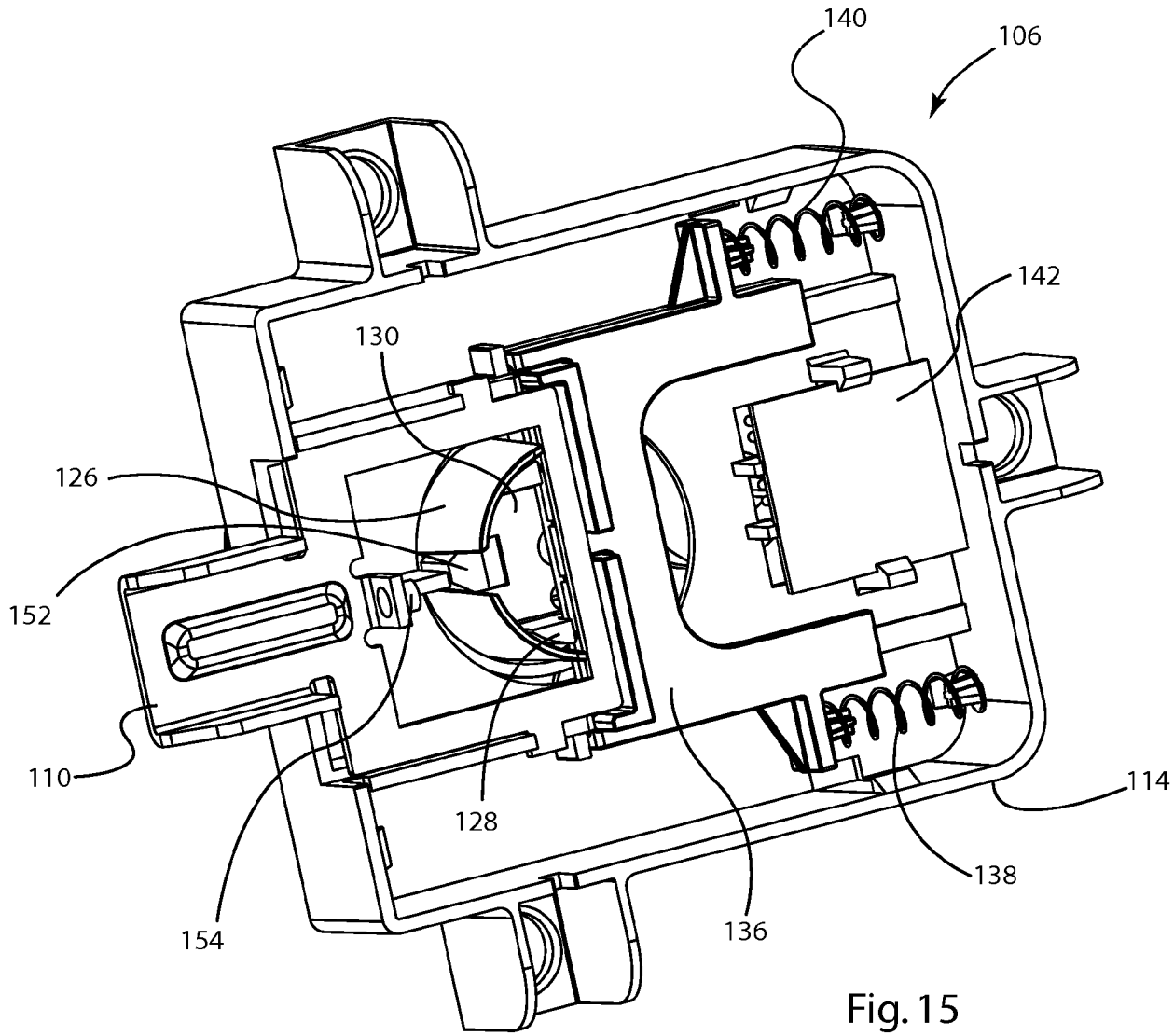
FIG. 15 is a fragmentary view of the latch of FIGS. 5A-5G shown with the latch mechanism in the latched configuration and with the latch pawl in the extended position.
Figure 16:
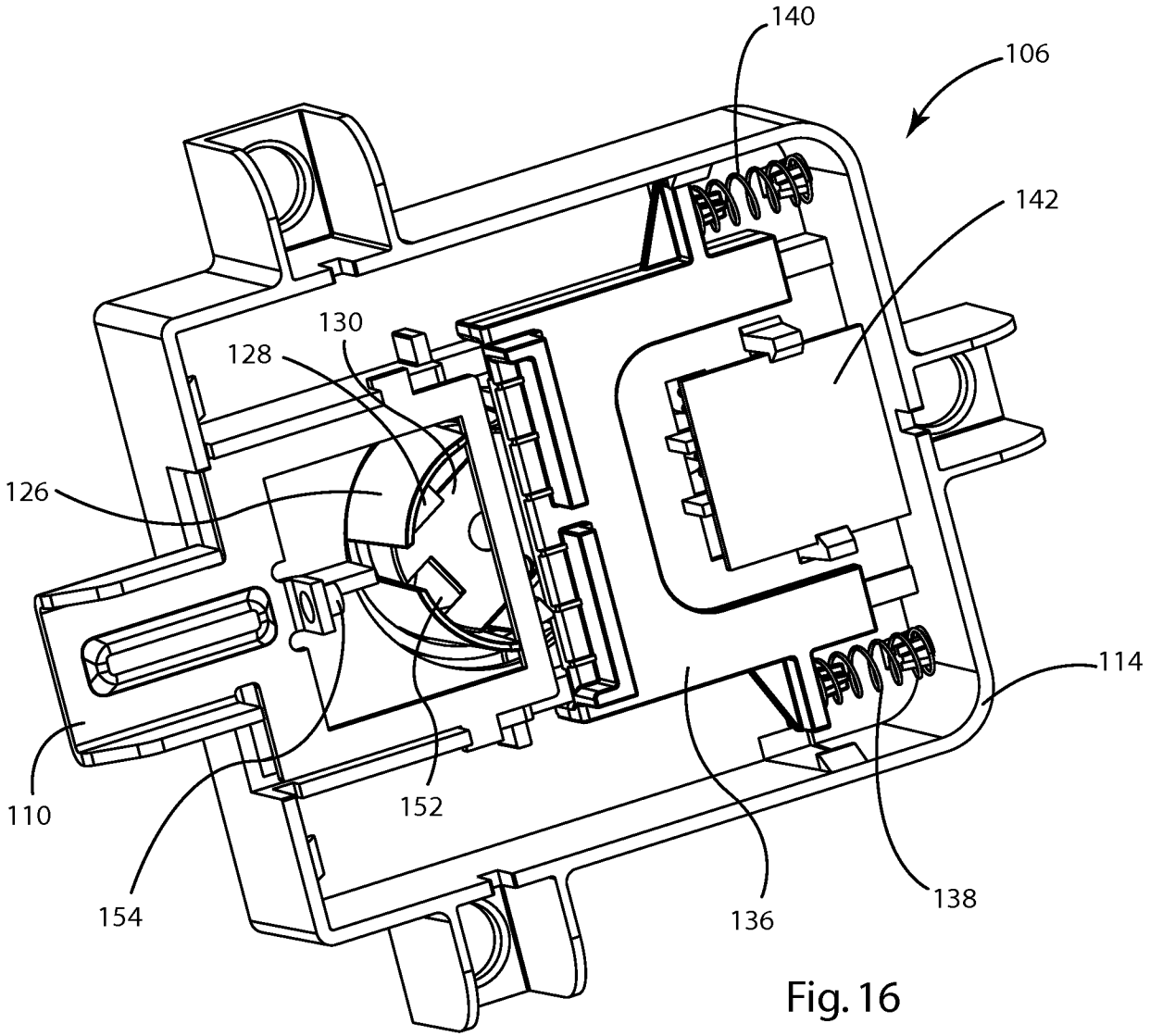
FIG. 16 is a fragmentary view of the latch of FIGS. 5A-5G shown with the handle rotated while it is disconnected from the outer cam.
Figure 17:
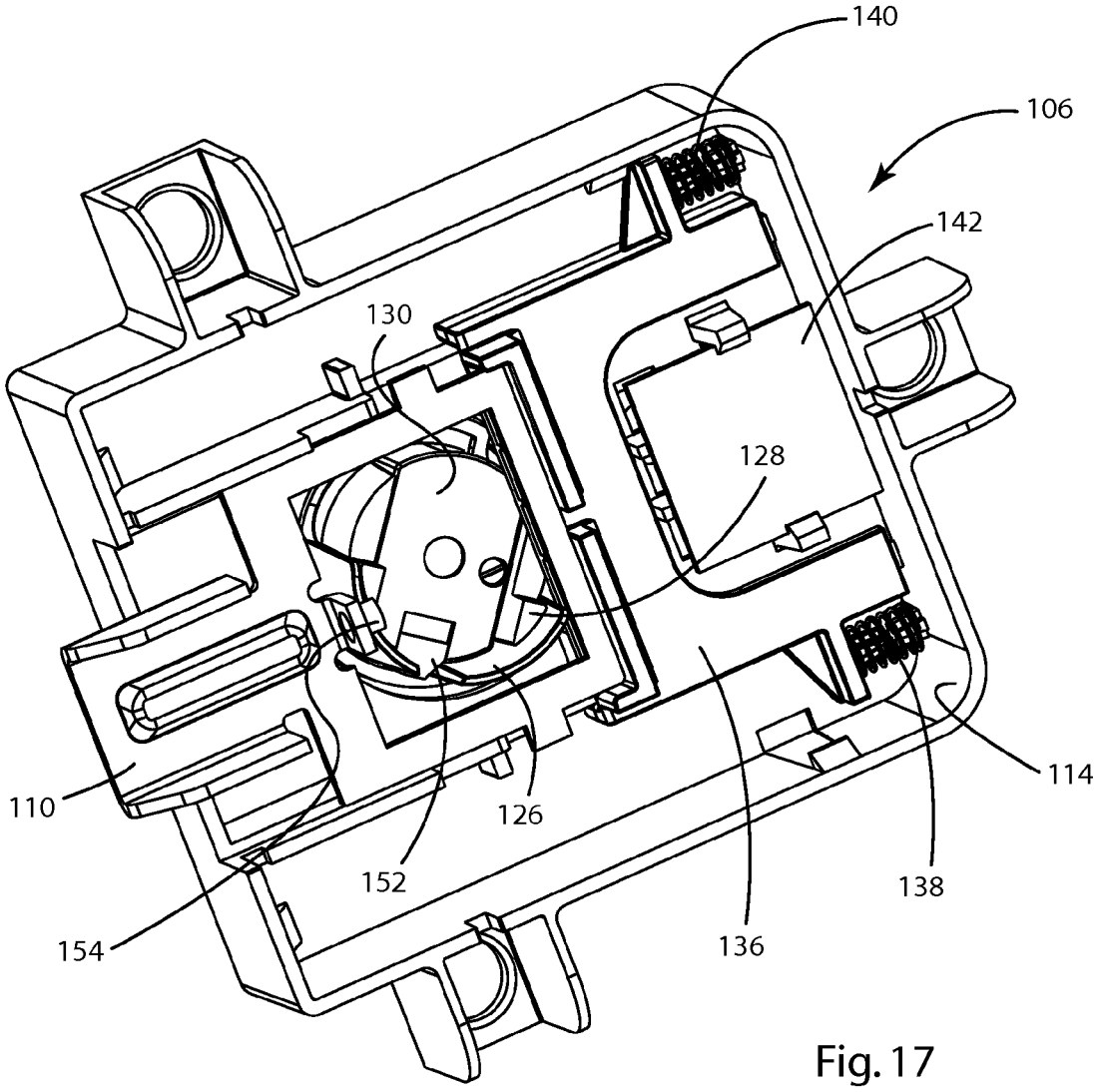
FIG. 17 is a fragmentary view of the latch of FIGS. 5A-5G shown with the latch mechanism in the unlatched configuration and with the latch pawl in the retracted position.
Figure 18A:
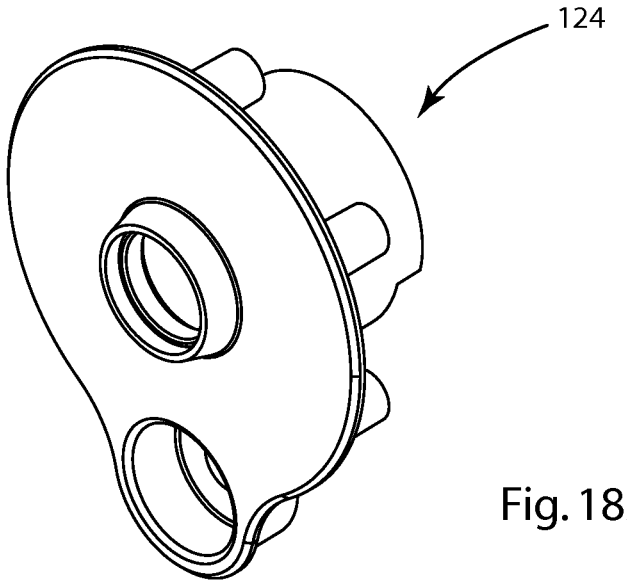
FIGS. 18A-18H are views of the housing of the actuating mechanism of FIGS. 6A-6G.
Figure 18B:
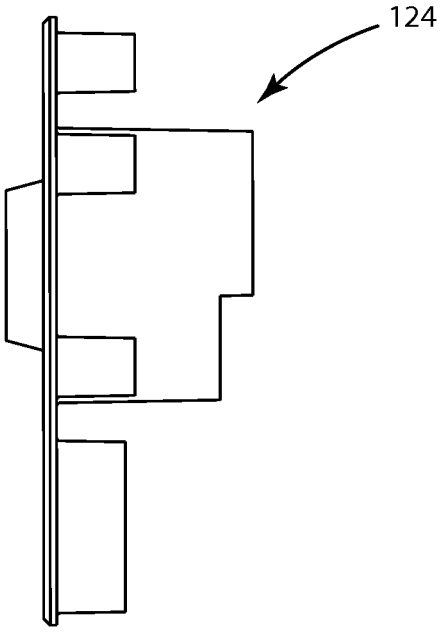
Figure 18C:
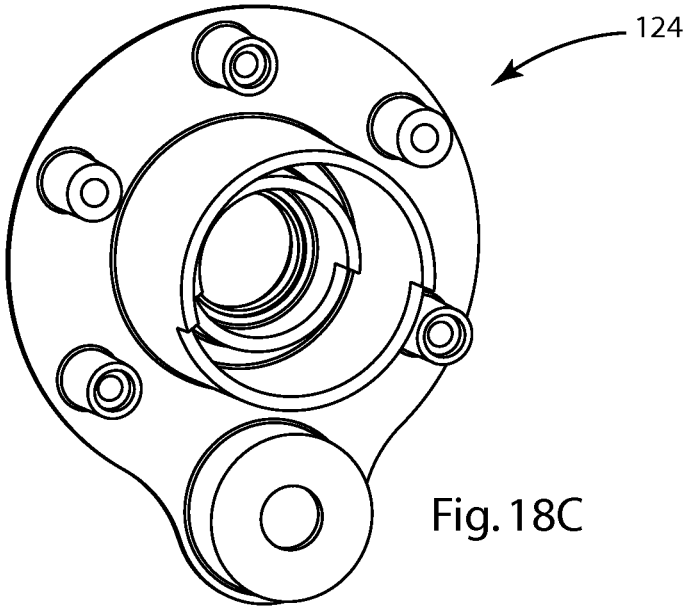
Figure 18D:
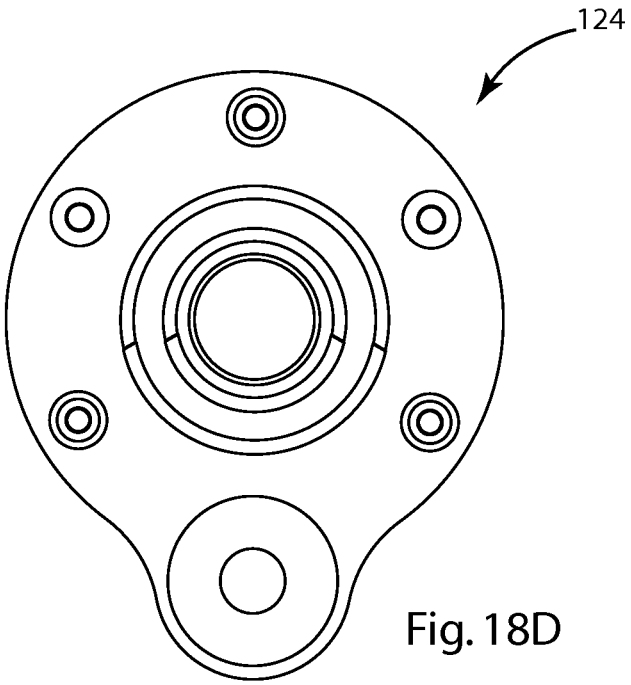
Figure 18E:
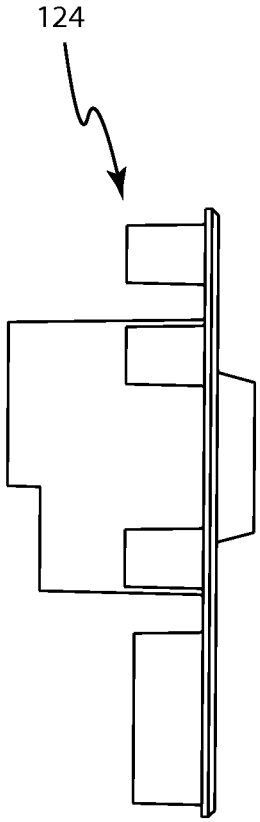
Figure 18F:
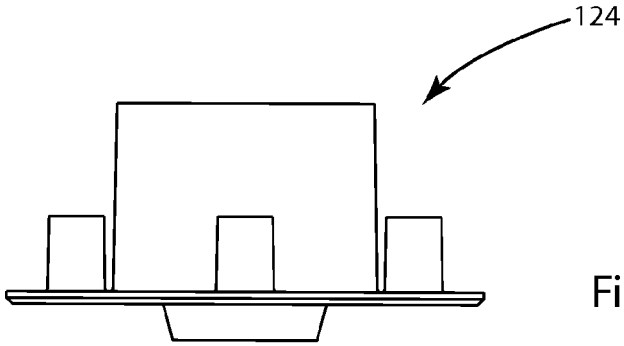
Figure 18G:
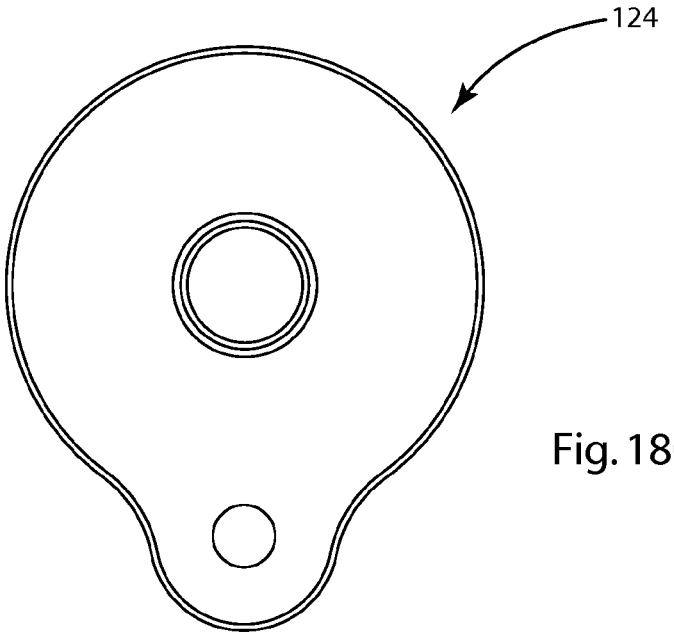
Figure 18H:
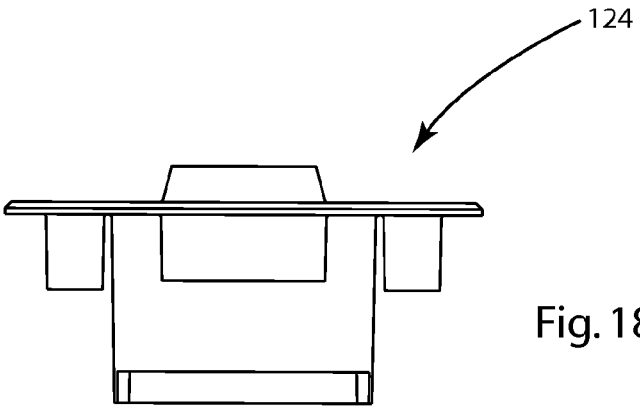
Figure 19A:
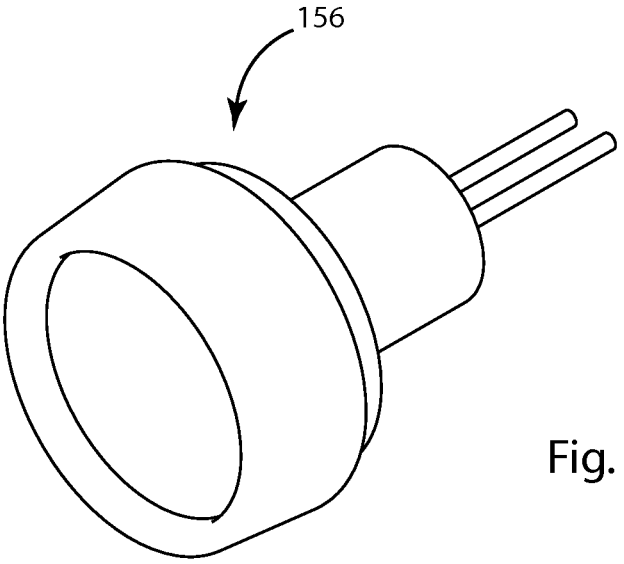
FIGS. 19A-19G are views of the proximity sensor of the actuating mechanism of FIGS. 6A-6G.
Figure 19B:
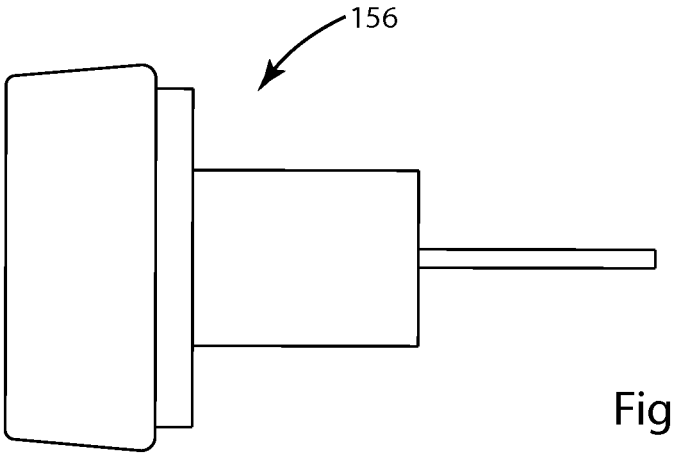
Figure 19C:
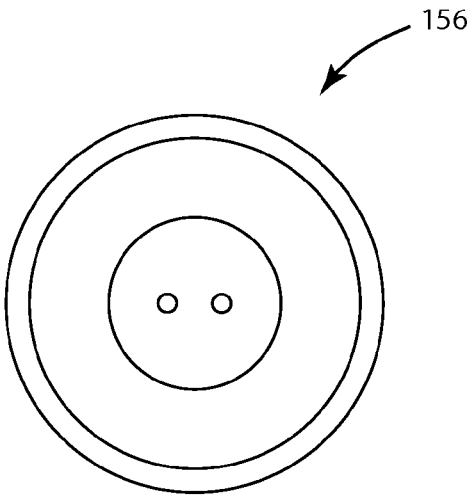
Figure 19D:
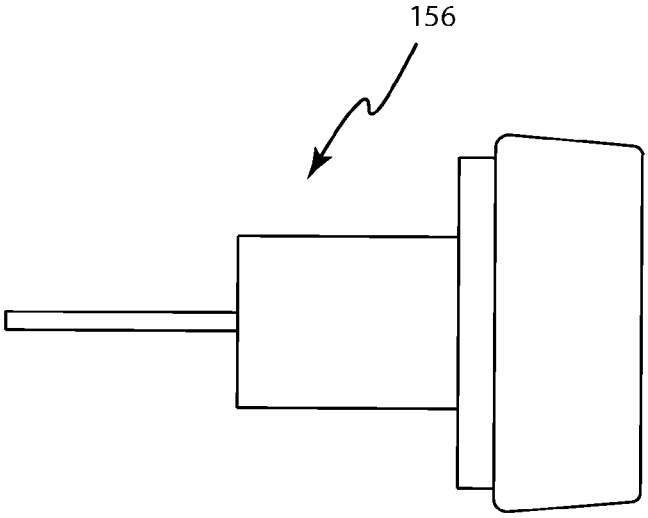
Figure 19E:
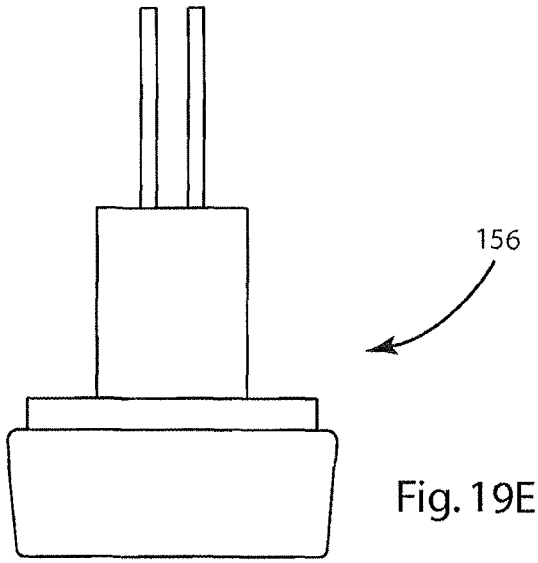
Figure 19F:
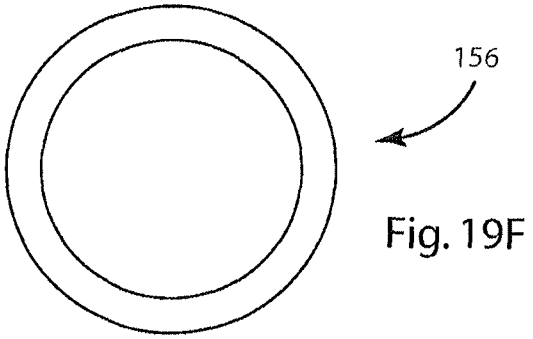
Figure 19G:
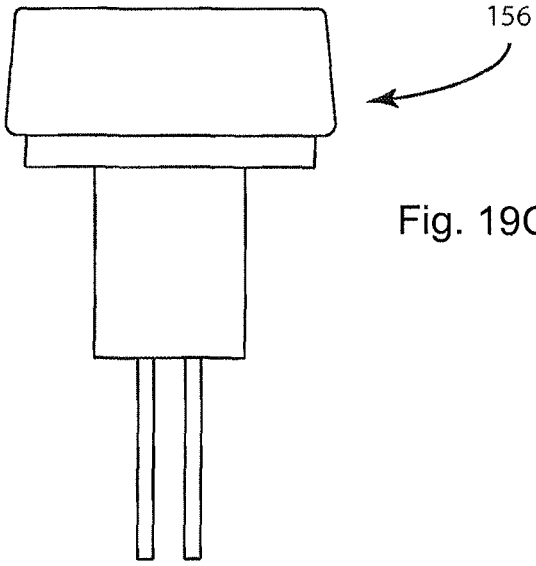
Figure 20A:
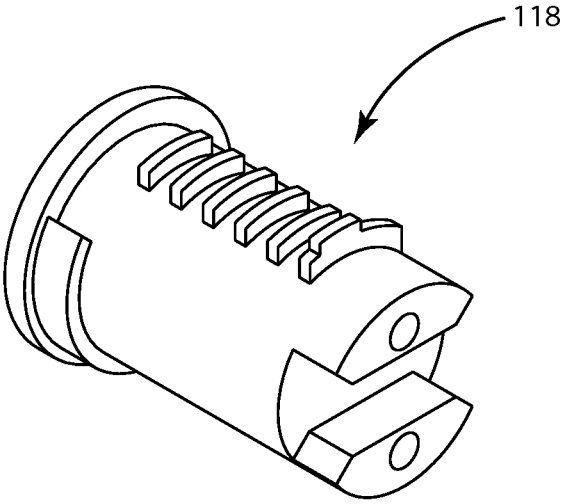
FIGS. 20A-20F are views of the cylinder lock of the actuating mechanism of FIGS. 6A-6G.
Figure 20B:
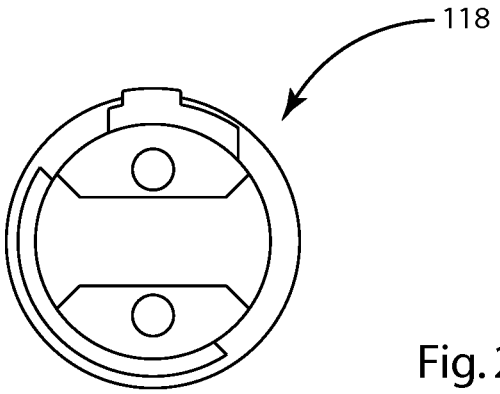
Figure 20C:
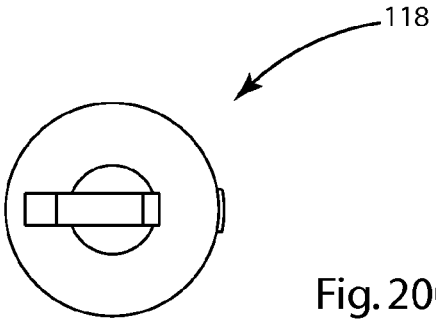
Figure 20D:
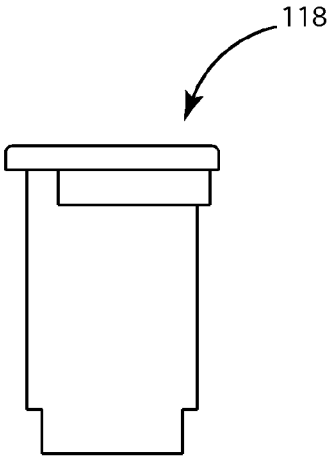
Figure 20E:
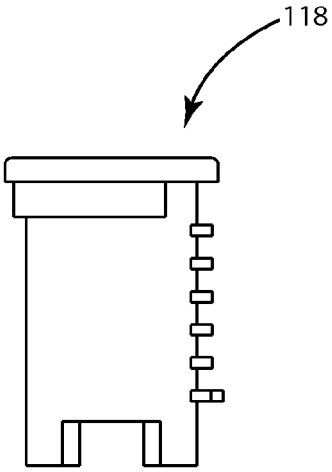
Figure 20F:
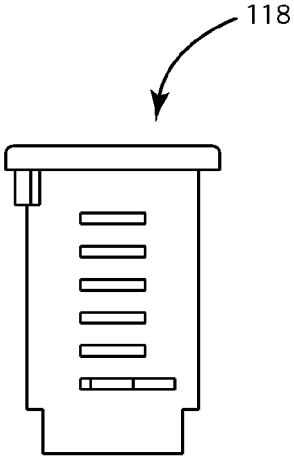
Figure 21B:
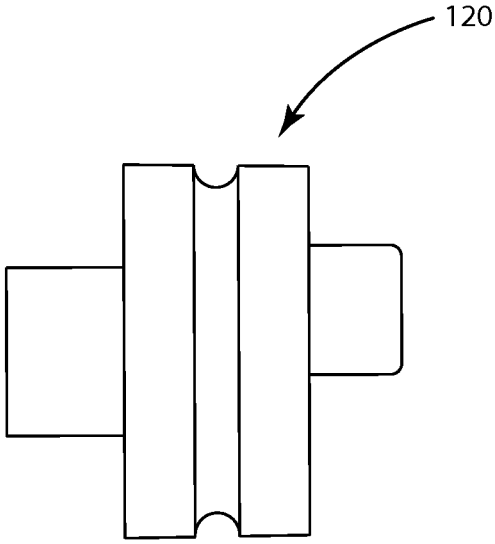
FIGS. 21A-21F are views of the eccentric cam of the actuating mechanism of FIGS. 6A-6G.
Figure 21A:
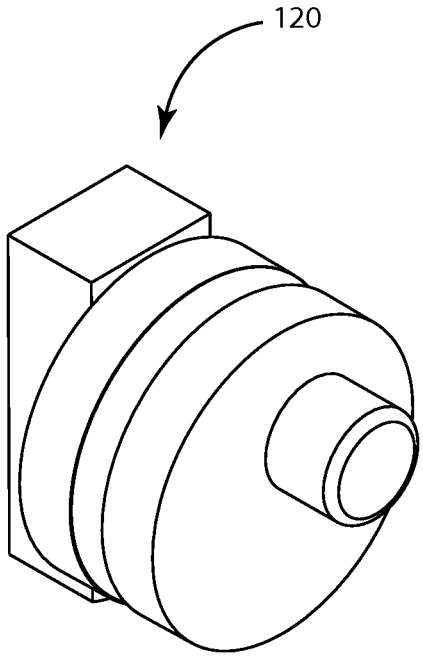
Figure 21E:
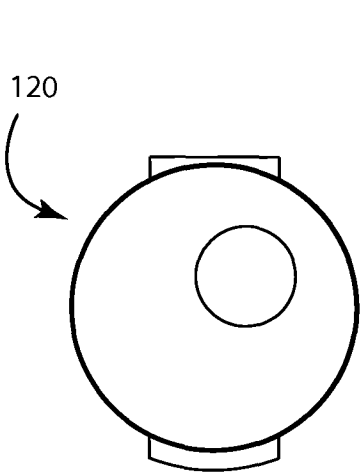
Figure 21D:
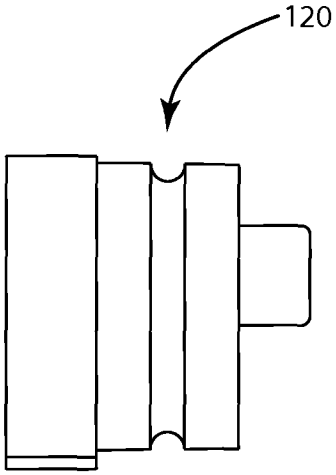
Figure 21F:
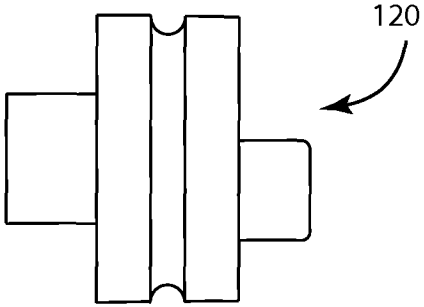
Figure 21C:
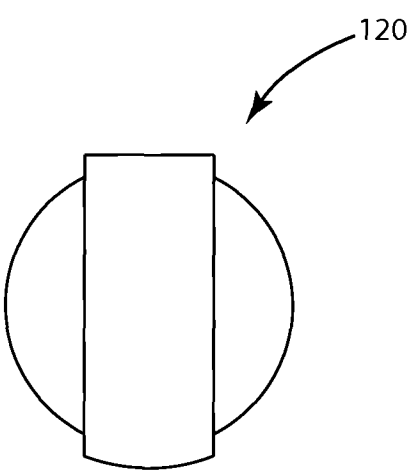
Figure 22A:
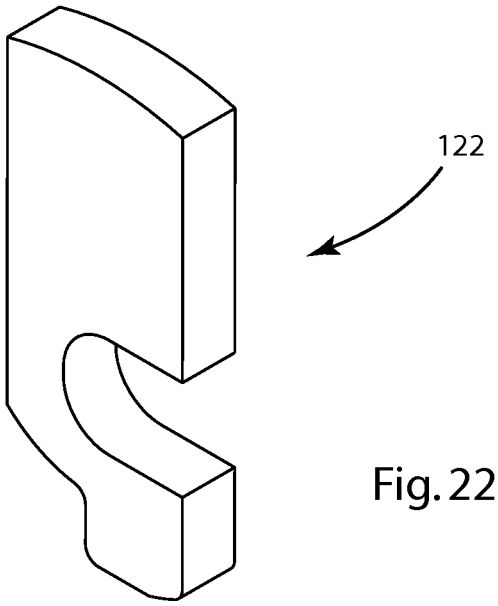
FIGS. 22A-22F are views of the lock bolt of the actuating mechanism of FIGS. 6A-6G.
Figure 22B:
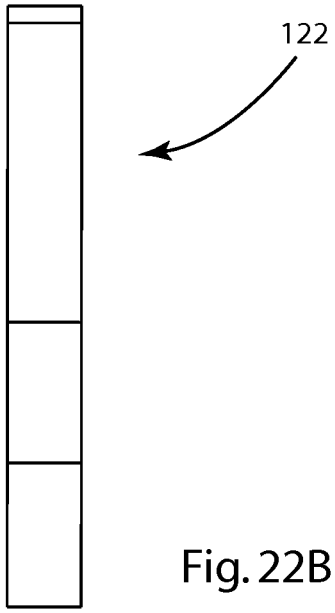
Figure 22C:
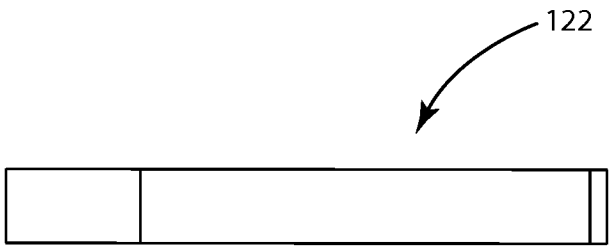
Figure 22E:
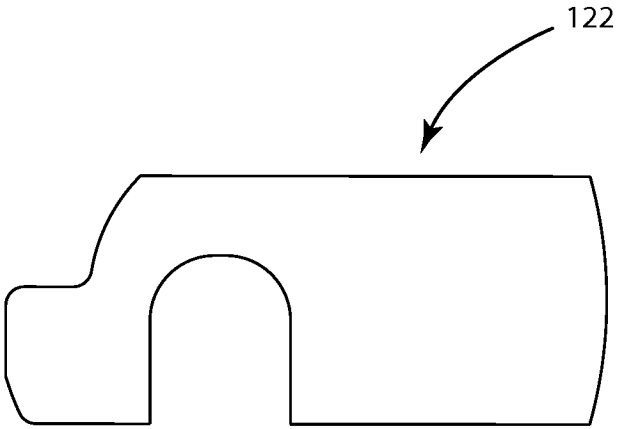
Figure 22F:
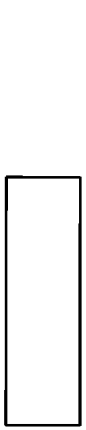
Figure 22D:
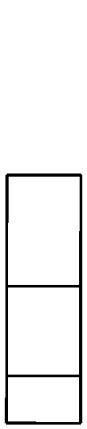
Figure 23A:
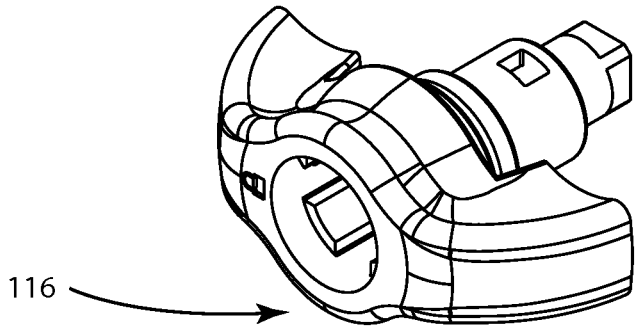
FIGS. 23A-23G are views of the handle or knob of the actuating mechanism of FIGS. 6A-6G.
Figure 23B:
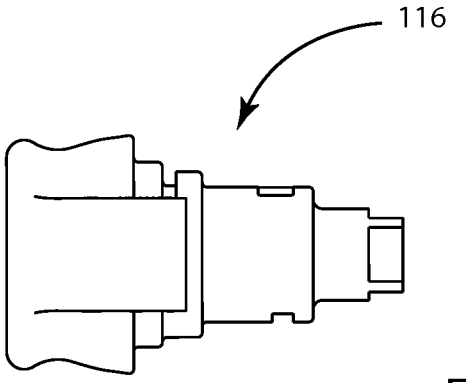
Figure 23C:
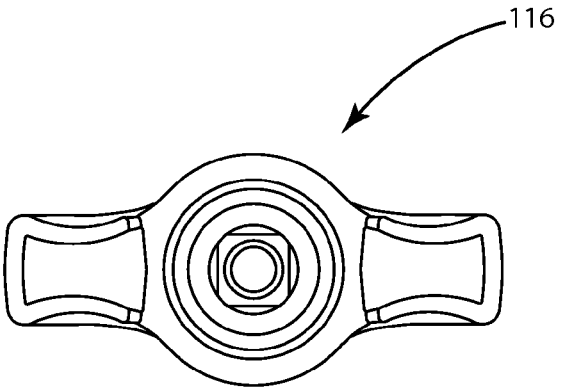
Figure 23D:
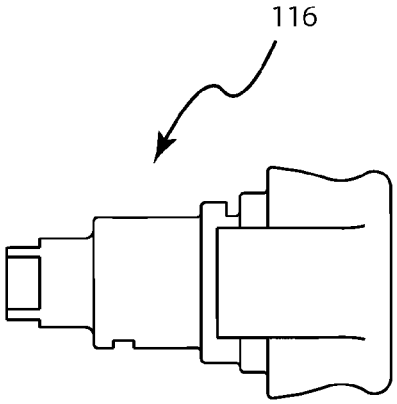
Figure 23G:
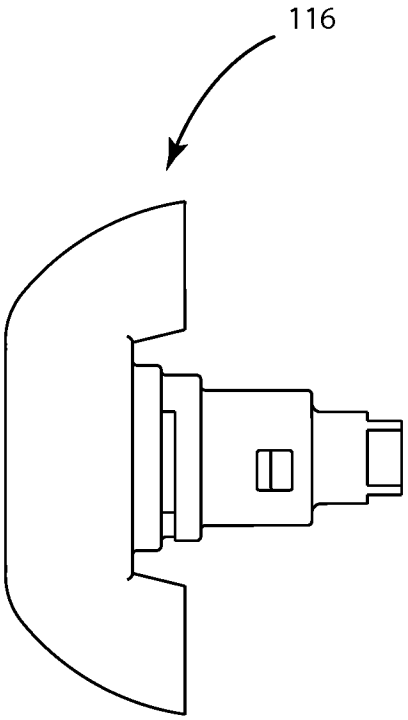
Figure 23F:
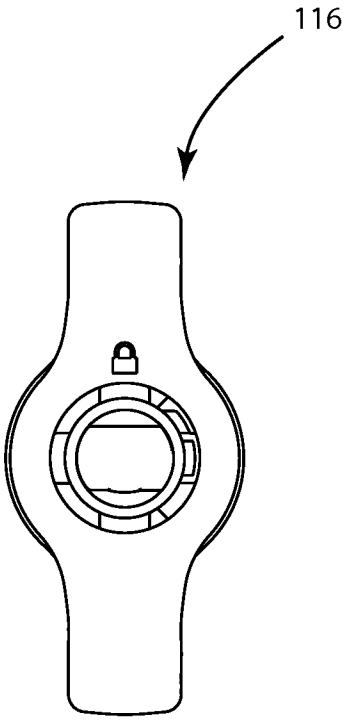
Figure 23E:
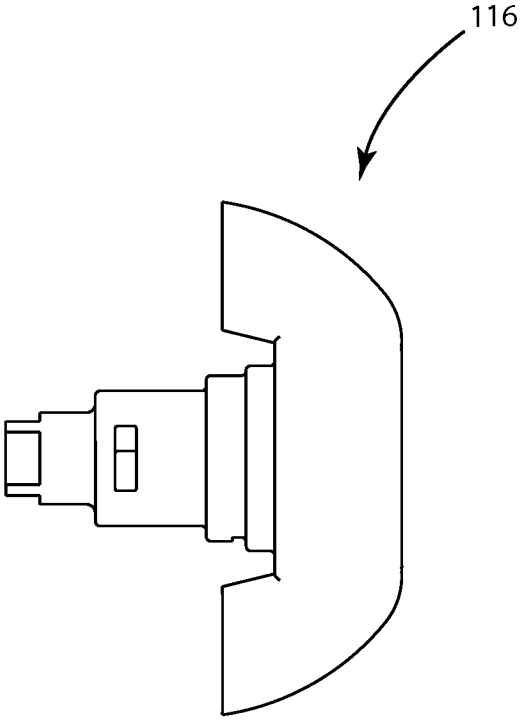
Figure 24A:
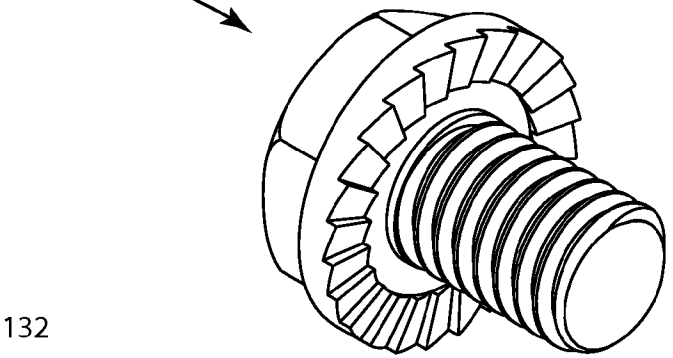
FIGS. 24A-24D are views of the screw for securing the handle to the inner cam of the actuating mechanism of FIGS. 6A-6G.
Figure 24D:
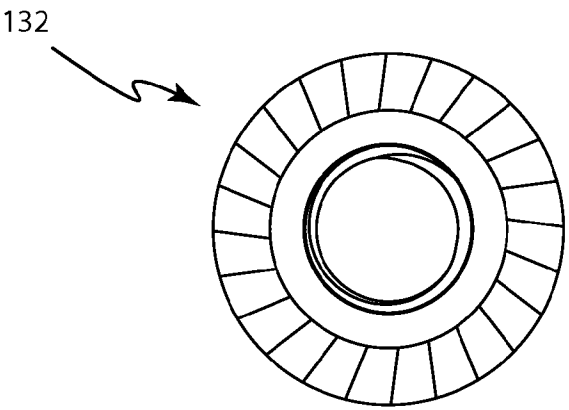
Figure 24C:
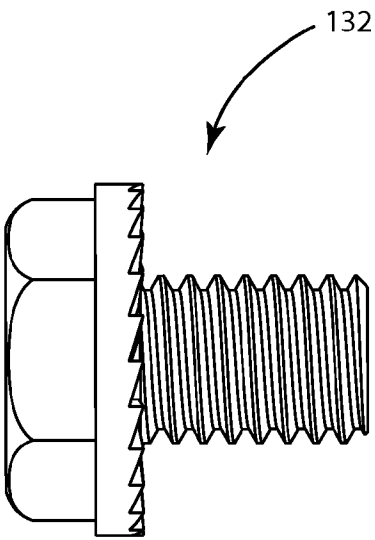
Figure 24B:
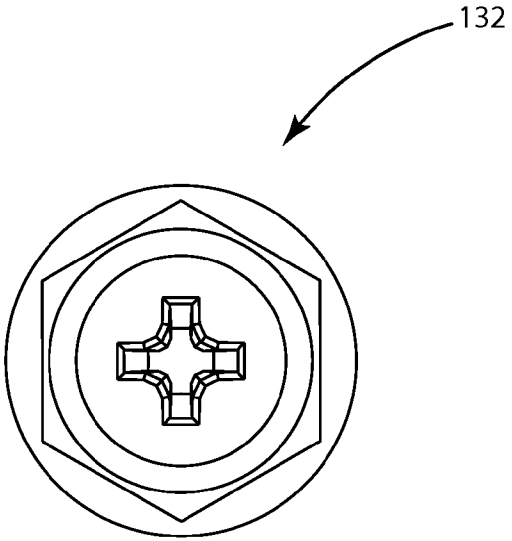
Figure 25A:
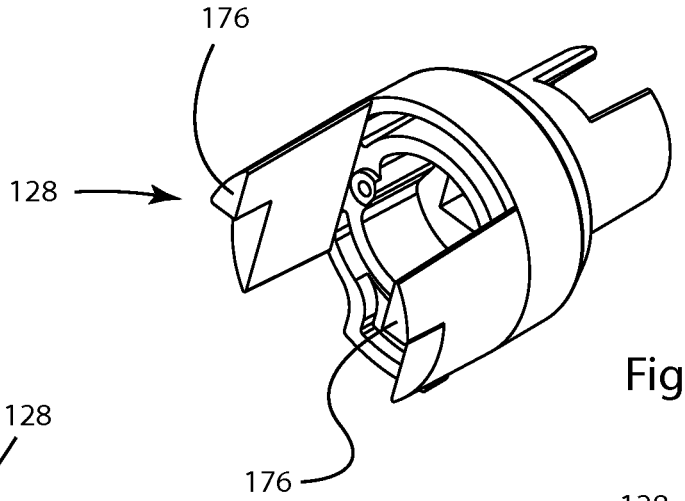
FIGS. 25A-25H are views of the inner cam of the actuating mechanism of FIGS. 6A-6G.
Figure 25B:
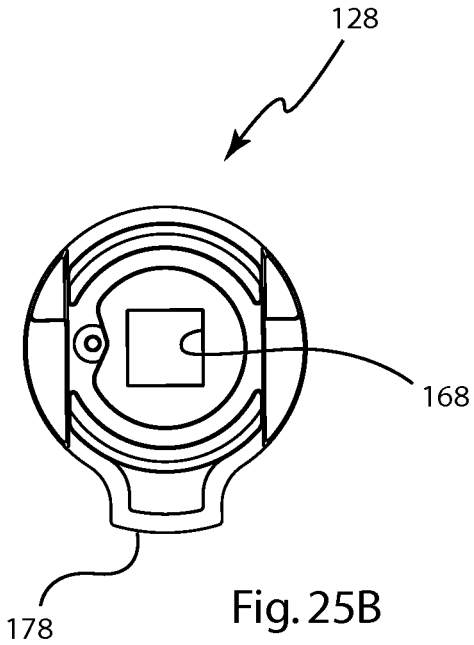
Figure 25C:
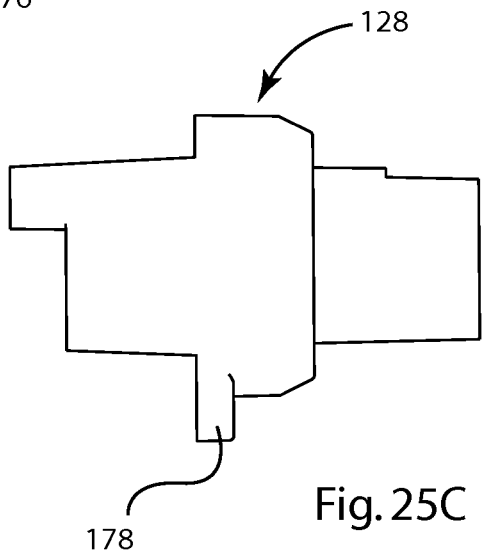
Figure 25D:
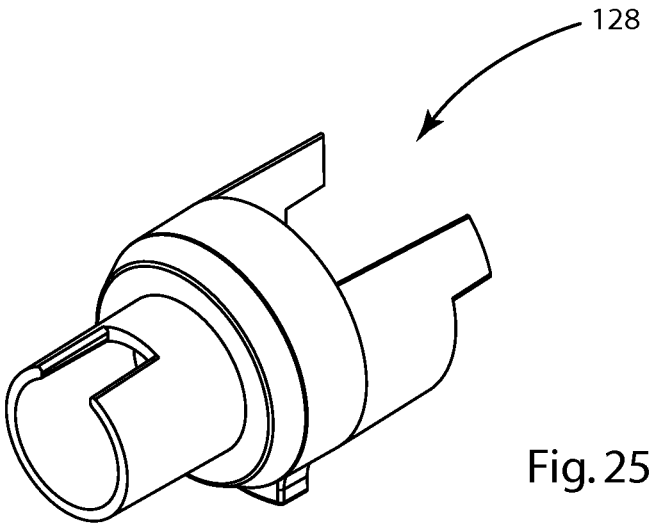
Figure 25E:
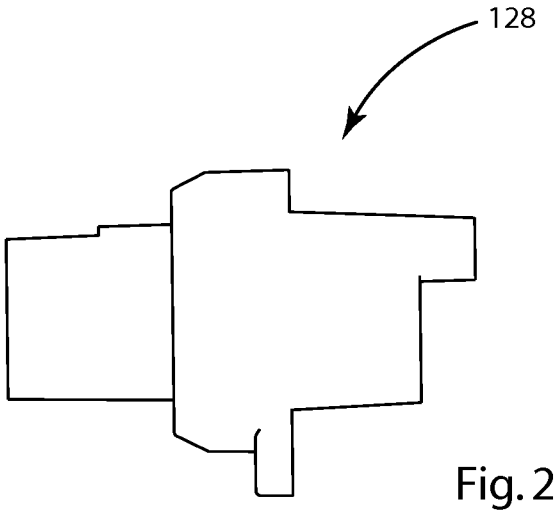
Figure 25F:
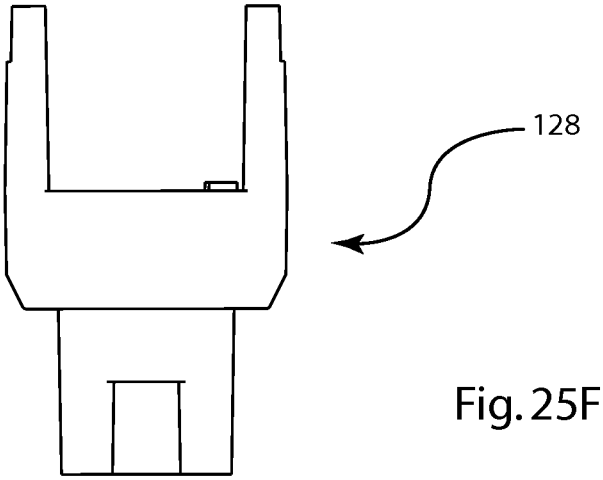
Figure 25G:
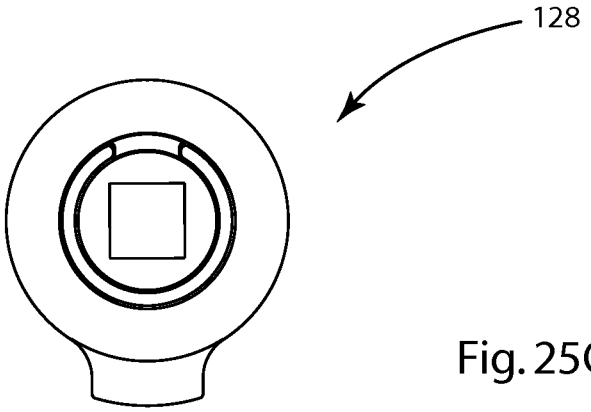
Figure 25H:
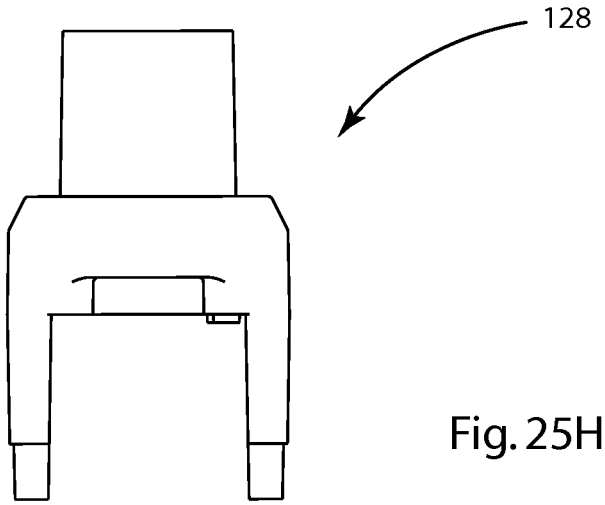
Figure 26B:
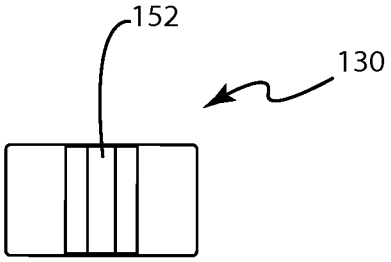
FIGS. 26A-26G are views of the motor of the actuating mechanism of FIGS. 6A-6G.
Figure 26A:
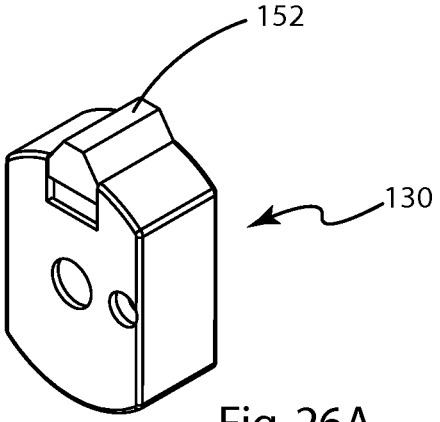
Figure 26C:
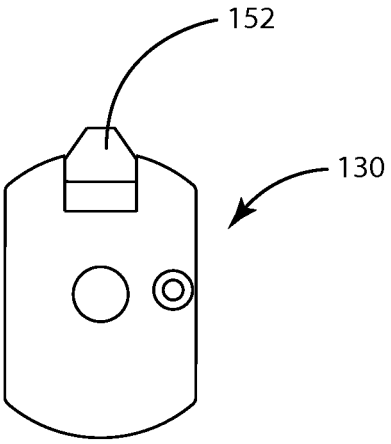
Figure 26D:
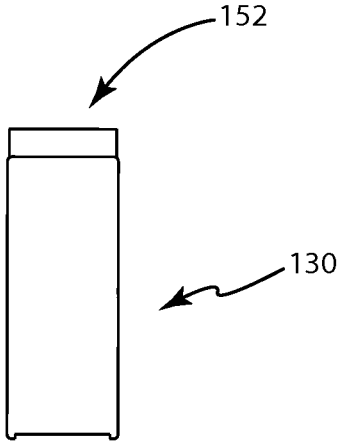
Figure 26E:
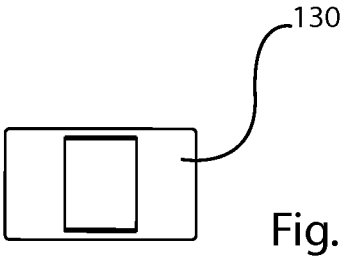
Figure 26F:
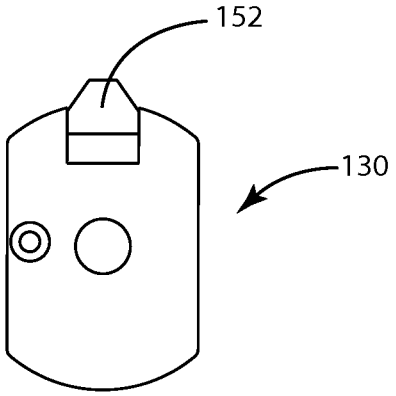
Figure 26G:
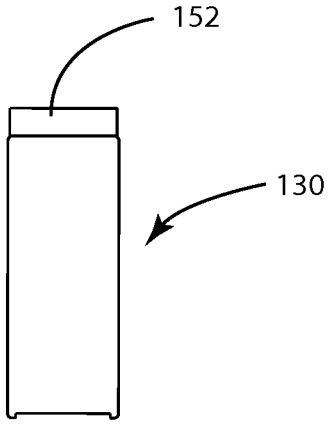
Figure 27A:
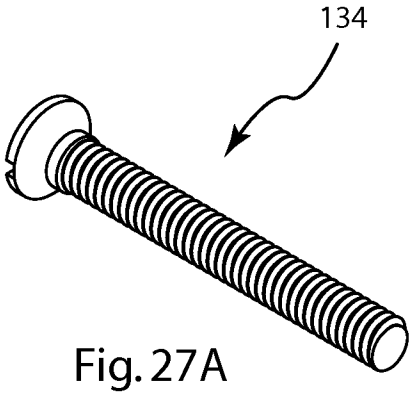
FIGS. 27A-27D are views of the screw for securing the motor to the inner cam of the actuating mechanism of FIGS. 6A-6G.
Figure 27D:
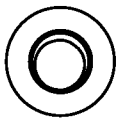
Figure 27C:
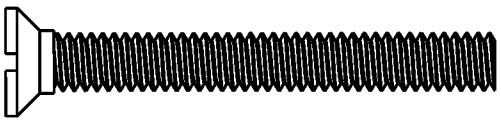
Figure 27B:
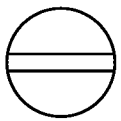
Figure 28A:
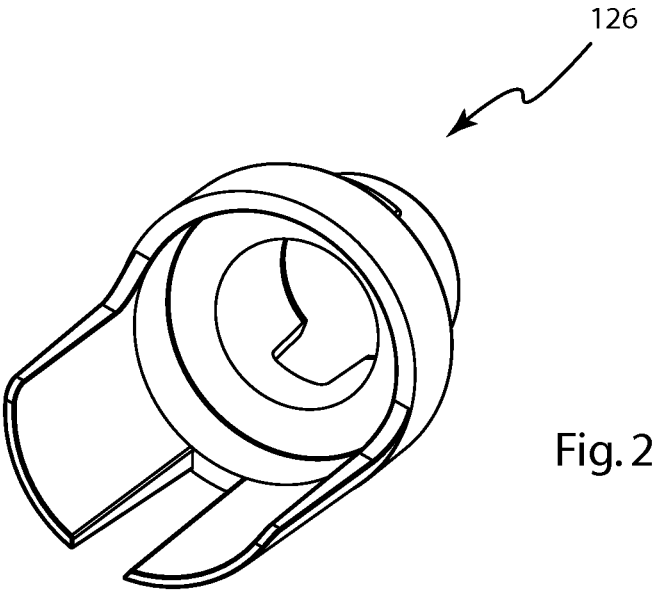
FIGS. 28A-28H are views of the outer cam of the actuating mechanism of FIGS. 6A-6G.
Figure 28B:
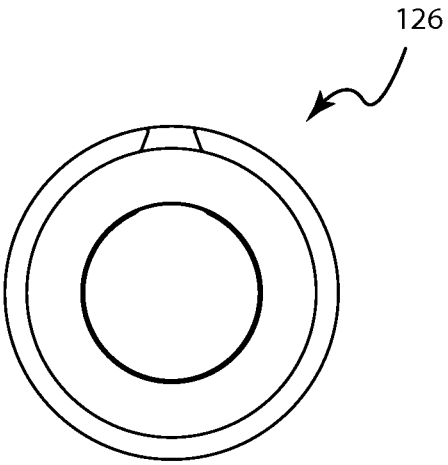
Figure 28C:
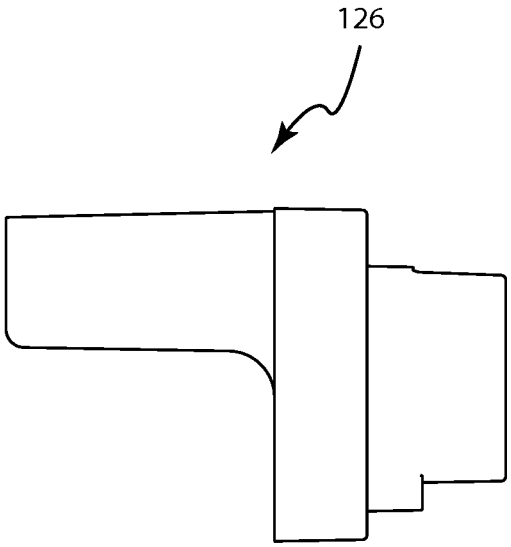
Figure 28D:
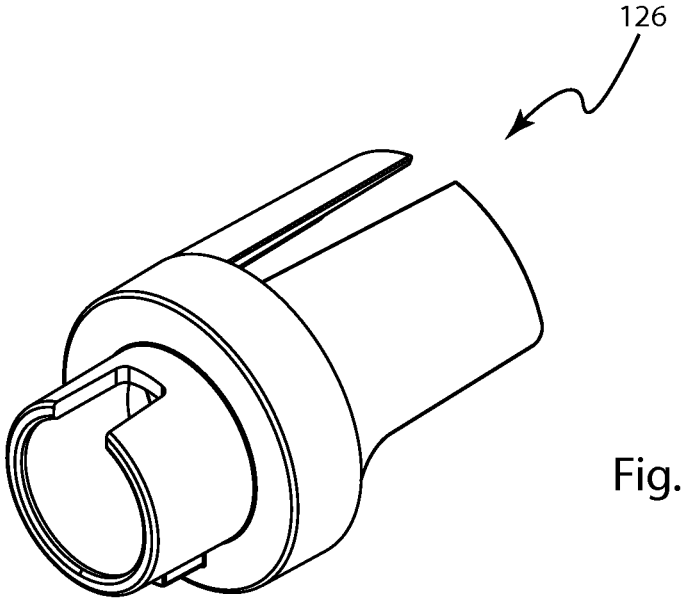
Figure 28E:
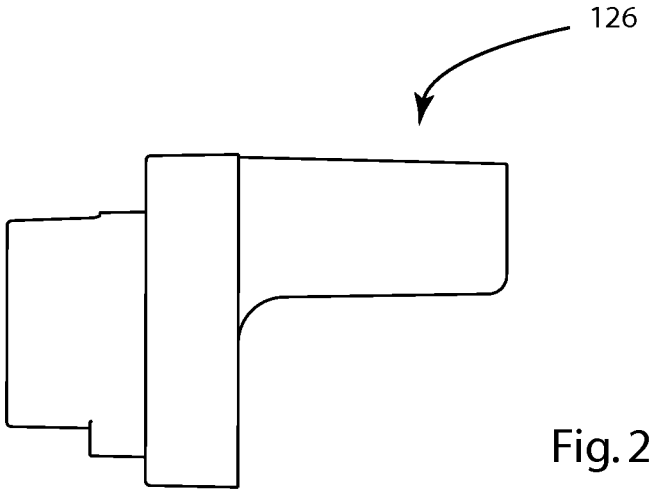
Figure 28F:
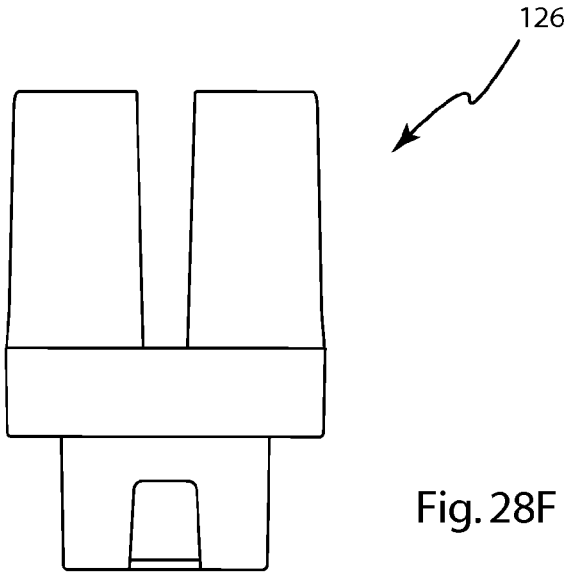
Figure 28G:
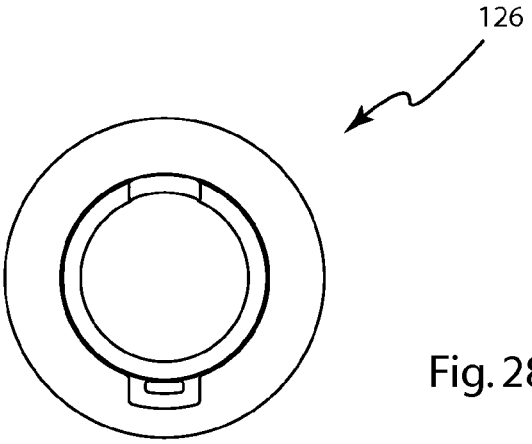
Figure 28H:
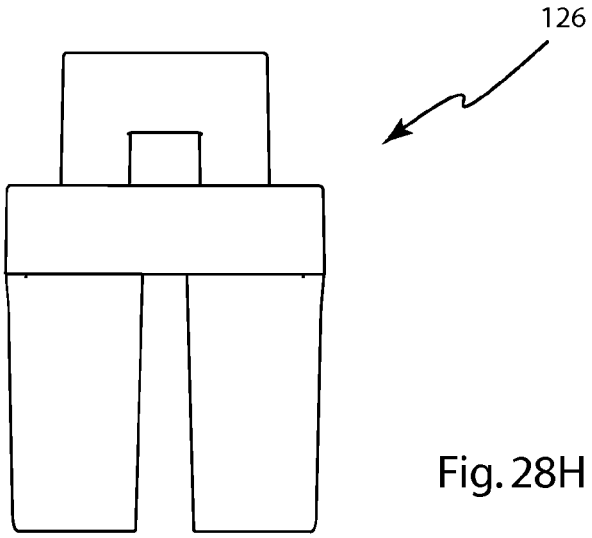
Figure 29A:
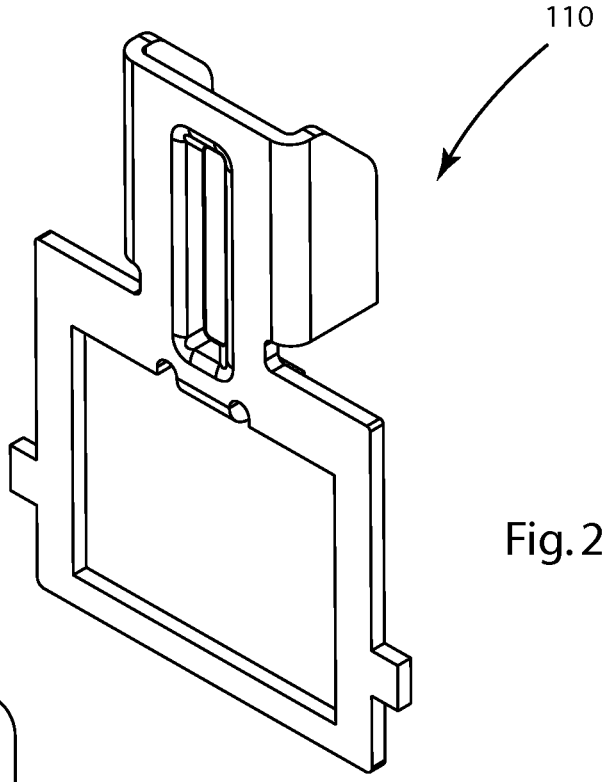
FIGS. 29A-29G are views of the latch pawl of the latch mechanism of FIGS. 7A-7G.
Figure 29B:
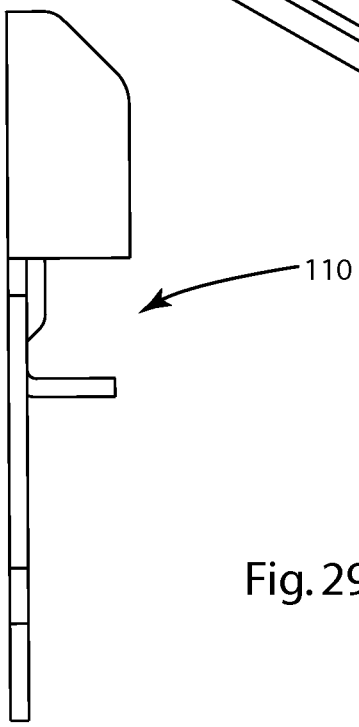
Figure 29C:
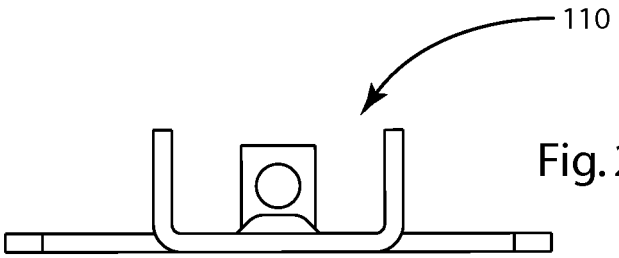
Figure 29D:
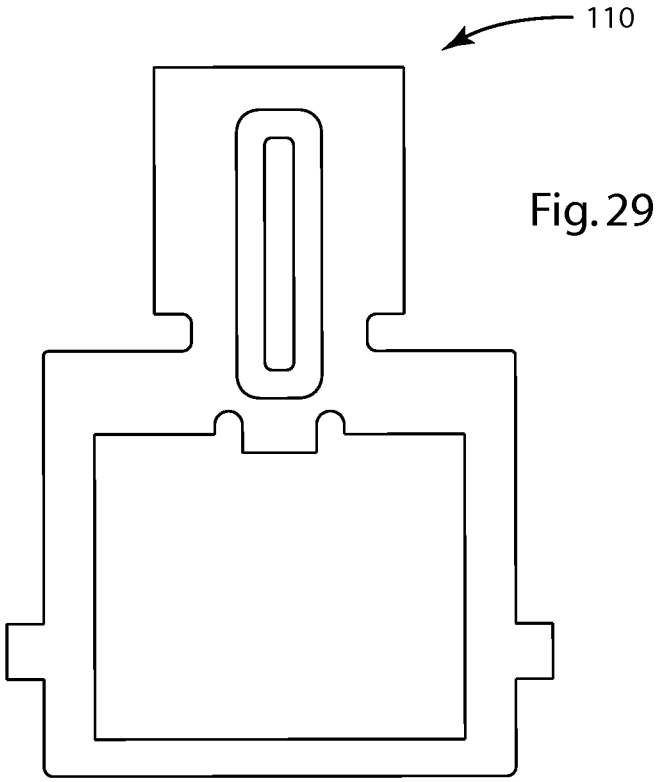
Figure 29E:
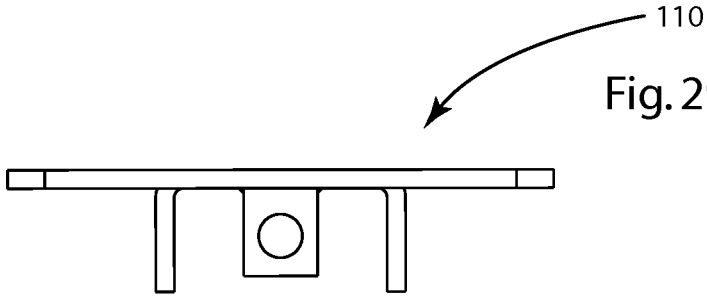
Figure 29F:
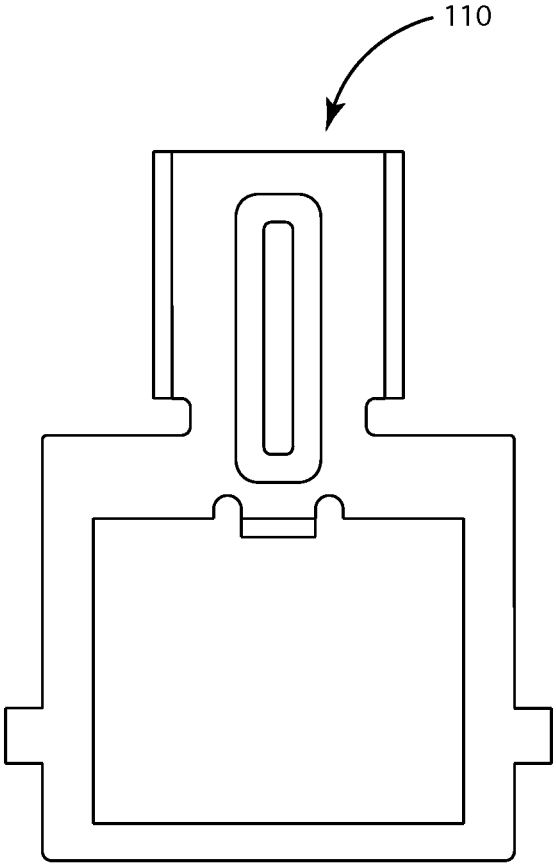
Figure 29G:
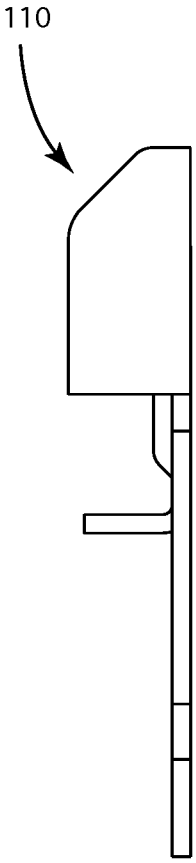
Figure 30:
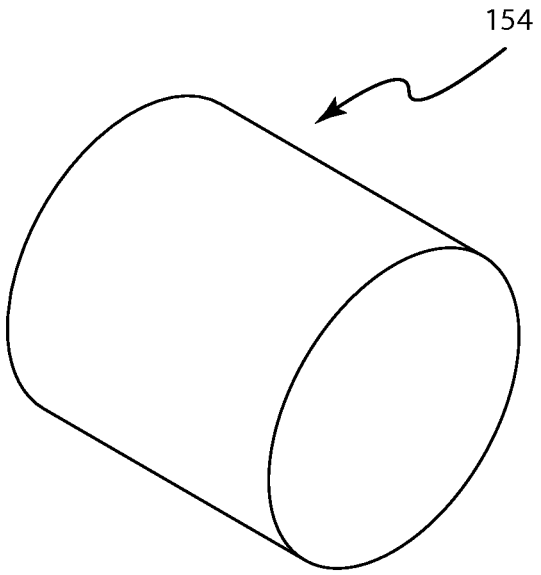
FIG. 30 is an isometric view of the spring guide of the latch pawl of the latch mechanism of FIGS. 7A-7G.
Figure 31A:
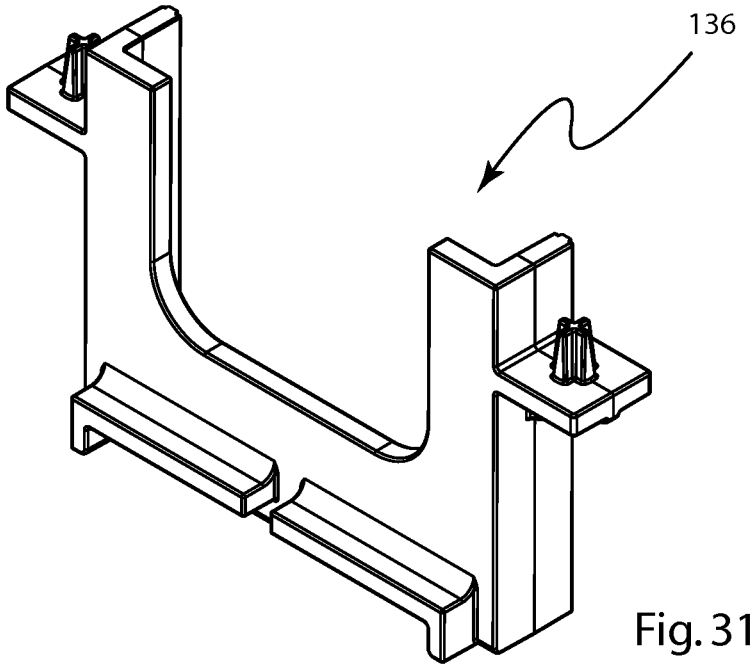
FIGS. 31A-31G are views of the return spring slide of the actuating mechanism of the latch of FIGS. 5A-5G.
Figure 31B:
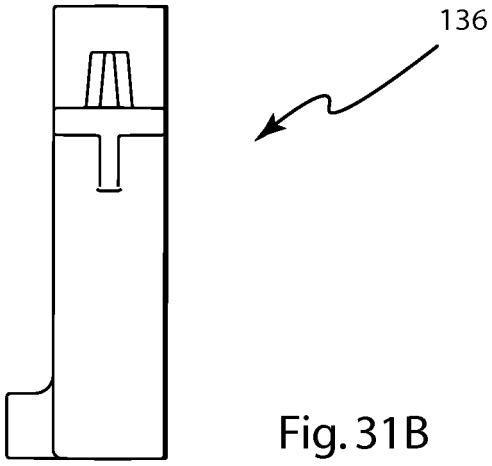
Figure 31C:
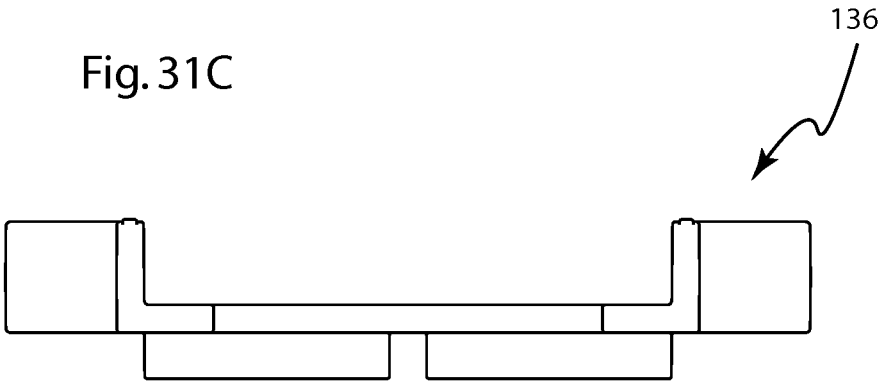
Figure 31D:
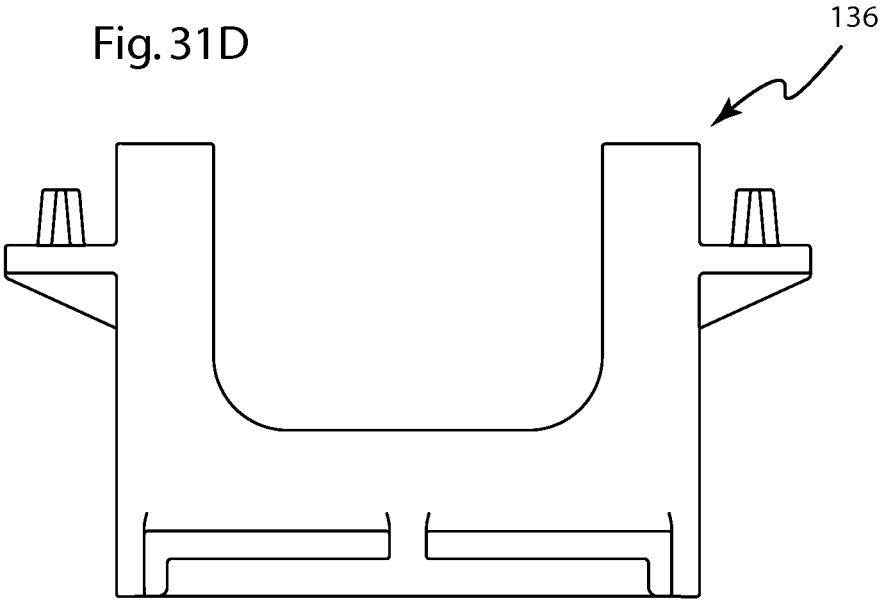
Figure 31E:
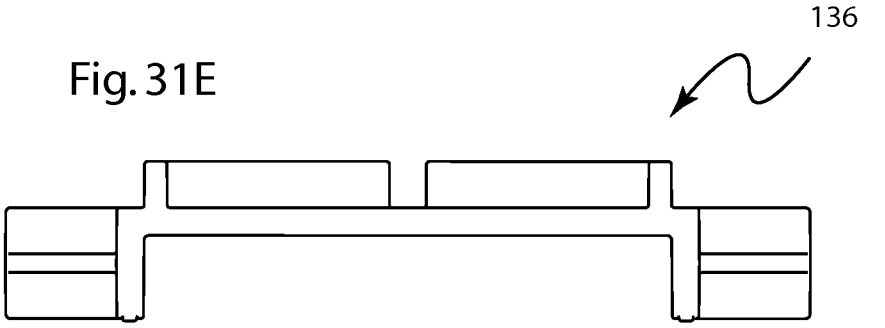
Figure 31F:
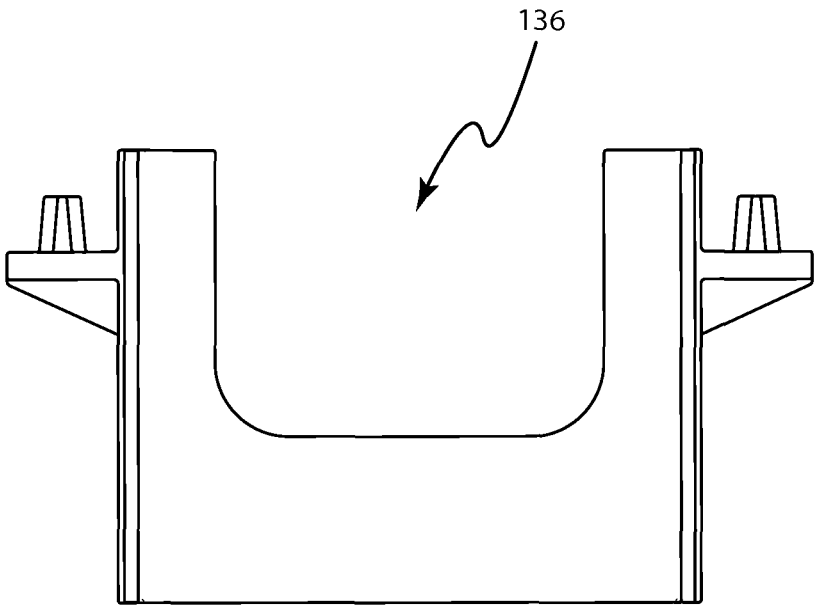
Figure 31G:
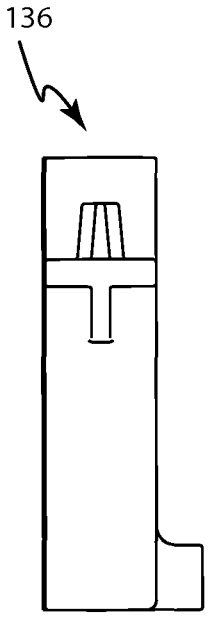
Figure 32A:
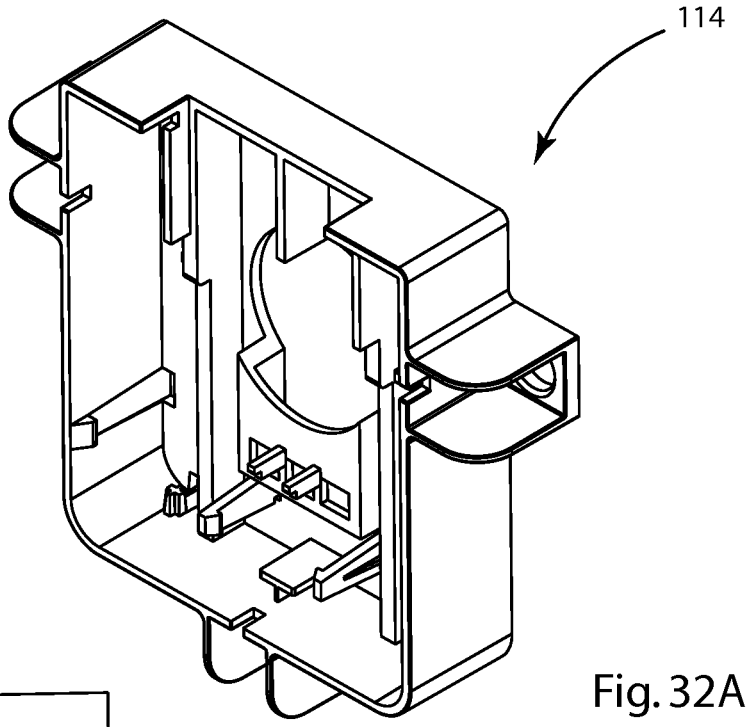
FIGS. 32A-32G are views of the housing of the latch mechanism of FIGS. 7A-7G.
Figure 32B:
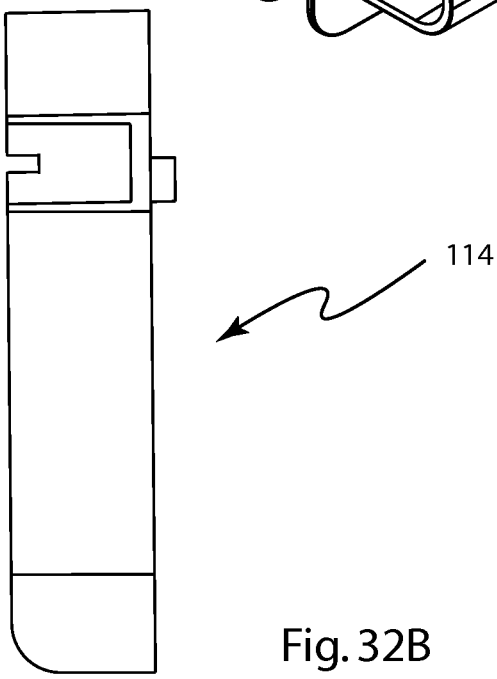
Figure 32C:
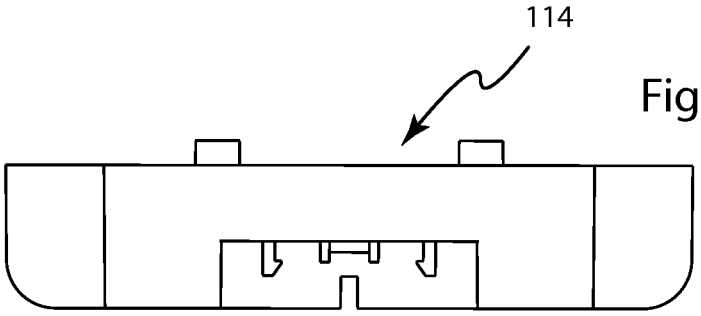
Figure 32D:
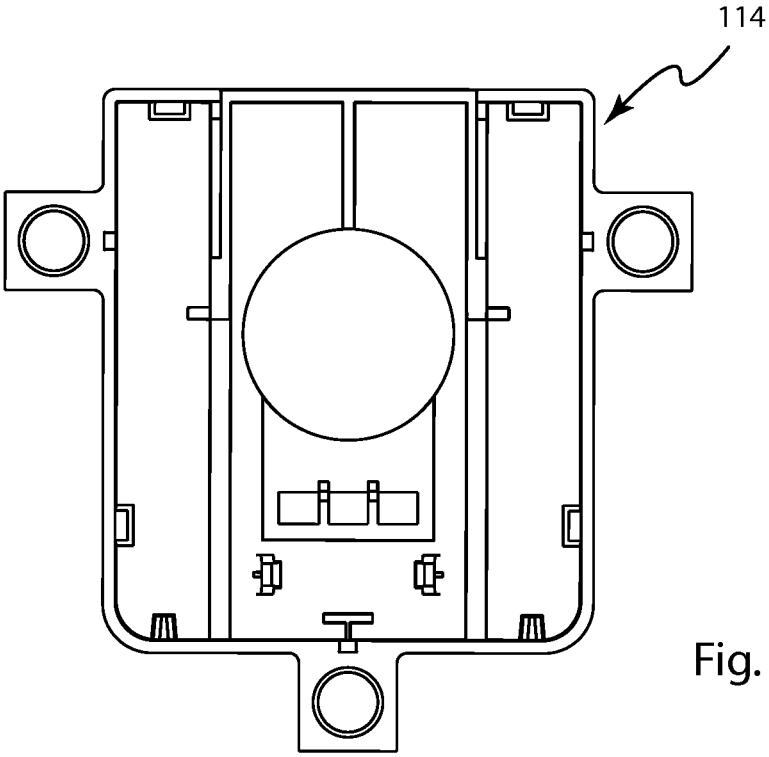
Figure 32E:
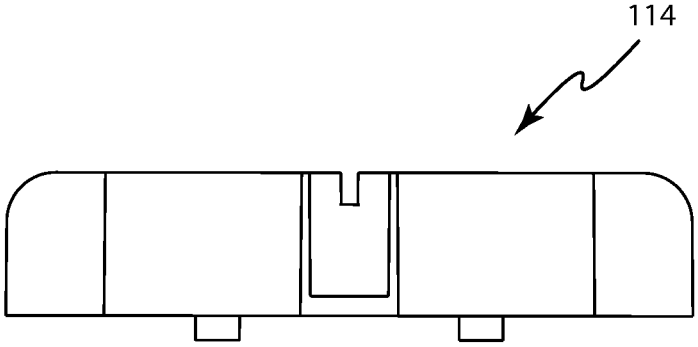
Figure 32F:
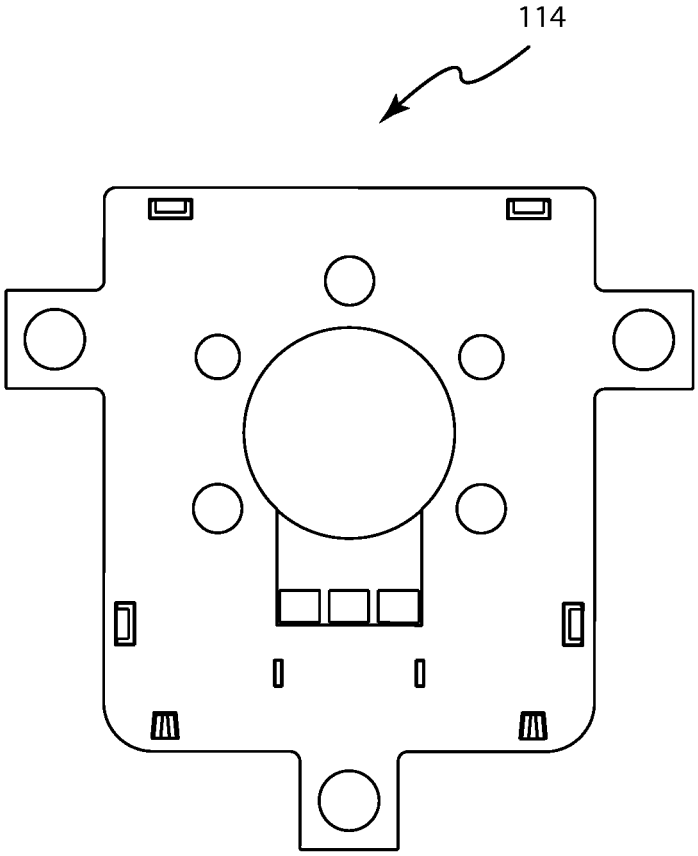
Figure 32G:
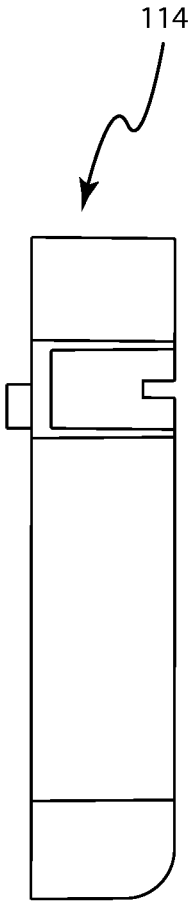
Figure 33A:
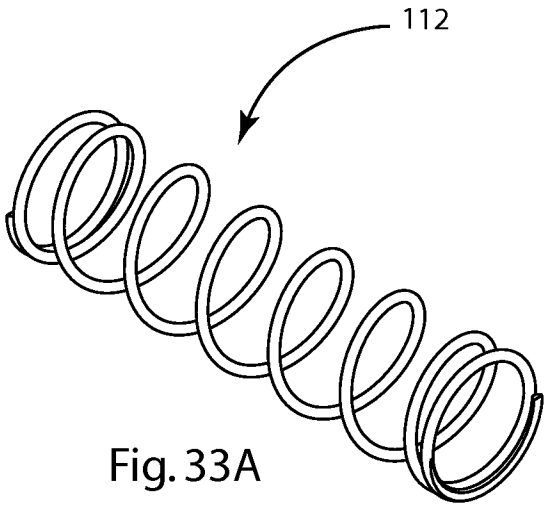
FIGS. 33A-33C are views of the biasing spring of the latch pawl of the latch mechanism of FIGS. 7A-7G.
Figure 33C:
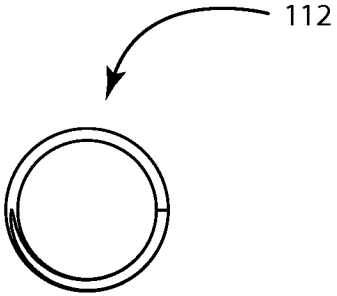
Figure 33B:
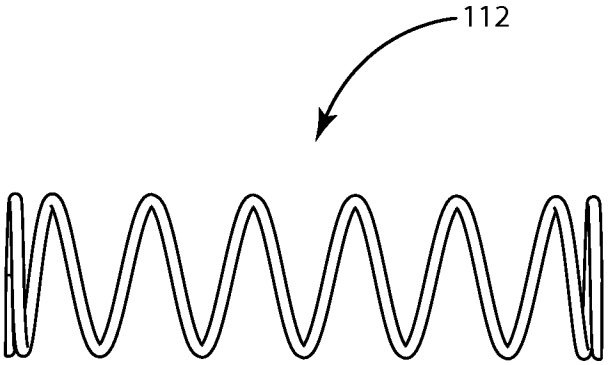
Figure 34A:
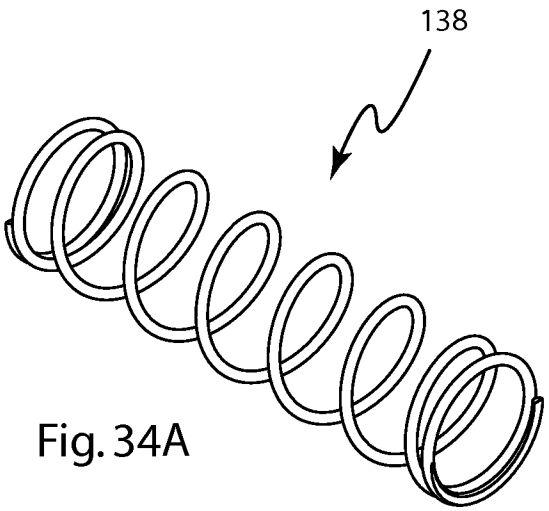
FIGS. 34A-34C and 35A-35C are views of the biasing springs of the return spring slide of the latch of FIGS. 5A-5G.
Figure 34C:
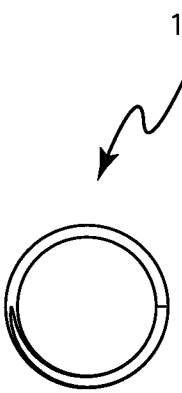
Figure 34B:
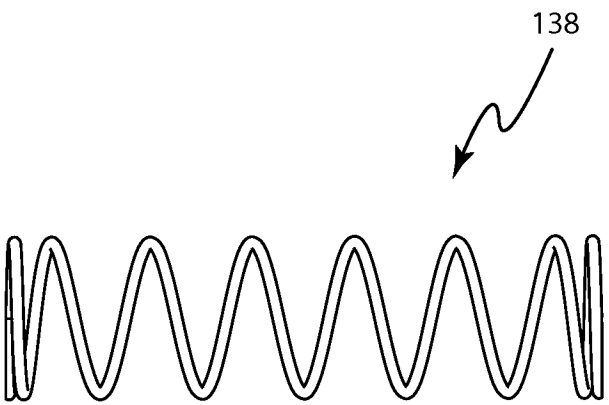
Figure 35A:
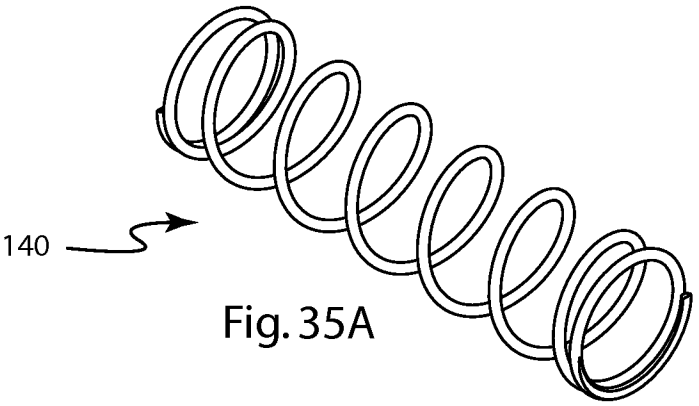
Figure 35C:
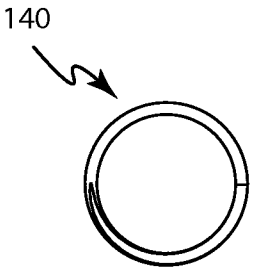
Figure 35B:
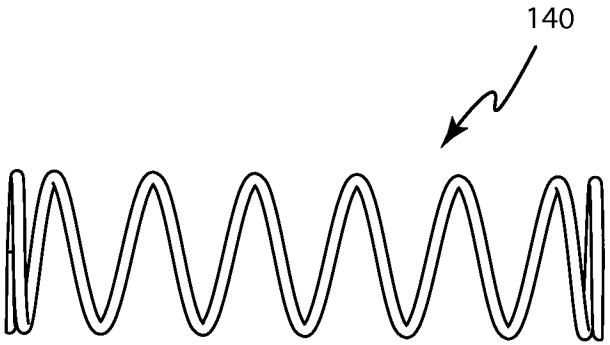
Figure 36A:
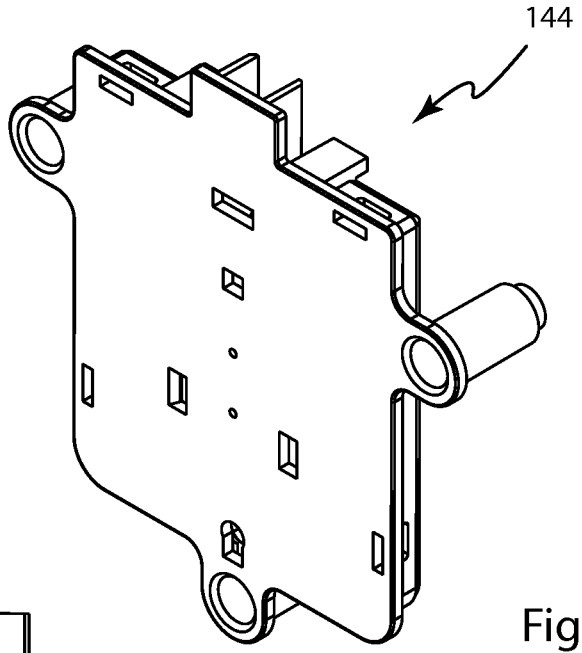
FIGS. 36A-36G are views of the housing cover of the latch mechanism of FIGS. 7A-7G.
Figure 36B:
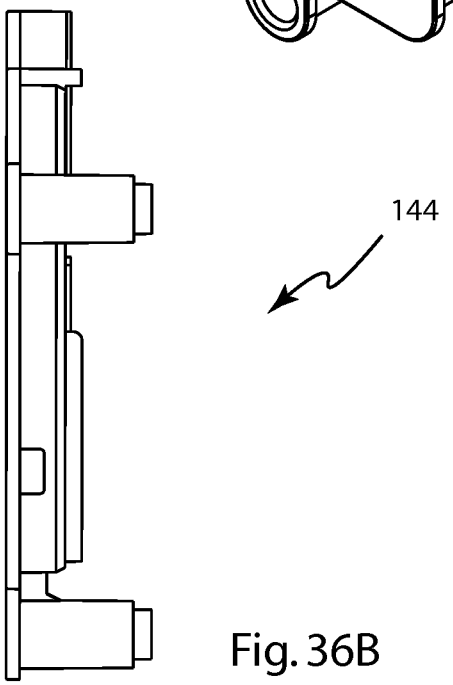
Figure 36C:
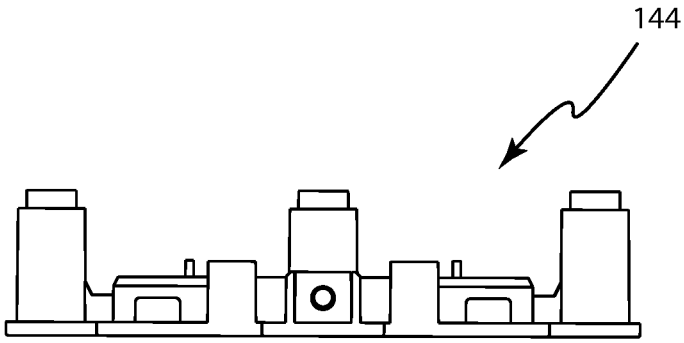
Figure 36D:
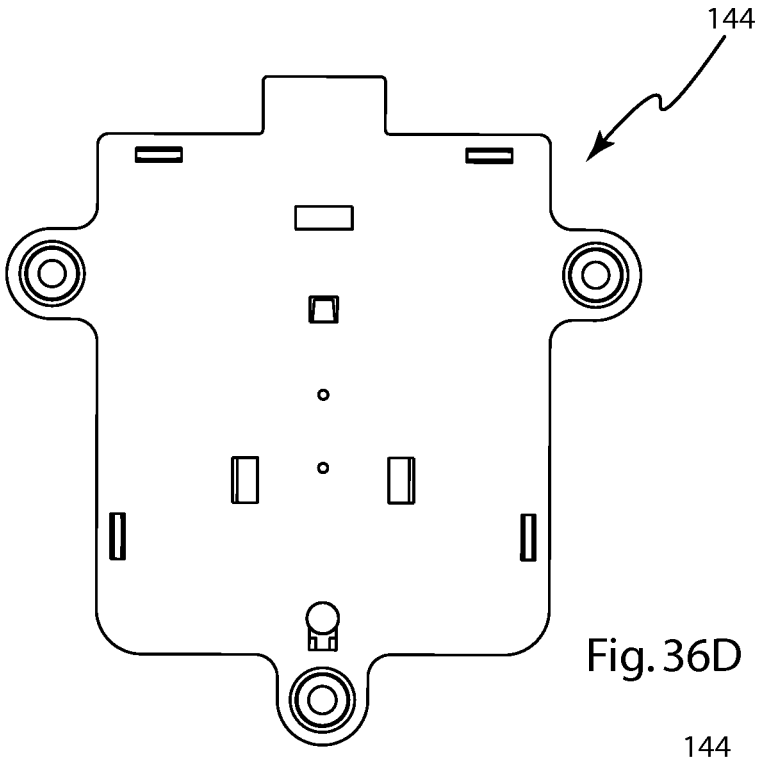
Figure 36E:
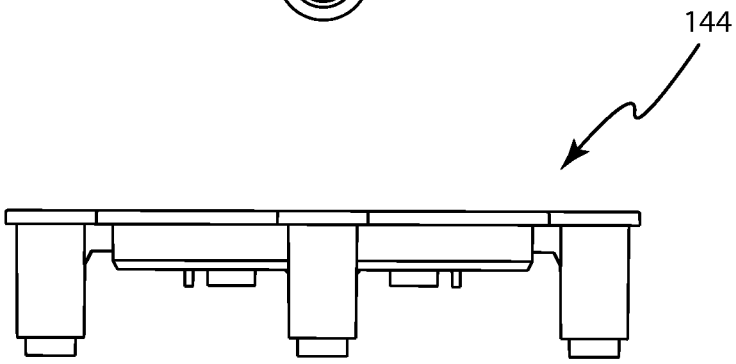
Figure 36F:
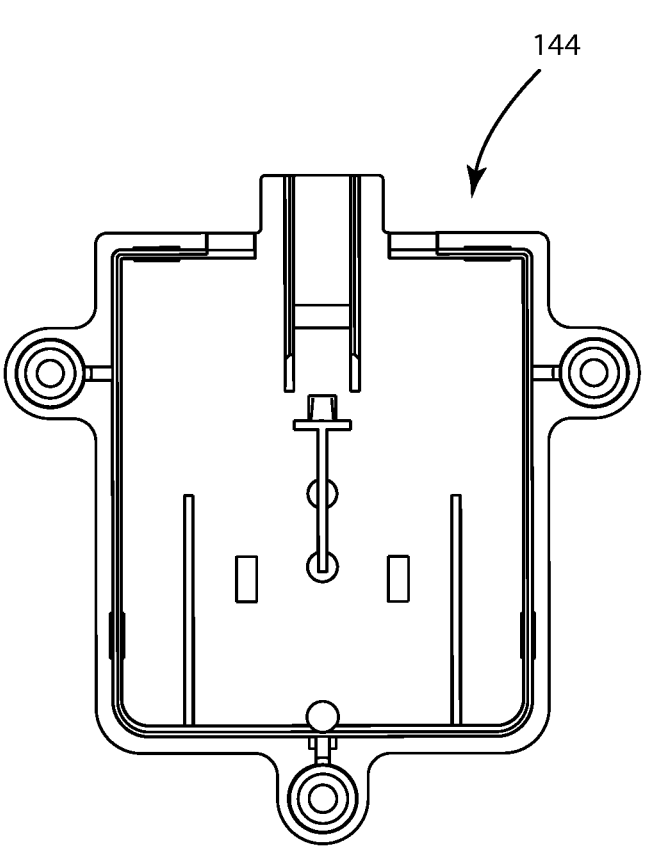
Figure 36G:
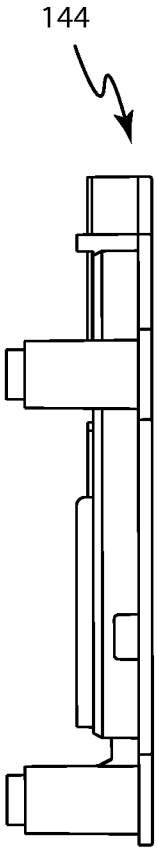
Figure 37A:
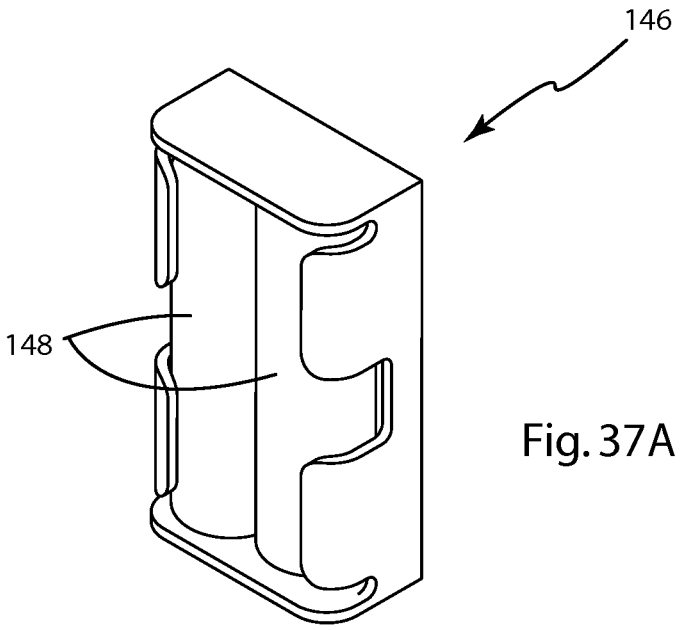
FIGS. 37A-37E are views of the battery housing of the latch of FIGS. 5A-5G.
Figure 37B:
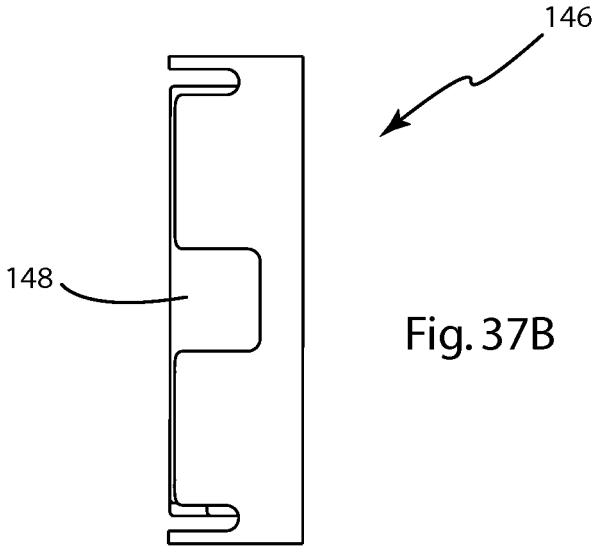
Figure 37C:
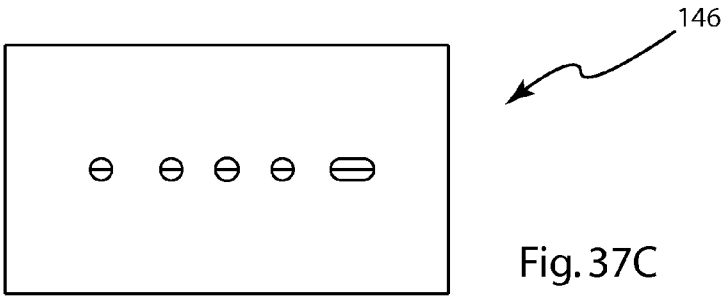
Figure 37D:
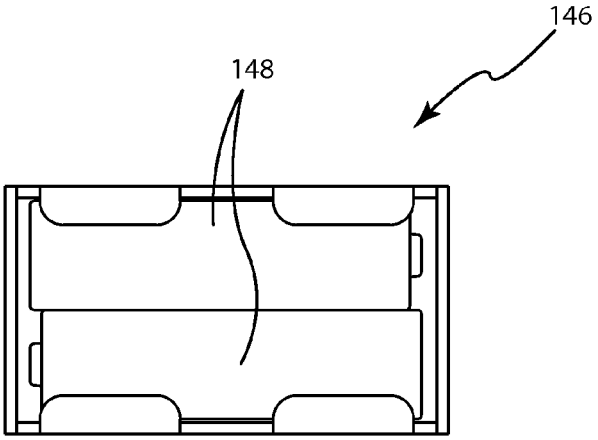
Figure 37E:
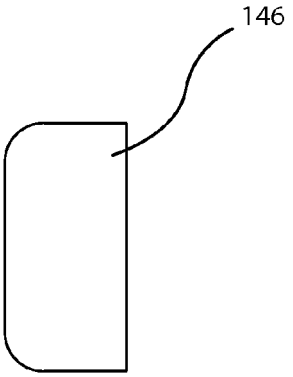
Figure 38A:
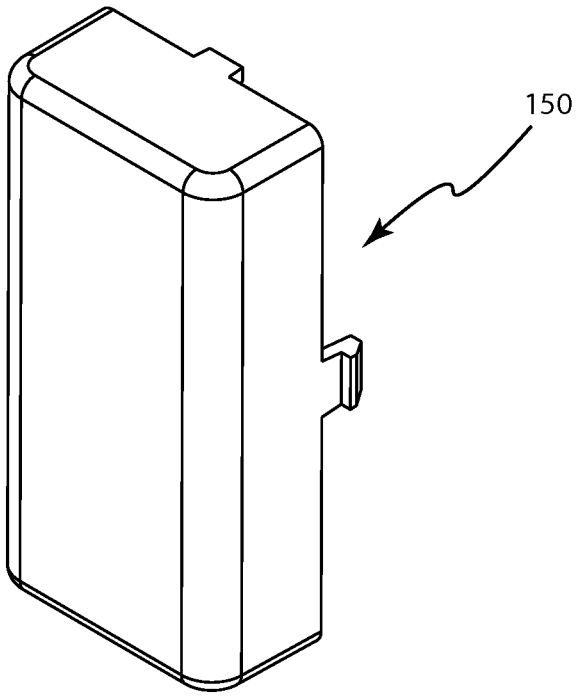
FIGS. 38A-38E are views of the battery housing cover of the latch of FIGS. 5A-5G.
Figure 38B:
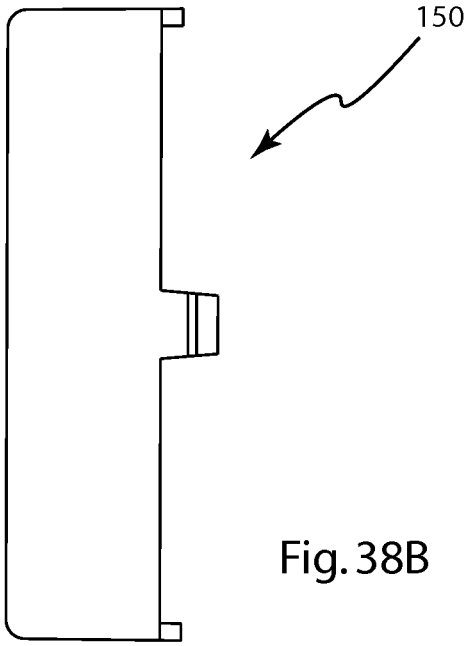
Figure 38C:
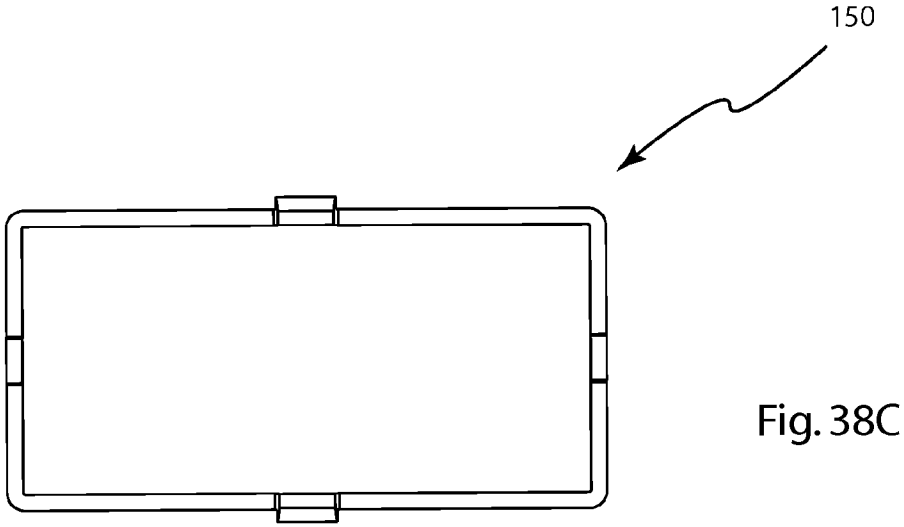
Figure 38E:
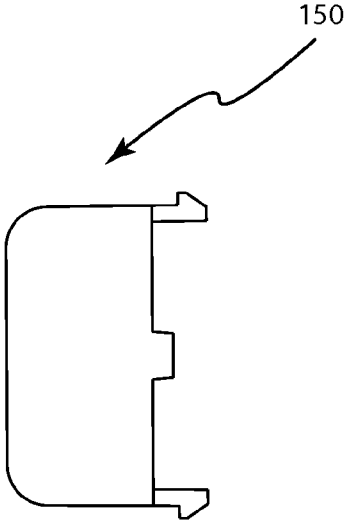
Figure 38D:
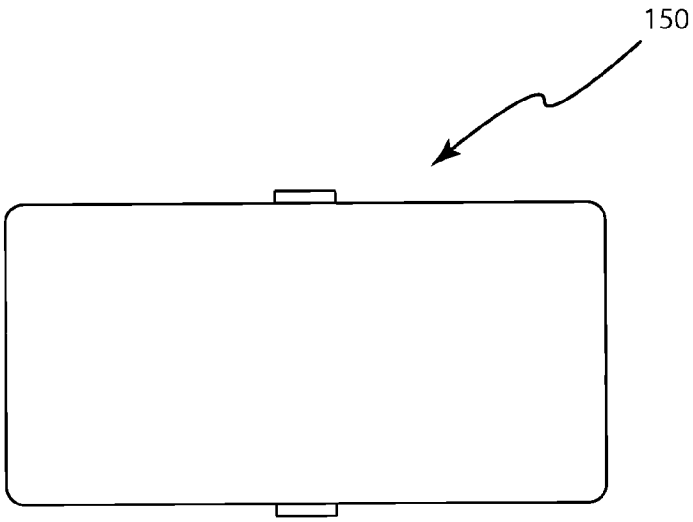
Figure 39:
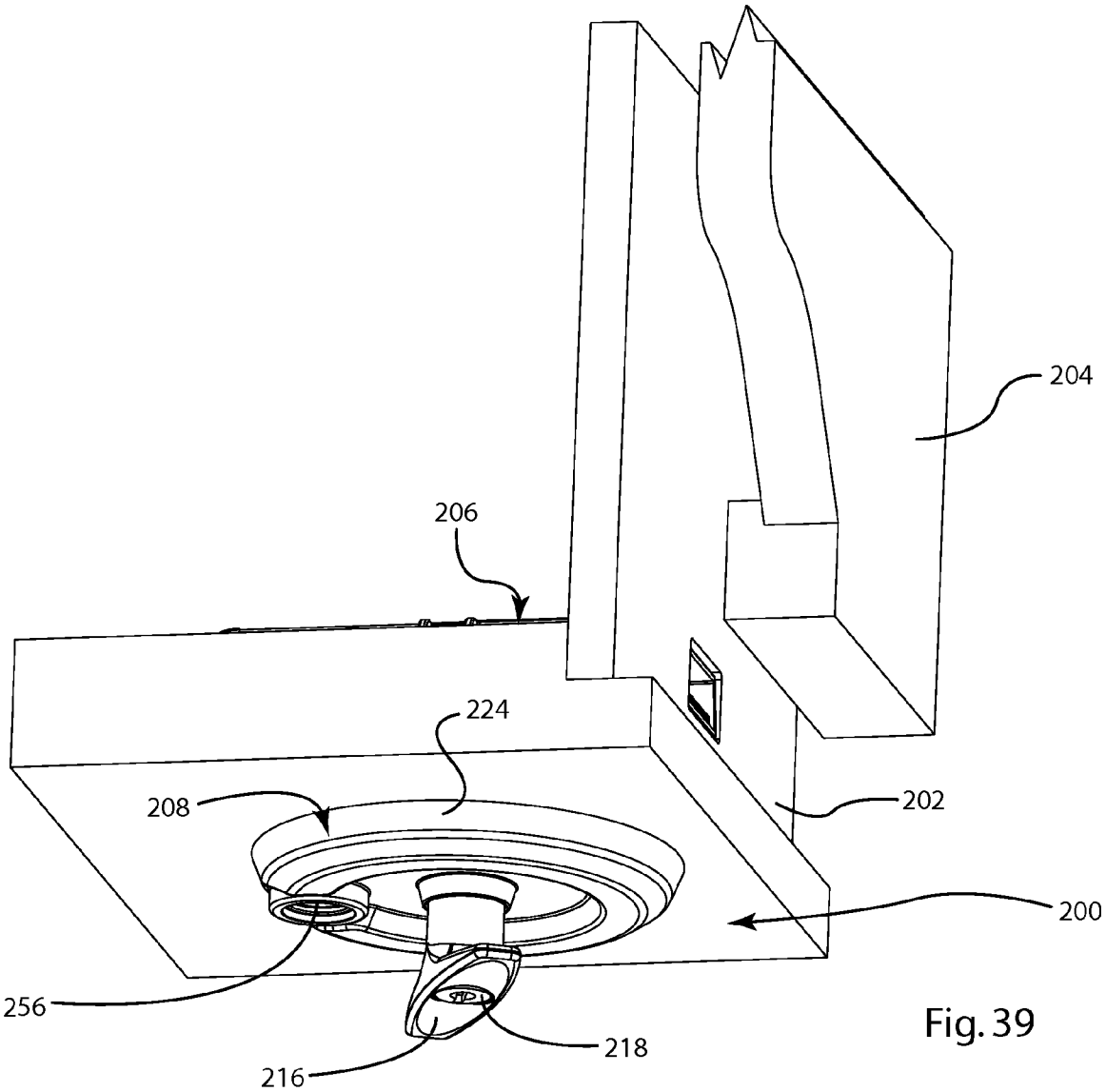
FIGS. 39-41 are environmental views of a second embodiment of a latch according to the present invention shown installed to a drawer.
Figure 40:
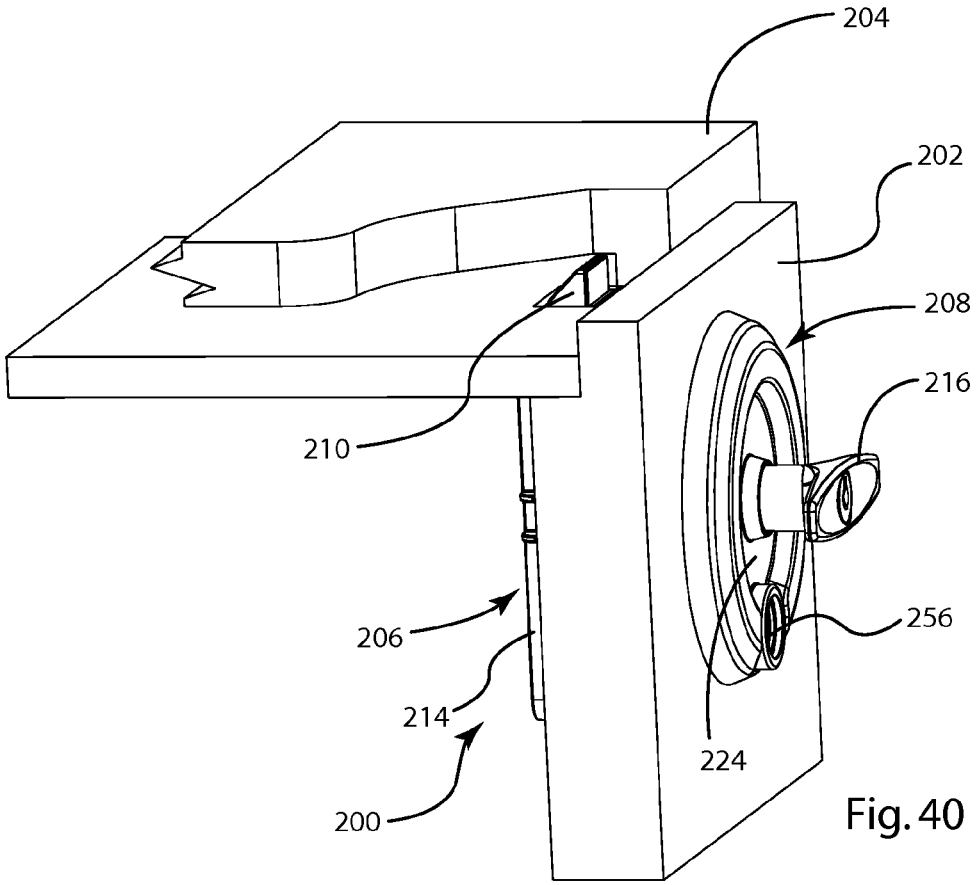
Figure 41:
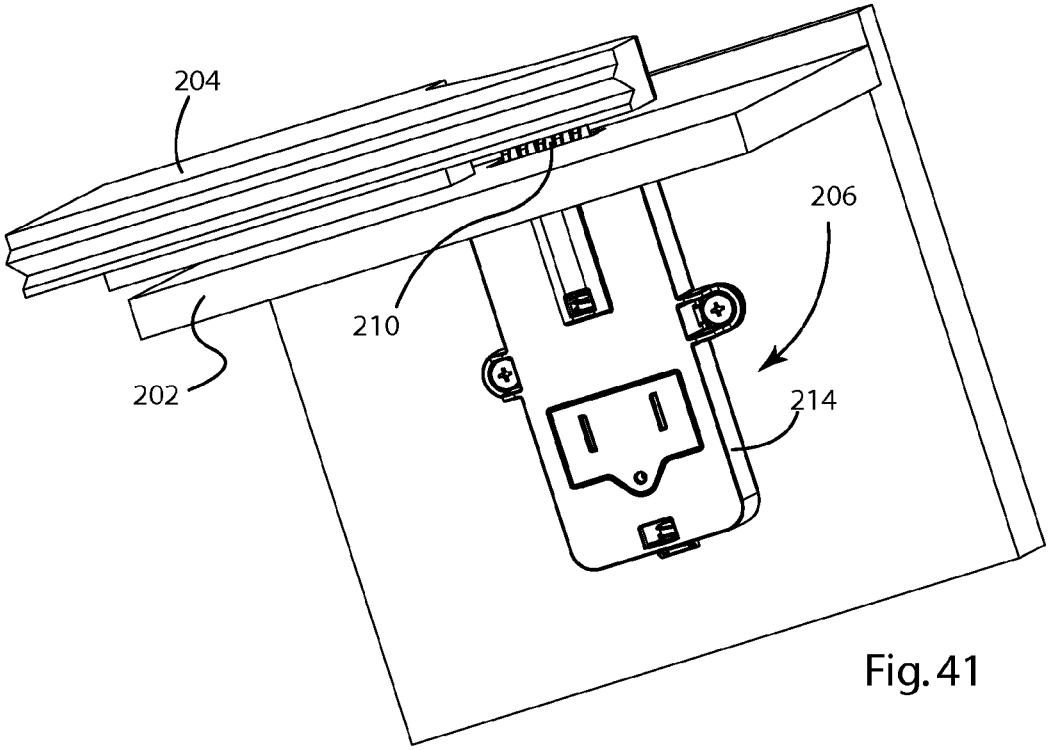
Figure 42:
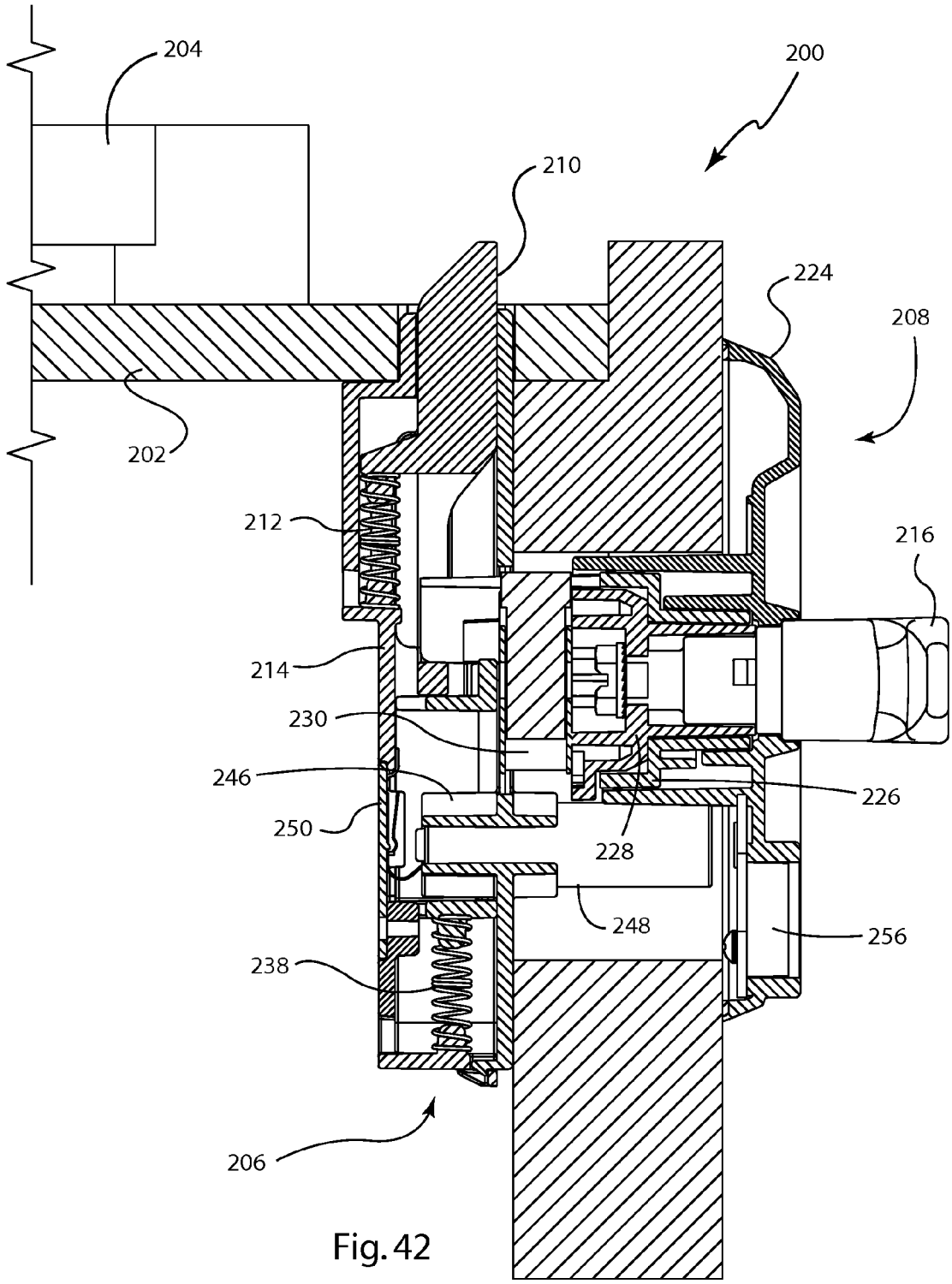
FIG. 42 is a cross sectional view of a second embodiment of a latch according to the present invention shown installed to a drawer.
Figure 43A:
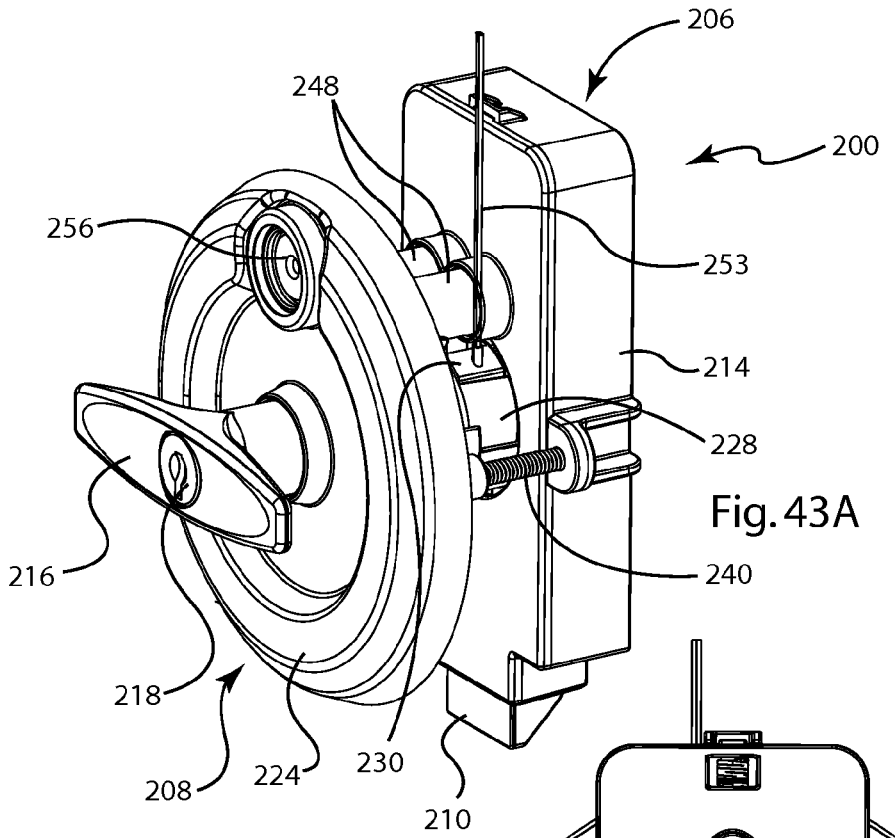
FIGS. 43A-43G are views of a second embodiment of a latch according to the present invention including an actuating mechanism and a latch mechanism.
Figure 43B:
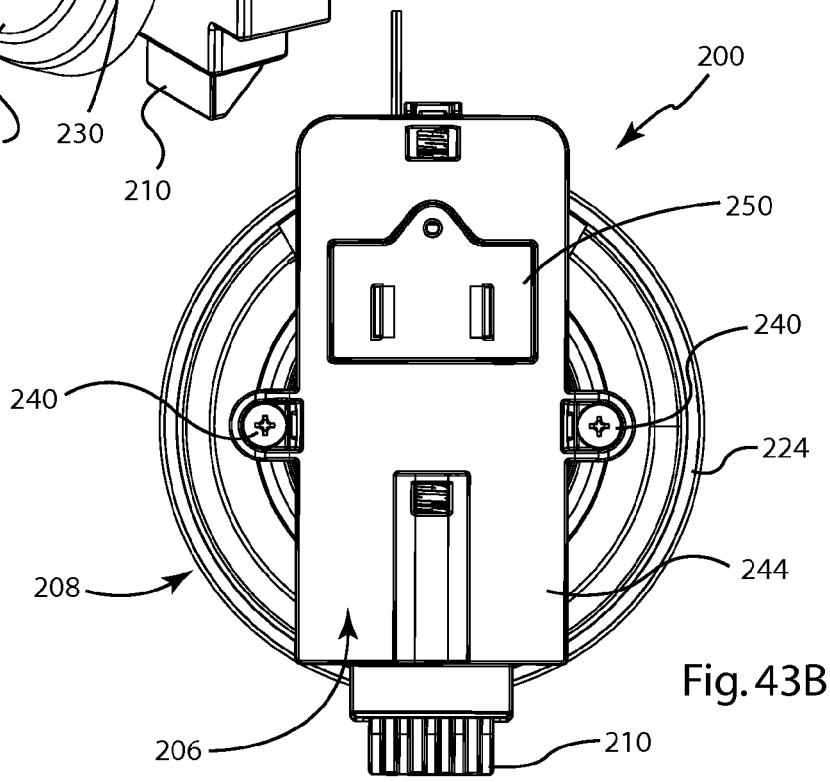
Figure 43C:
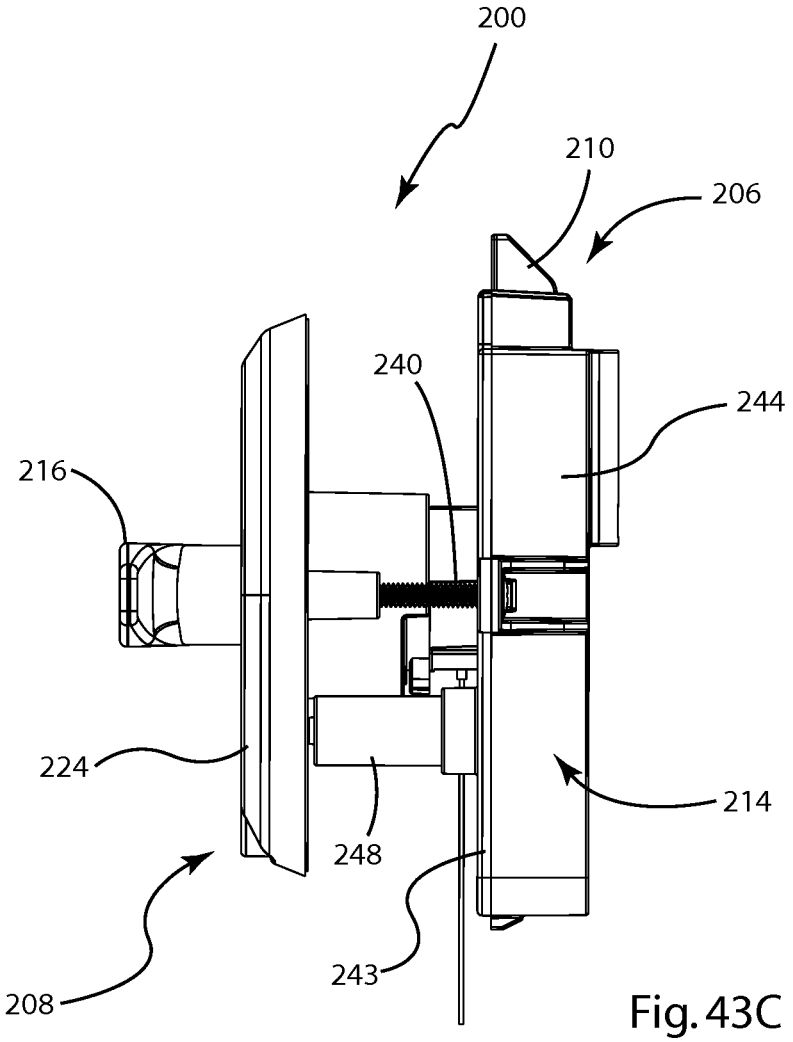
Figure 43D:
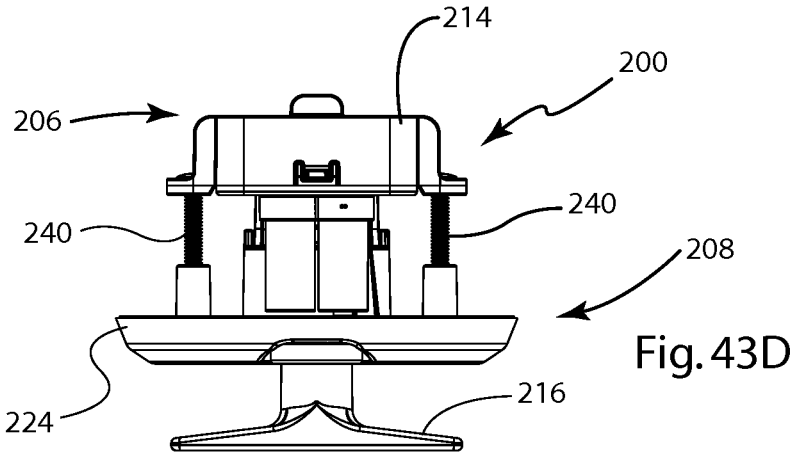
Figure 43E:
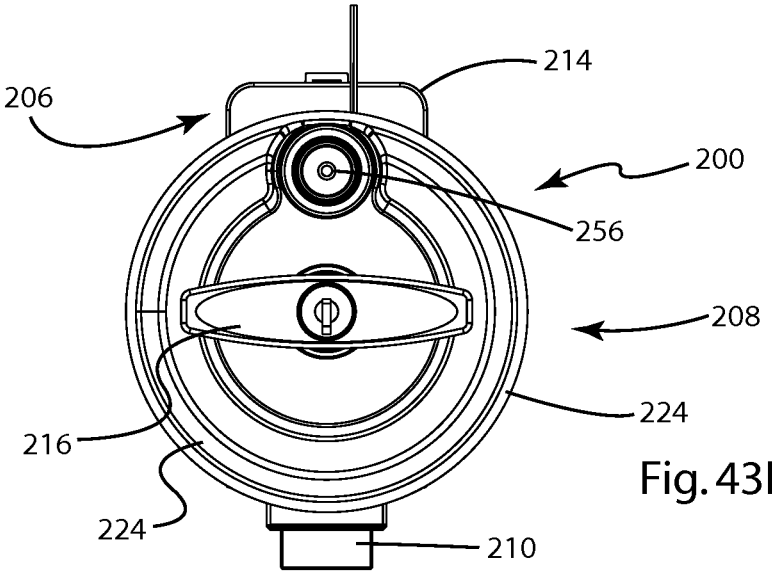
Figure 43F:
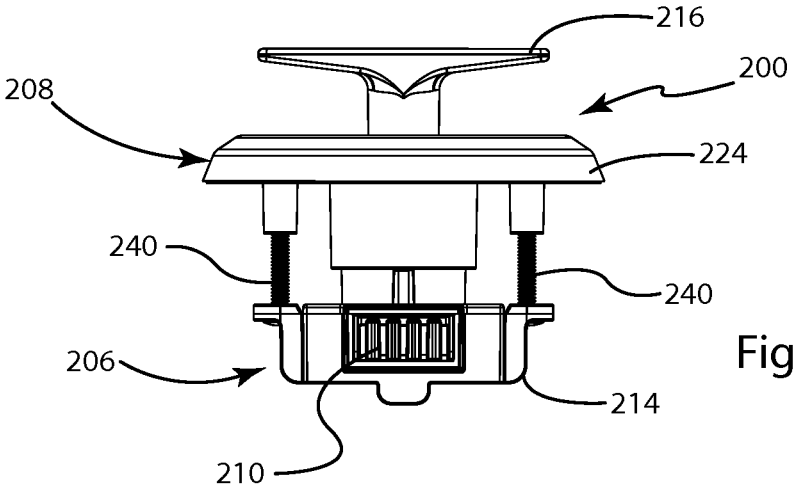
Figure 43G:
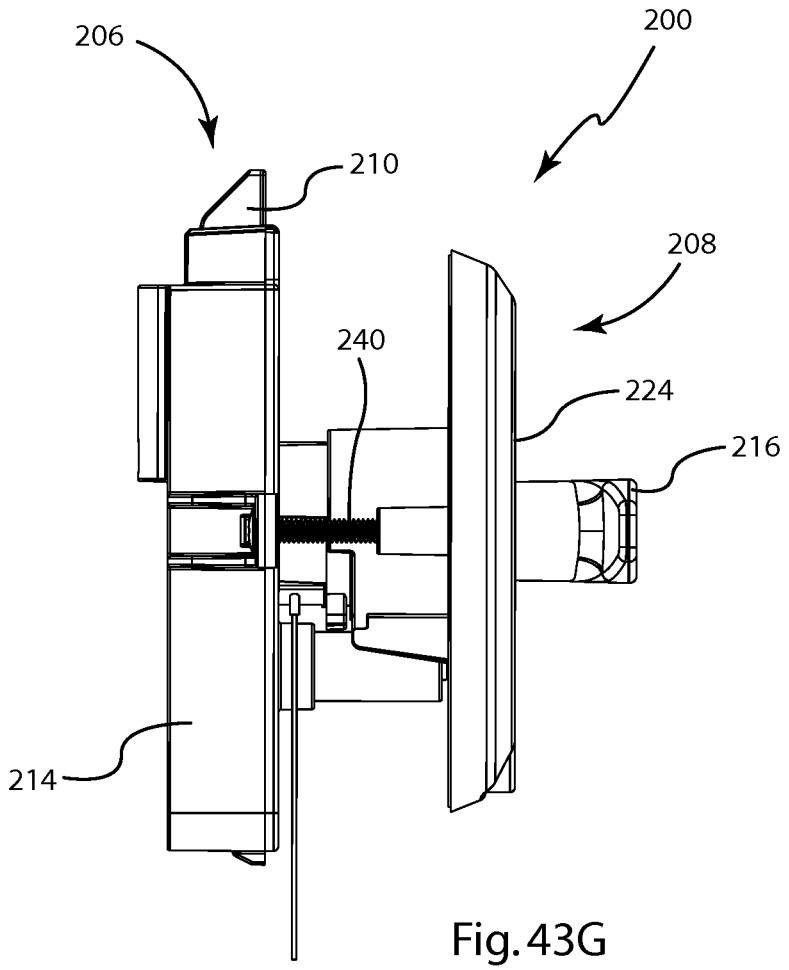
Figure 44A:
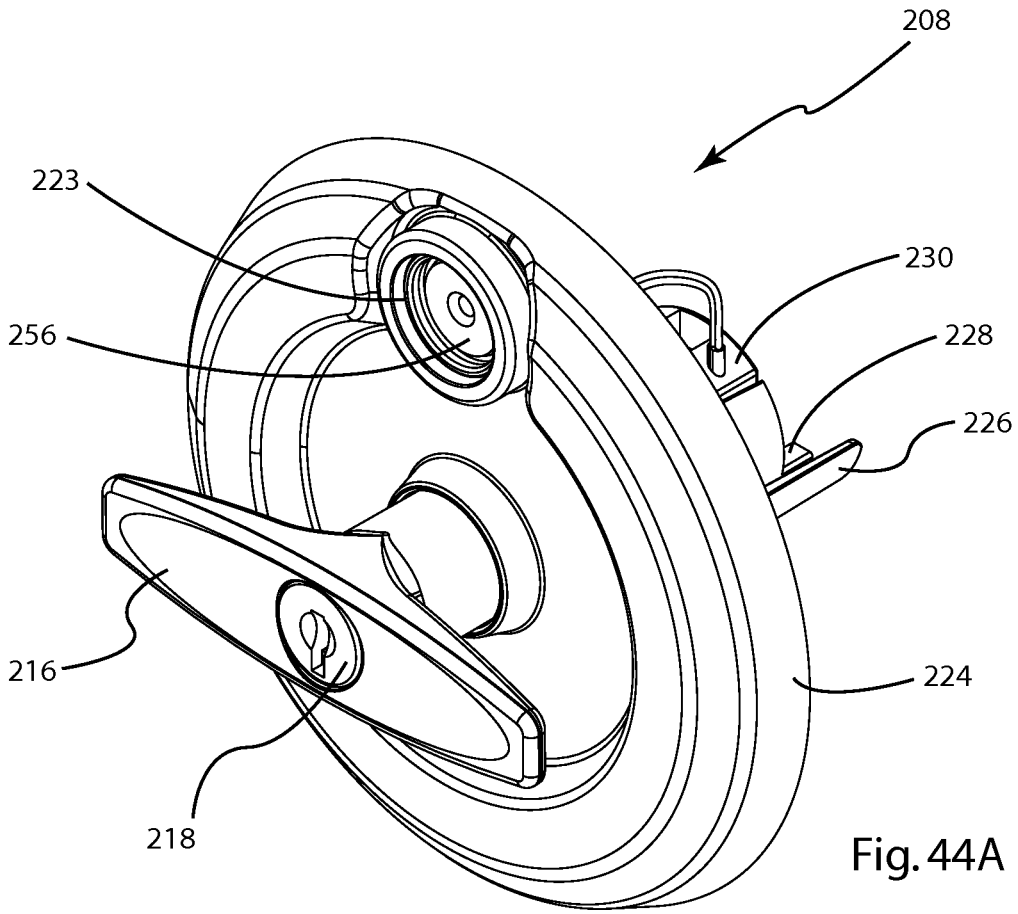
FIGS. 44A-44G are views of an actuating mechanism of a second embodiment of a latch according to the present invention.
Figure 44B:
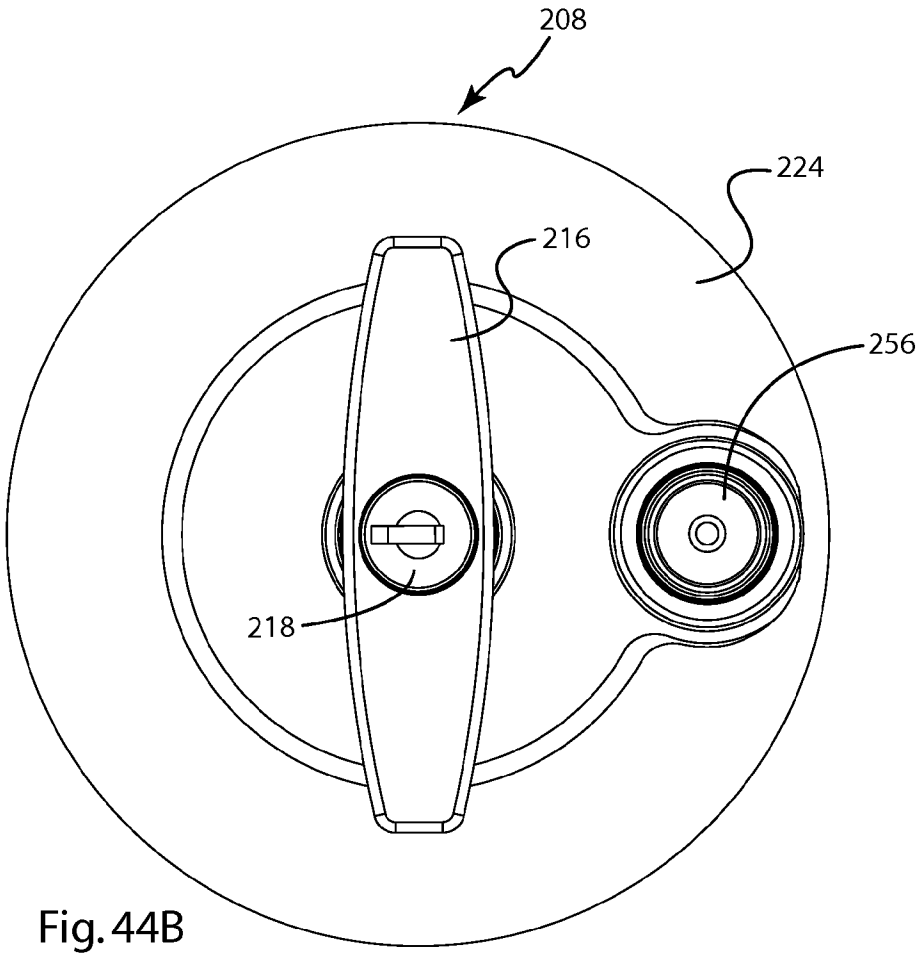
Figure 44C:
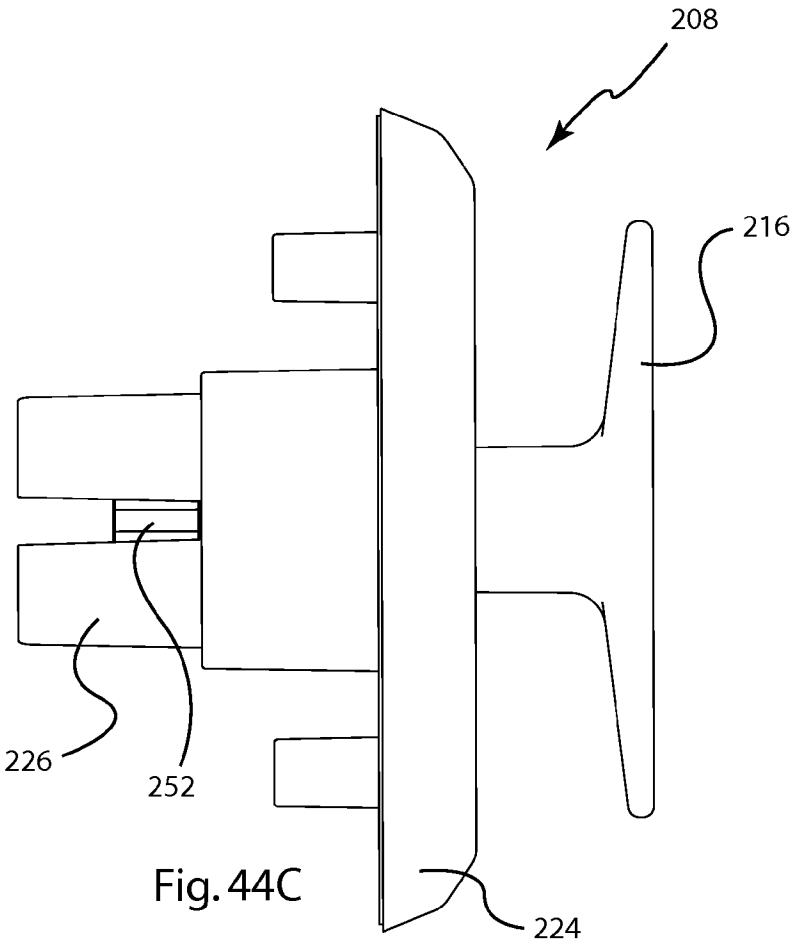
Figure 44D:
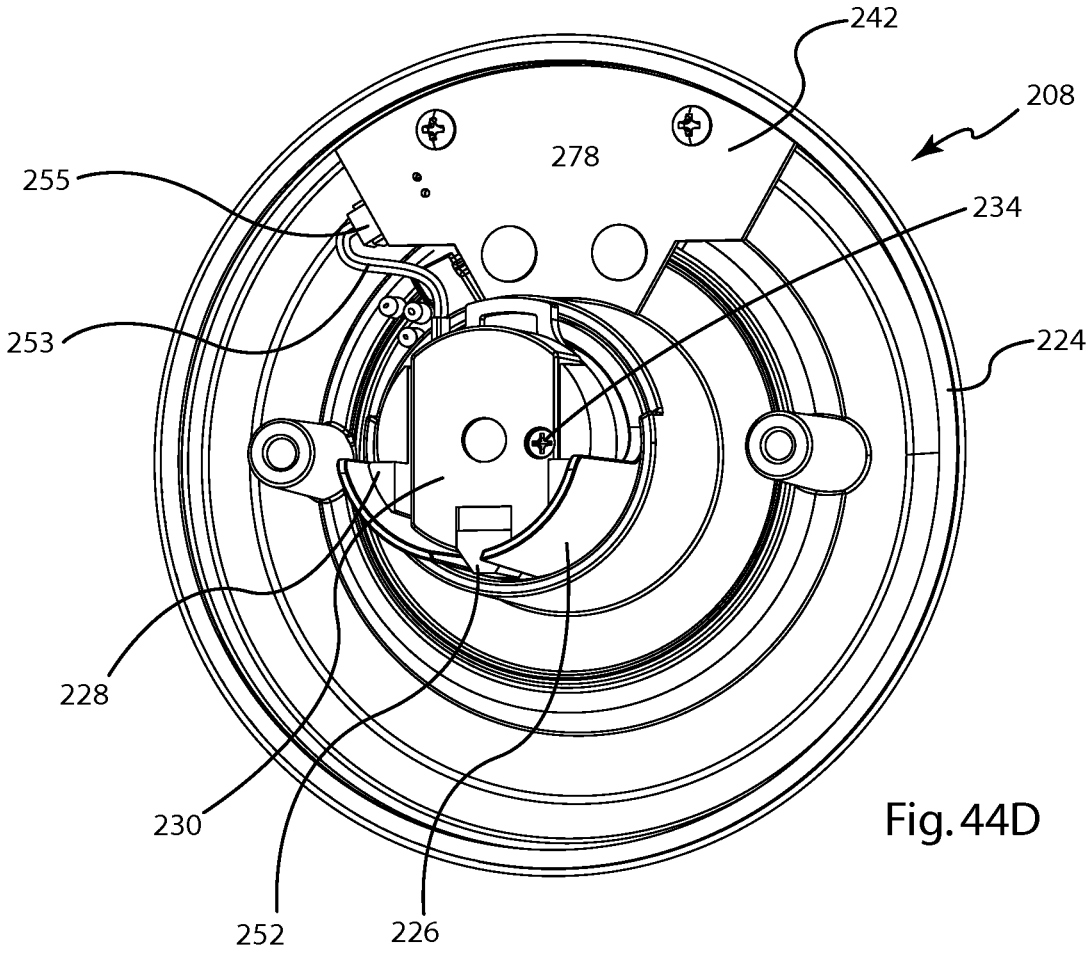
Figure 44E:
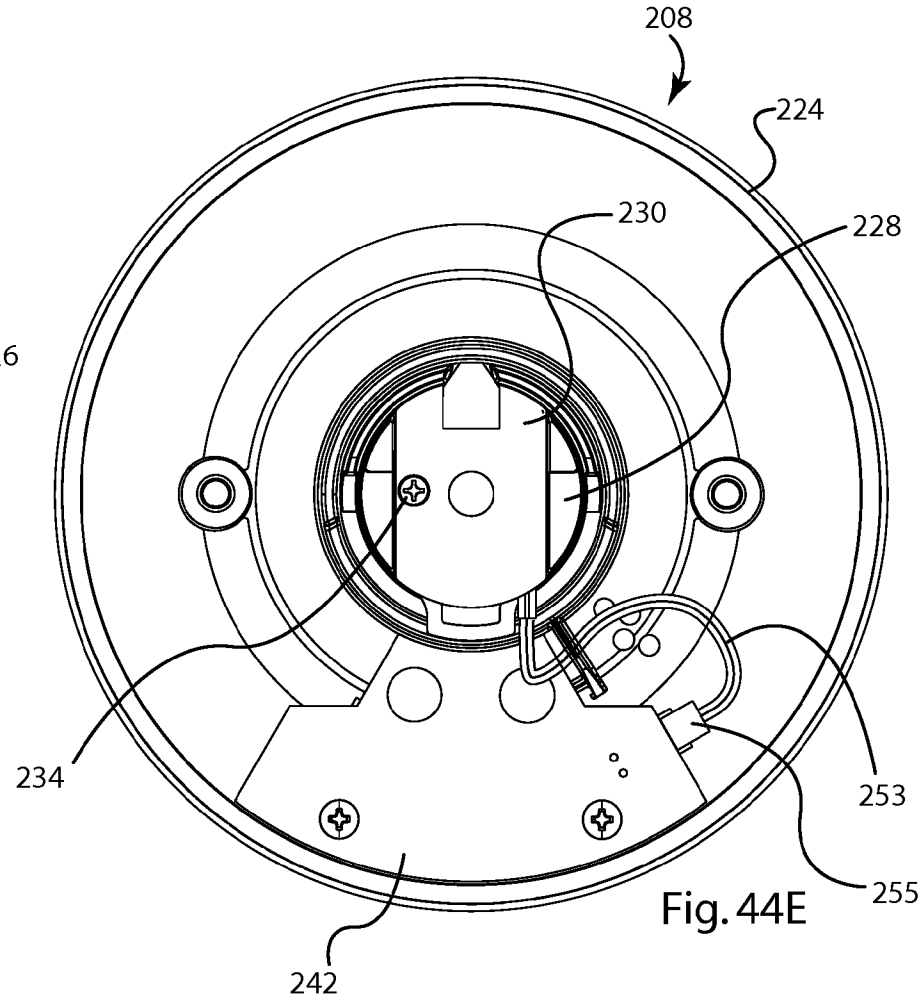
Figure 44F:
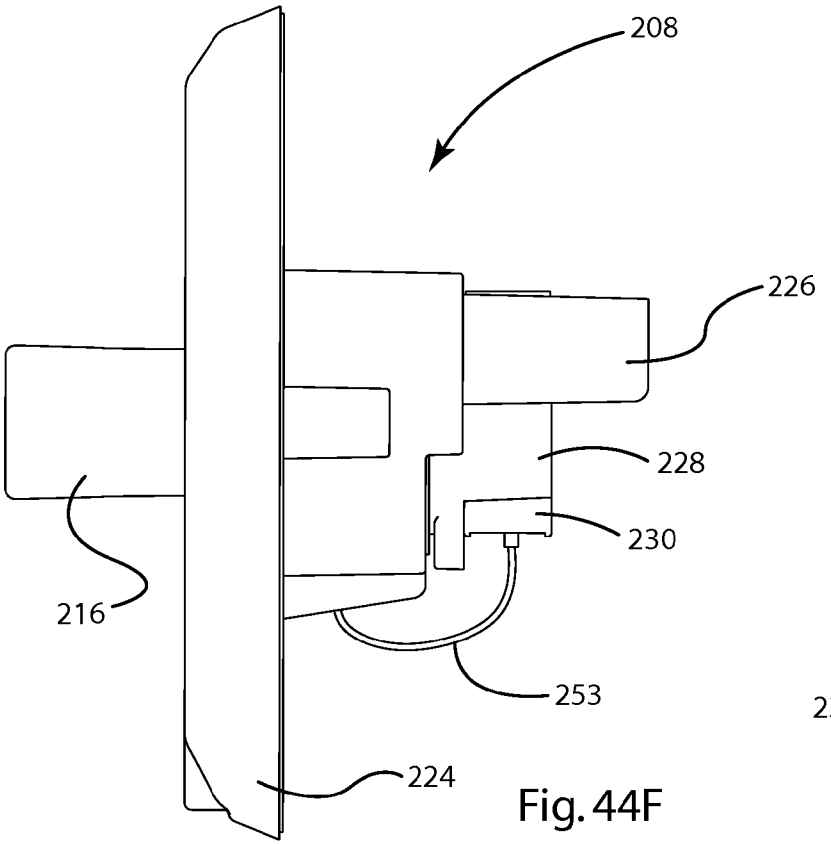
Figure 44G:
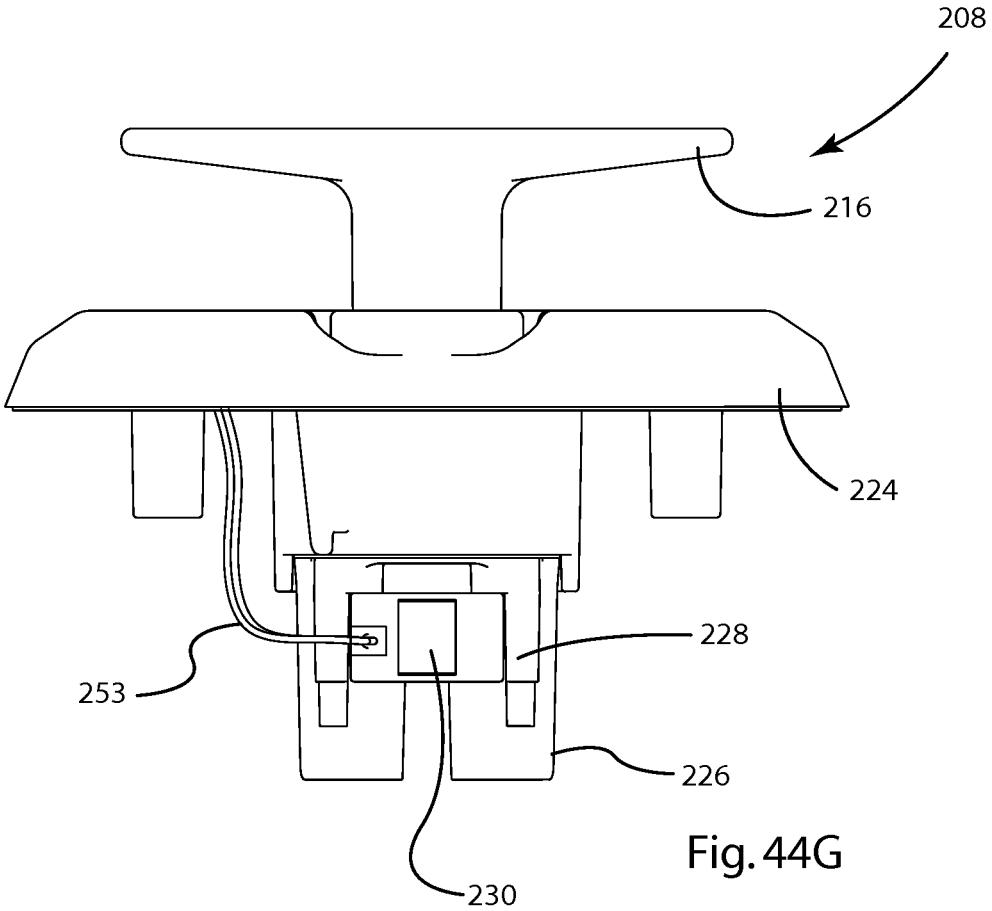
Figure 45A:
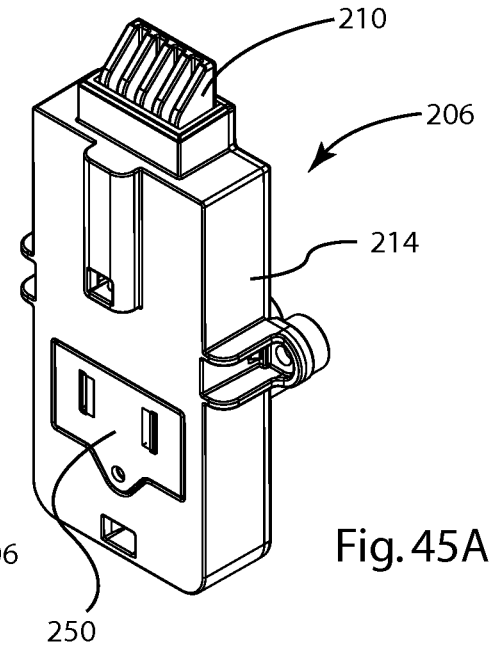
FIGS. 45A-45H are views of a latch mechanism according to the present invention and adapted for use with the actuating mechanism of FIGS. 44A-44H.
Figure 45C:
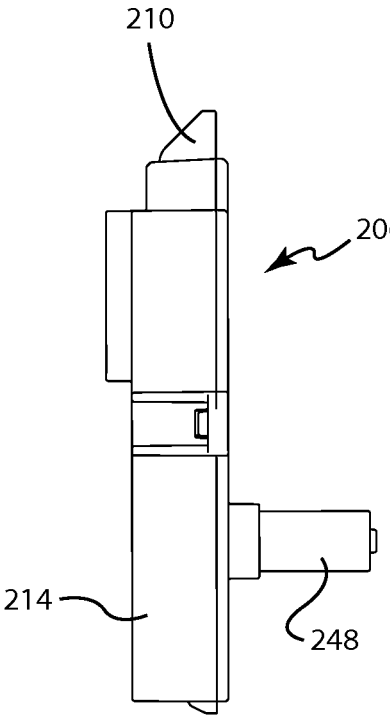
Figure 45B:
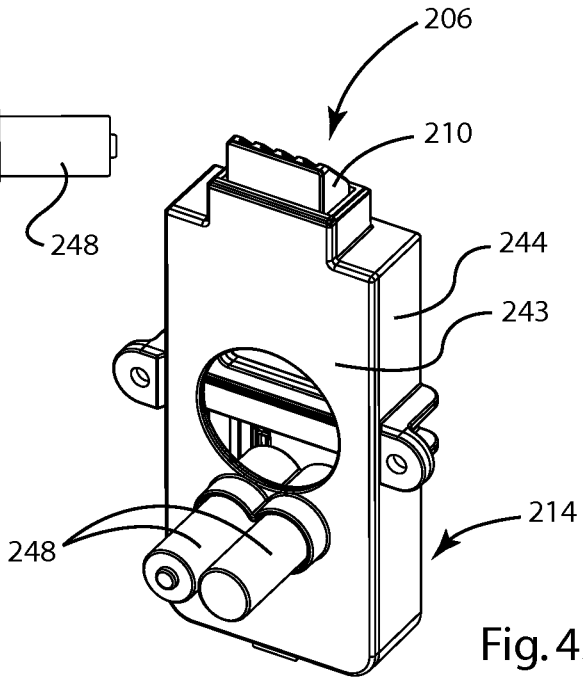
Figure 45D:
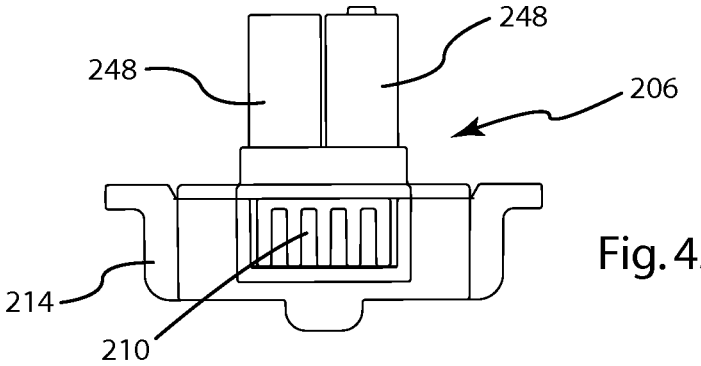
Figure 45E:
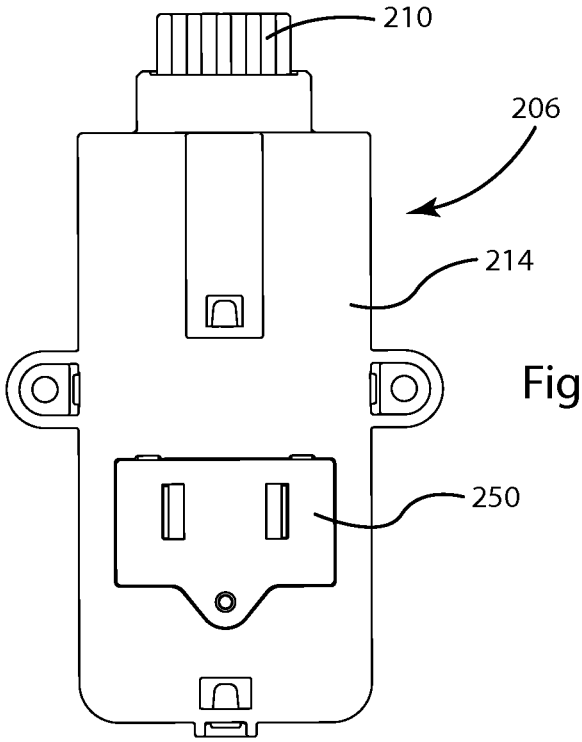
Figure 45F:
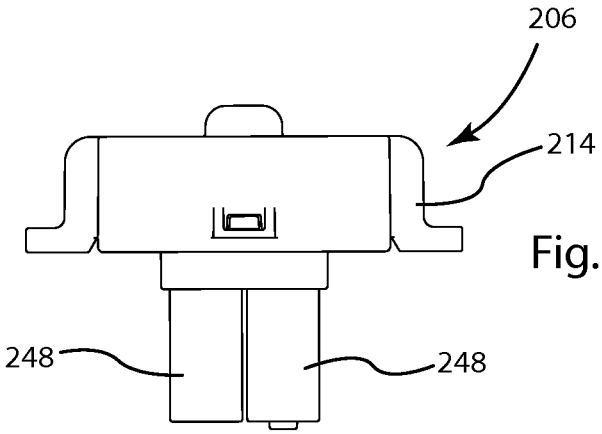
Figure 45G:
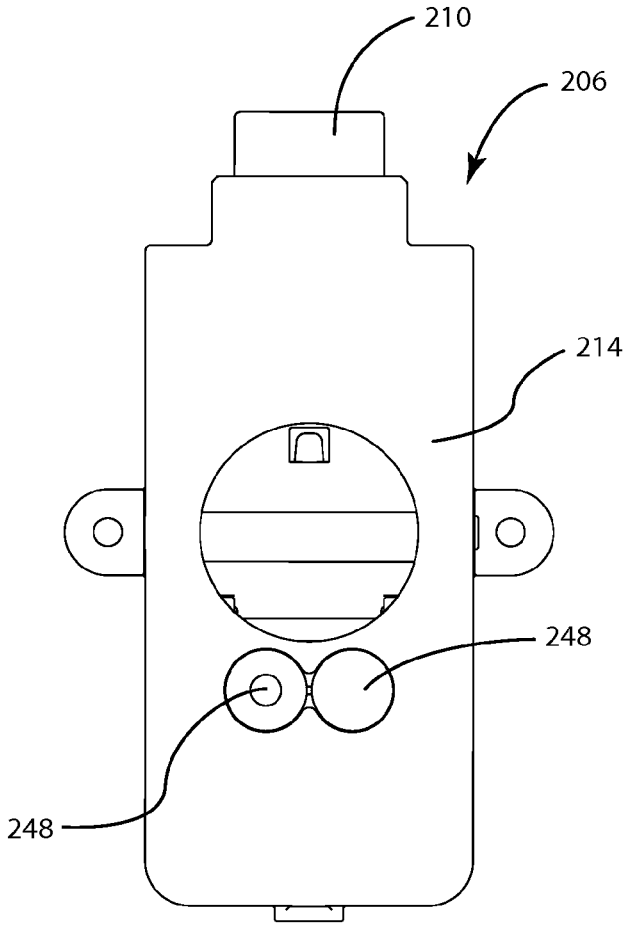
Figure 45H:
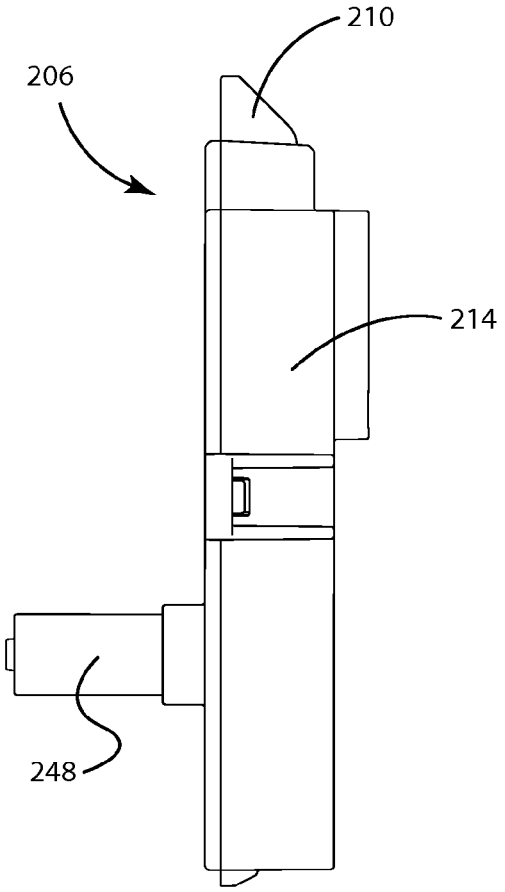
Figure 46:
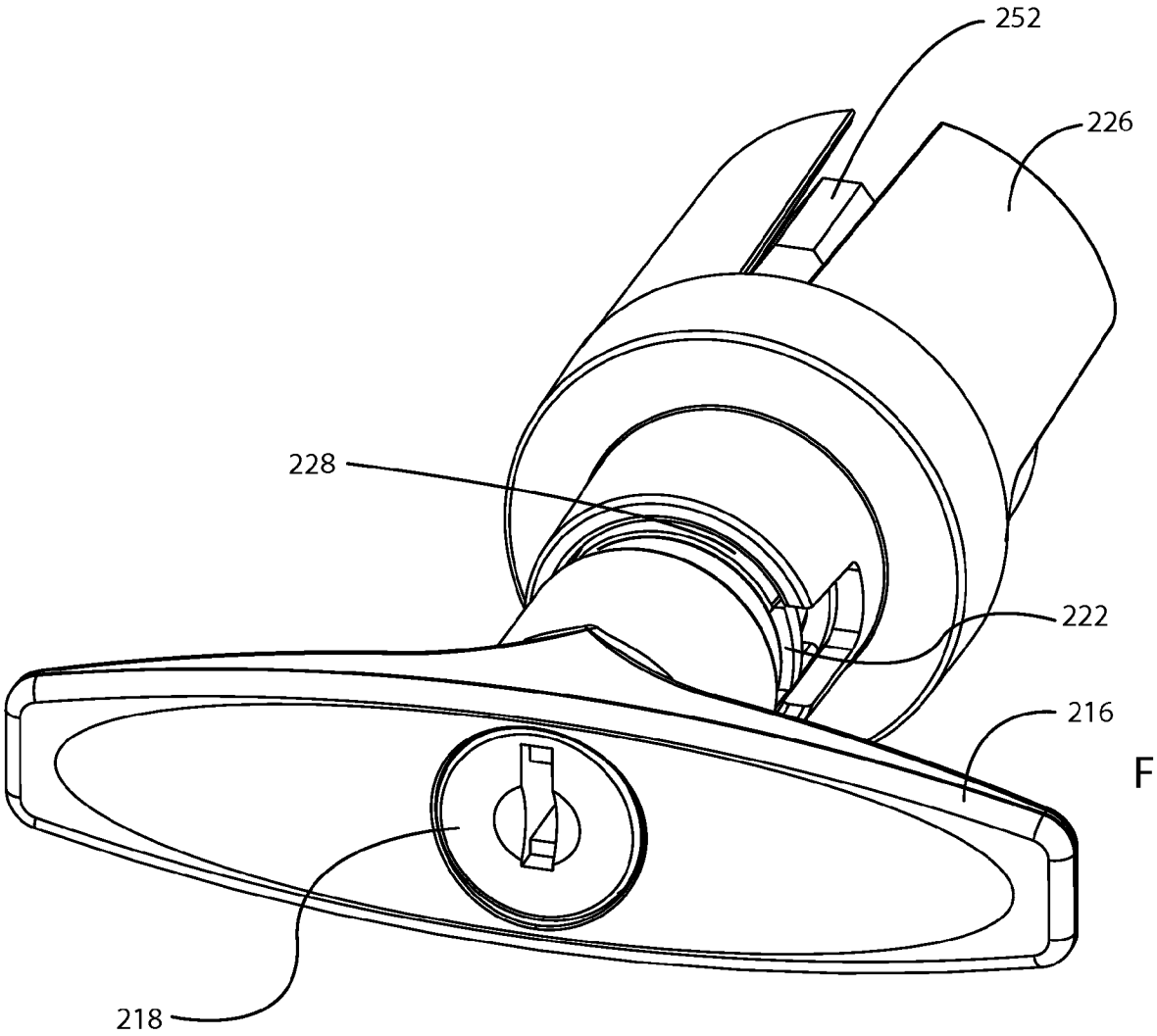
FIG. 46 is a fragmentary view showing the handle of the actuating mechanism of FIGS. 44A-44G with the cylinder lock in the locked position.

The actuating mechanism 108 includes a knob or handle 116 and is capable of selectively being placed in an engaged configuration (shown in FIGS. 1, 10, and 17) and a disengaged configuration (shown in FIGS. 9 and 16). The word "handle" as used herein should be understood to include all types of handles and knobs. The handle 116 is rotationally supported by the housing or bezel 124, which also supports the proximity sensor 156. A user can cause the actuating mechanism 108 to assume the engaged configuration either manually using a key (not shown) or electrically. Once in the engaged configuration, the user can manually operate the actuating mechanism 108 to move the pawl 110 to the retracted position, which in turn allows the first member 102 to be moved to the open position. With the actuating mechanism 108 in the engaged configuration, rotating the handle causes rotation of a cam 126 that engages the pawl 110 and moves it to the retracted position.

In the illustrated embodiment, the cam 126 constitutes an outer cam, and the actuating mechanism 108 also includes and inner cam 128 whose function is explained later. In the illustrated embodiment, the cam 126 has a pawl-engaging portion 158 that is roughly in the form of a cylindrical sleeve that has had one half of it cut away longitudinally. The cam 126 has a input portion 160 that receives torque input from the handle when the actuating mechanism 108 in one of two engaged configurations and that is roughly in the form of a cylindrical sleeve of a diameter smaller than the pawl-engaging portion 158. The outer cam 126 also includes a projection 162 and slots 164 and 166 whose functions are explained later. The pawl-engaging portion 158 of the outer cam 126 acts against an inner edge of the pawl opening 174 to pull the pawl 110 to the retracted position when the cam 126 is rotated. The projection 162 limits the range of rotation of the cam 126.

The inner cam 128 has a square center hole 168 that receives a square cross section portion 170 of the handle shaft 172, such that the handle 116 and the inner cam 128 rotate together as a unit. The screw 132 is used to secure the handle 116 to the inner cam 128 of the actuating mechanism 108. The inner cam 128 has projections 176 that are too short to engage the inner edge 174 of the pawl opening. Accordingly, the inner cam 128 does not engage the pawl 110. The projections 176, however engage and act against the return spring slide 136 such that rotation of the inner cam 128 out of its closed position, corresponding to the closed position of the handle 116, causes the return spring slide 136 to compress the return springs 138 and 140 against the latch mechanism housing 114 when the actuating mechanism 108 is in the disengaged configuration. When the handle 116 is released, the compressed springs 138 and 140 act against the cam 128, via the slide 136, to return the cam 128 and the handle 116 to their closed positions. Thus the slide 136 and springs 138 and 140 constitute a biasing means for biasing the handle 116 toward the closed position. The cam 128 had a projection 178 that limits the range of rotation of the cam 128 and thus the handle 116.

The handle 116 of the actuating mechanism 108 can be moved rotationally between a latched or closed position and an unlatched or open position. When the actuating mechanism 108 is in the disengaged configuration, the handle 116 can be rotated between the closed and open positions without moving the cam 126, and thus without moving the sliding pawl or bolt 110 of the latch. The handle 116 carries a lock cylinder 118 that can be rotated relative to the handle 116 using a key to rotate the lock cylinder 118 between locked and unlocked positions relative to the handle 116. The lock cylinder 118 operates a lock bolt 122 between retracted and extended positions, via an eccentric cam 120 that converts the rotation of the lock cylinder to the rectilinear motion of the lock bolt 122. When the lock bolt 122 is in the extended position, the actuating mechanism 108 is in a first engaged configuration and the handle 116 is locked to the cam 126, through the engagement of the lock bolt 122 with the slot 164 of the cam 126, such that rotating the handle 116 from the closed position to the open position moves the cam 126, and thus moves the sliding pawl 110 to the retracted position in order to allow the opening of, for example, a drawer secured by the latch 100.

In addition, the handle 116 carries an electrically-powered motor 130 that is attached to the handle 116, by being secured to the inner cam 128 using the screw 134, such that the motor 130 rotates with the handle 116 as the handle is rotated between the open position and the closed position. The motor 130 has a second bolt 152, also referred to as the motor bolt 152, which can move rectilinearly between retracted and extended positions. The motor bolt 152 is biased toward the extended position and has beveled sides. The motor bolt 152 projects into the slot 166 in the cam 126 when the handle 116 is in the closed position. When the motor 130 is not energized, the motor bolt 152 is free to move to the retracted position.

When the motor 130 is not energized, the sides of the slot 166 in the cam 126 act on the beveled surfaces of the motor bolt 152 such that the motor bolt is moved to the retracted position as the handle 116 is rotated toward the open position with the result that the cam 126 will not rotate to the open position with the handle 116. When the motor 130 is energized the motor bolt 152 is prevented from moving out of the extended position, thus placing the actuating mechanism 108 in a second engaged configuration. When the motor bolt 152 is prevented from moving out of the extended position by the energized motor 130, the handle 116 is locked to the cam 126, by the engagement of the motor bolt 152 with the slot 166, such that rotating the handle 116 from the closed position to the open position moves the cam 126 from the closed position to the open position, and thus moves the sliding pawl 110 to the retracted position in order to allow the opening of, for example, a drawer secured by the latch 100. Thus, the lock cylinder 118 and the motor 130 provide two independent means of rotationally connecting the handle 116 to the cam 126 in order to allow the opening of a member secured by the latch 100.

In the preferred embodiment, the actuating mechanism includes a proximity sensor 156 operated by an electronic key (not shown). The motor 130 is energized, under control of electronic circuitry carried on circuit board 142, in response to a signal from the proximity sensor 156 that is generated when the proximity sensor 156 senses the presence of the electronic key held near the proximity sensor. The motor 130 and proximity sensor 156 allow relatively quick access to the contents of any compartment secured by the latch 100, for example a drawer, during emergencies. The cylinder lock 118 allows a manual override in the event of sensor, motor, or power failure.

The actuating mechanism 108 consumes very little power, because the majority of the time, i.e. during periods when the actuating mechanism is in the disengaged configuration, the motor is not energized.

The actuating mechanism 108 is mounted to the front of the drawer 102 using three screws from the inside of the drawer. The wires (not shown) for the piezo-motor 130 and the proximity sensor 156 are passed through the face of the drawer to connect them to the circuit board 142. The batteries 148 in battery housing 146 are also connected to the circuit board 142 to supply power to the system. A cover 150 protects the batteries 148 and the battery housing 146. Once the wires are connected, the latch mechanism 106 is then mounted to the back of the front drawer panel using three screws.

The Latch 100 is assembled to the front panel of a drawer and allows the end user to access the contents of the drawer via an electronic proximity sensor 156 or a traditional mechanical key. Once the latch 100 is unlocked, the user then rotates the handle 116 which retracts a sliding pawl 110 on the inside of the drawer 102 enabling the drawer to slide open.

In electronic access, the user places an electronic key against the proximity sensor 156, the electrical system on circuit board 142 checks to see whether the user is authorized for access. If access is granted, power is sent to piezo-motor 130 and a green LED will light up on the proximity sensor 156. This allows the outer cam 126 to engage with the handle 116. When the handle 116 is rotated, the outer cam 126 rotates as well and thereby retracts the sliding pawl 110. The system can be programmed to remain in the unlocked state for 5 seconds or more (in 5 second increments). If the user is not authorized for access, a red LED will light up on the sensor 156 and no power is sent to the piezo-motor 130. Without power to the piezo-motor 130, the handle 116 and outer cam 126 are NOT engaged; therefore the sliding pawl 110 will not retract. If there is a power failure or if the electronic key is not available, the system can be unlocked using a properly matched traditional key. By inserting an appropriate key into the lock plug 118 and rotating it, the lock bolt 122 extends out of the handle 116 and mechanically engages the outer cam 126 to the handle 116. The drawer 102 can now be opened by rotating the handle 116. The system stays in the unlocked state as long as the lock plug 118 remains in the un-locked position.

The printed circuit board (PCB) 142 can be moved to the actuating mechanism 108. This eliminates the need for wires to have to pass through the front drawer panel. This also frees up space inside the latch mechanism 106. The battery pack can then be relocated to the inside of the housing 114, thus minimizing the overall size of the latch.

An important benefit realized from this design of handle is that when it is in it's locked mode, it is in a soft lockout condition whereby the handle 116 can still rotate, but turning it doesn't accomplish anything. No amount of torque, even excessive overtorque, applied to the handle 116 can open the latch when the actuating mechanism 108 is in the disengaged configuration. The handle 116 will simply rotate ineffectually when the actuating mechanism 108 is in the disengaged configuration.

Additionally the actuating mechanism 108 can be used in combination with various other latch mechanisms that can be actuated by a rotating member. This may require modification of the biasing means for the handle 116 by replacing the slide 136 and springs 138, 140 with, for example, a torsion spring depending upon the required range of rotation. All the individual electronic components are off-the-shelf items or can be implemented using standard circuit design techniques and therefore it is not necessary to describe them here in detail. In the present embodiment, the actuating mechanism 108 is used to operate a slam latch, but it is within the scope of the invention for the actuating mechanism 108 to alternatively be used to operate various other types of latches, including well known types such as a simple rotating pawl latch or a compression latch of the type that outputs a combination of rotational and rectilinear movement in response to a rotational input.

The proximity sensor 156 is an off-the-shelf access controller using iButton® technology available from DALLAS SEMICONDUCTOR, and was chosen and used in combination with a circuit board design that uses low penlight battery power and also is normally "asleep" so it draws very little battery power until a user brings the electronic key into proximity with the sensor 156 on the latch. This technology uses the iButton® key that is contacted with the sensor 156 to unlock the latch 100. It is also intended for various other ways of controlling authorization to open the latch to be within the scope of the invention. The other ways include the use of electronic keypads, retina or fingerprint readers, radio frequency identification (RFID) tags, push button key chain fobs (like those used for locking/unlocking automobiles), or mechanical pushbutton or combination lock access.

The piezoelectric motor unit 130 also consumes very little power, being normally asleep, and is an off-the-shelf item available from SERVOCELL, Ltd. in the United Kingdom. The piezoelectric unit 130 has a slide or bolt 152 that is normally spring loaded to its extended position, but when energized a piezoelectric leaf-like member inside deforms into place to block the slide 152 from being retracted, thus locking the slide 152 into its extended position.

Referring to FIGS. 39-65H, the present invention is directed to a latch that is particularly suited for releasably securing a first member relative to a second member. In the illustrated example, the illustrative embodiment 200 of the latch of the present invention is shown being used to secure a drawer; however, it should be readily apparent that the latch 200 can be used to releasably secure a wide variety of types of closure members in the closed position. For example, the latch 200 can be used to secure any type of door in a closed position against a doorframe. In the illustrative embodiment, the latch 200 is used to secure the drawer 202 in a closed position relative to a chest or cabinet 204.

The present invention is directed to improvements in latches and latch actuators. The illustrated embodiment exemplifying the several inventive concepts of the present invention is a latch 200 that includes a sliding pawl latch mechanism 206 provided with a latch actuating mechanism 208 that can be accessed on the exterior of the member, such as a door, drawer, panel or the like, which is secured by the latch 200. The illustrated embodiment of the latch mechanism 206 includes a housing 214, a sliding pawl 210, and a biasing means 212. The pawl 210 moves rectilinearly along a straight line axis between an extended position and a retracted position. The extended position corresponds to the latched position of the pawl 210, and the retracted position corresponds to the unlatched position of the pawl 210. The pawl 210 is biased toward the latched position, i.e. extended position, by the biasing means 212, which is a compression coil spring 212 in the illustrated embodiment. The illustrated coil spring 212 is of the type having two or more "dead" coils in the middle thereof.

Figure 47:
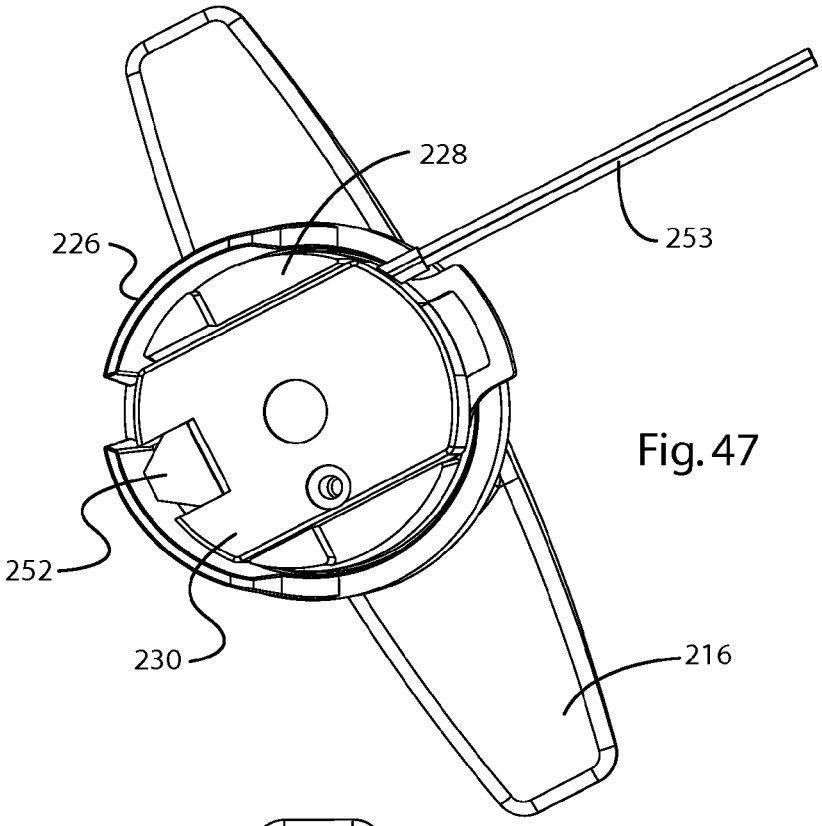
FIG. 47 is a fragmentary view of the actuating mechanism of FIGS. 44A-44G showing the motor bolt in the retracted position.
Figure 48A:
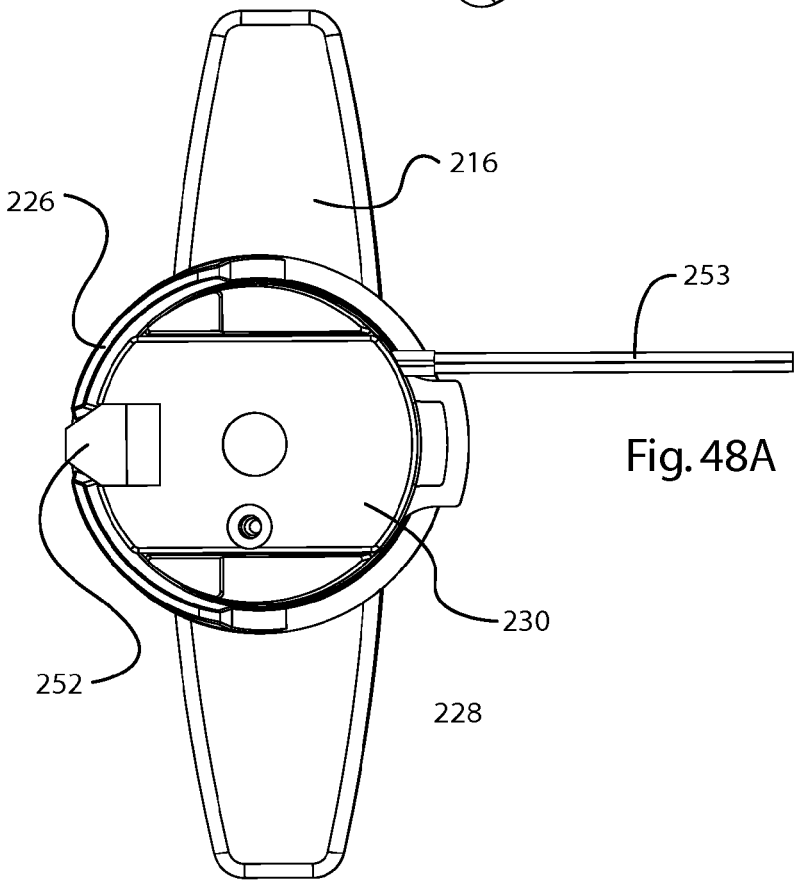
FIG. 48A is a fragmentary view of the actuating mechanism of FIGS. 44A-44G showing the motor bolt in the extended position.
Figure 48B:
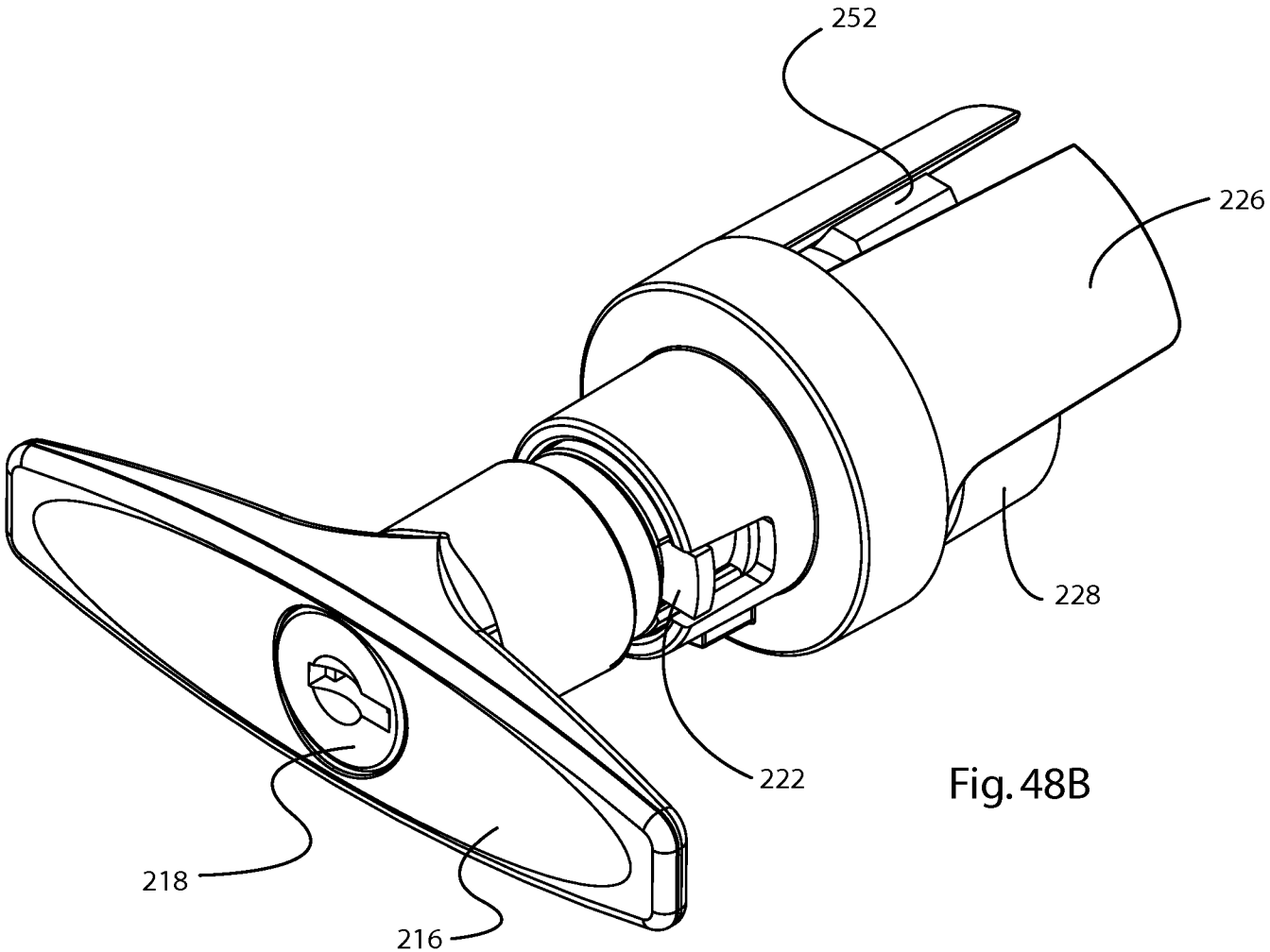
FIG. 48B is a fragmentary view showing the handle of the actuating mechanism of FIGS. 44A-44G connected to the outer cam.
Figure 49:
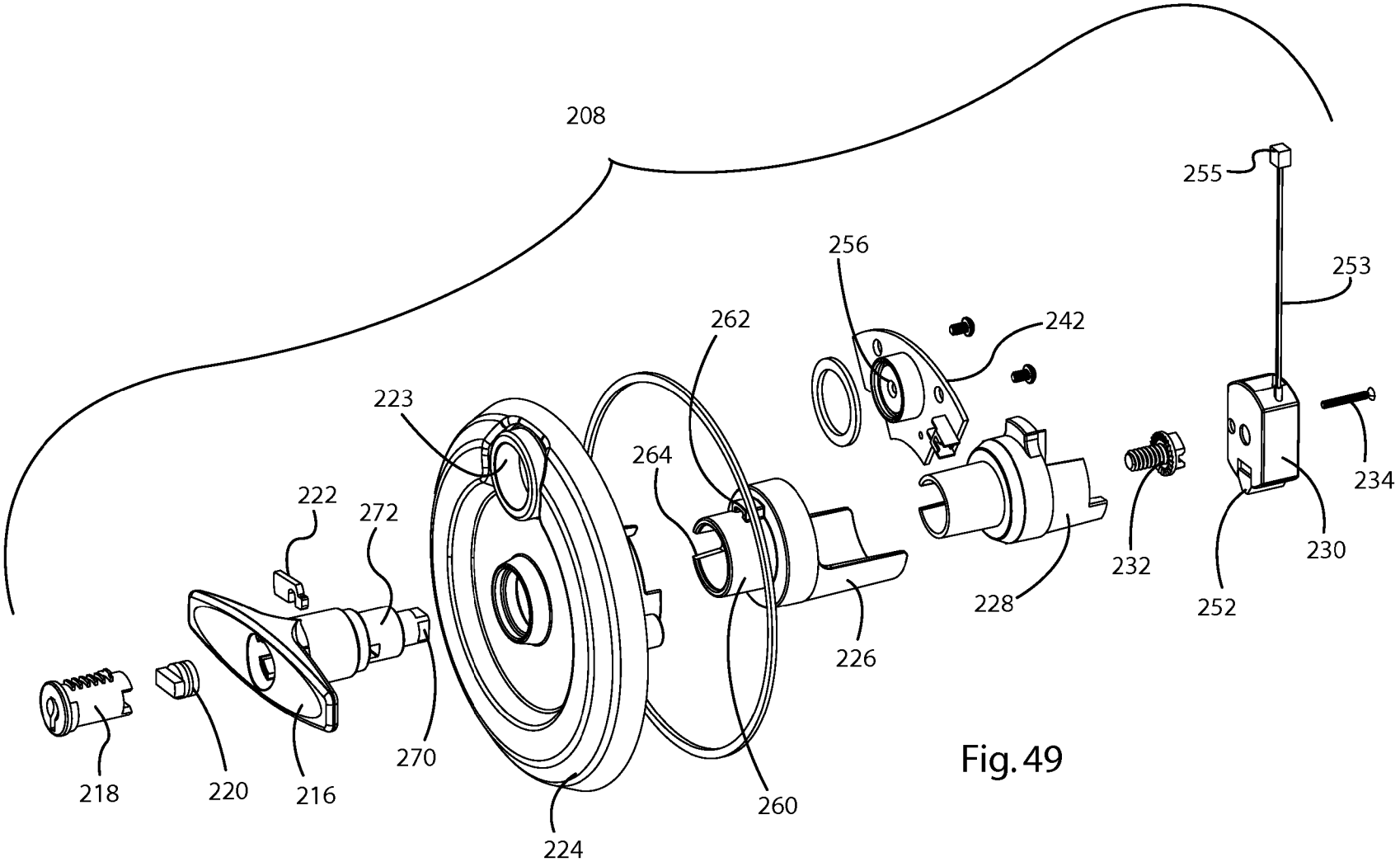
FIG. 49 is an exploded view of the actuating mechanism of FIGS. 44A-44G.
Figure 50:
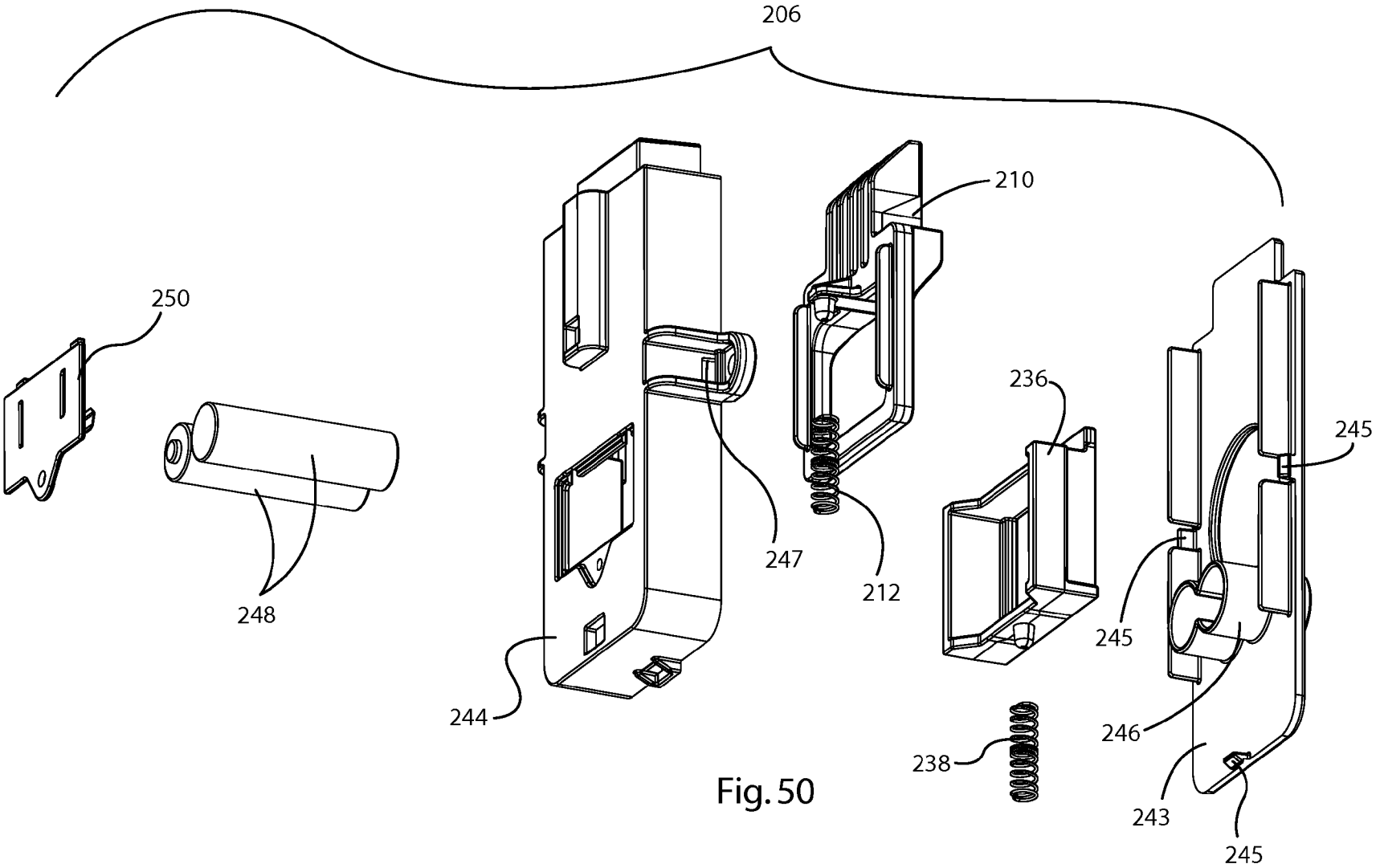
FIG. 50 is an exploded view of the latch mechanism of FIGS. 45A-45H.
Figure 51:
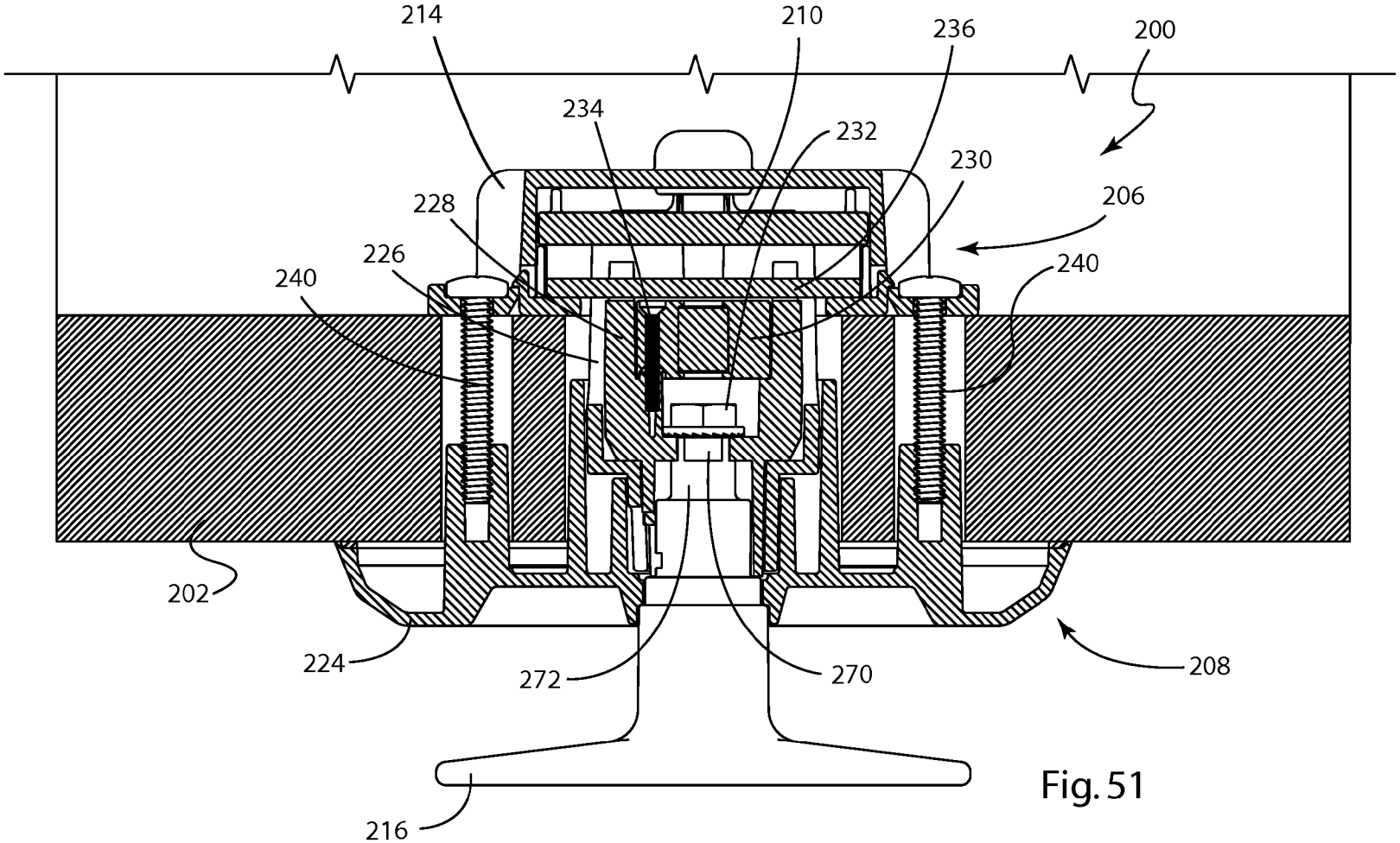
FIG. 51 is a cross sectional view of the second embodiment of the latch according to the present invention shown installed to a drawer and illustrating the engagement of the screws for attaching the actuating mechanism to the latch mechanism.
Figures 52, 53:
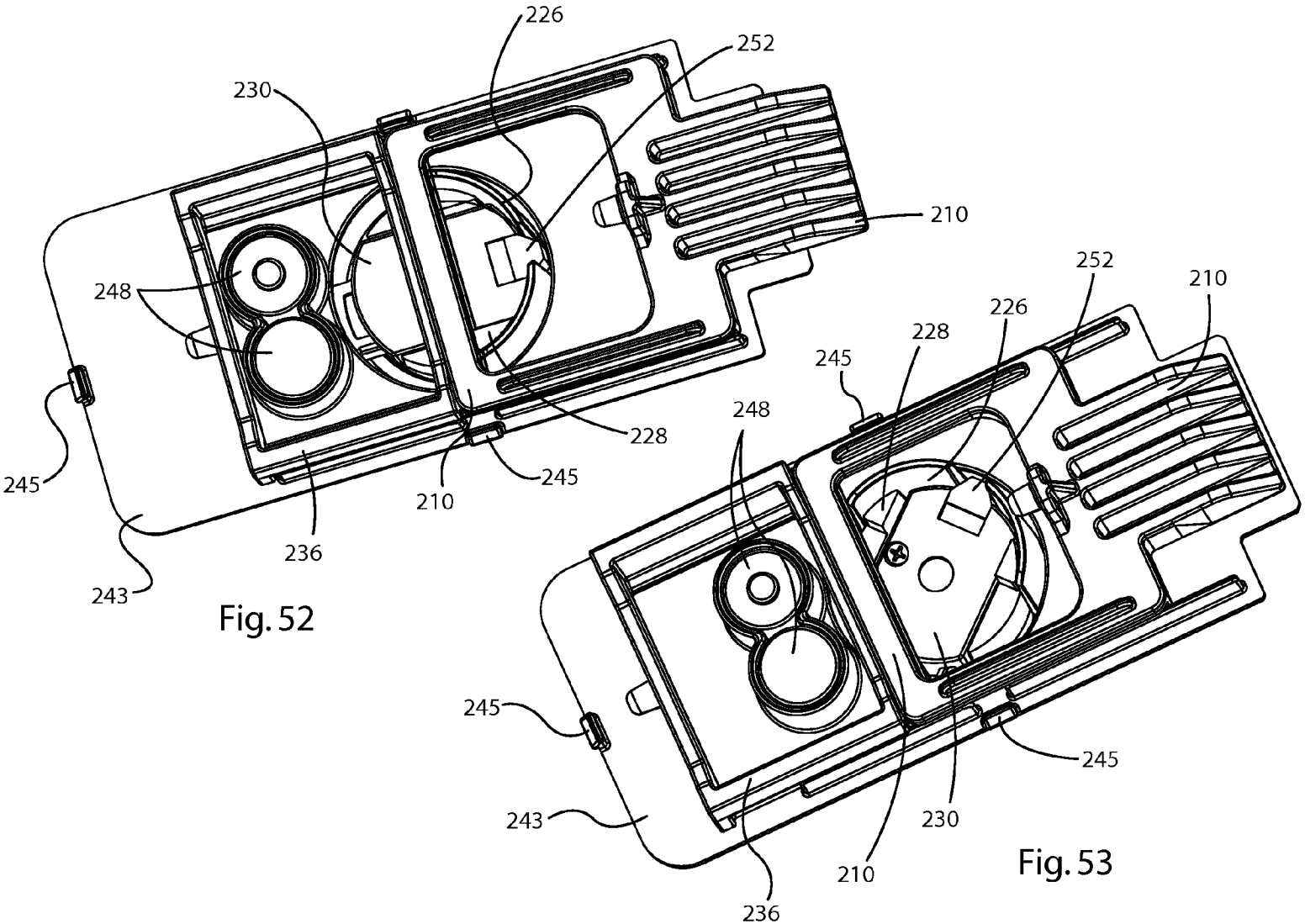
FIG. 52 is a fragmentary view of the latch of FIGS. 43A-43G shown with the latch mechanism in the latched configuration and with the latch pawl in the extended position.
FIG. 53 is a fragmentary view of the latch of FIGS. 43A-43G shown with the latch mechanism in the unlatched configuration and with the latch pawl in the retracted position.
Figure 54A:
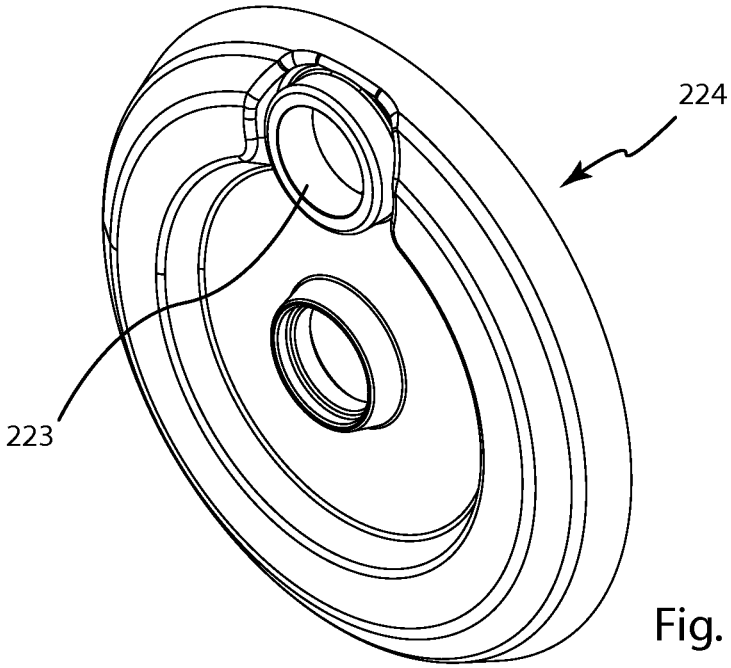
FIGS. 54A-54H are views of the housing of the actuating mechanism of FIGS. 44A-44G.
Figure 54B:
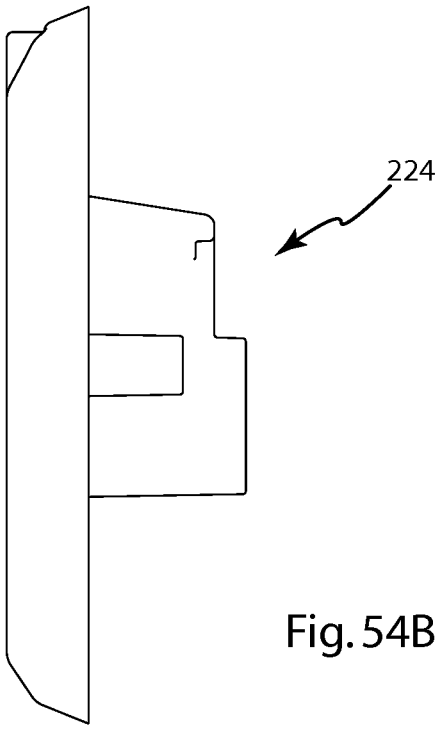
Figure 54C:
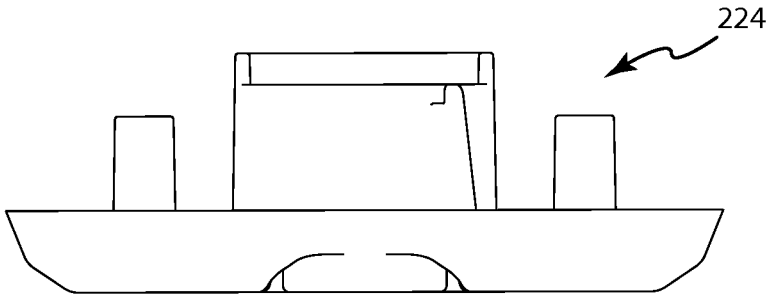
Figure 54D:
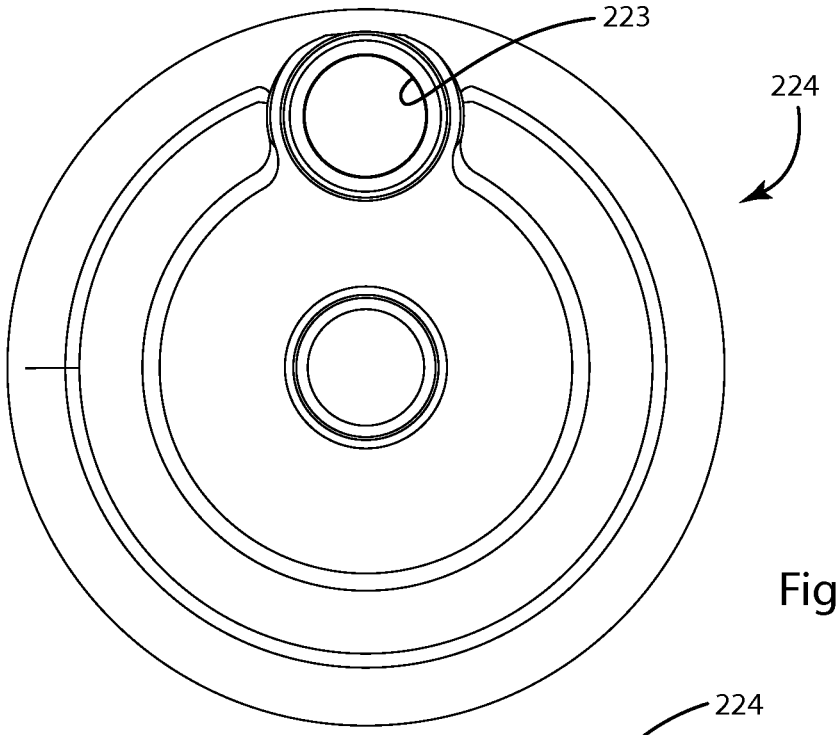
Figure 54E:
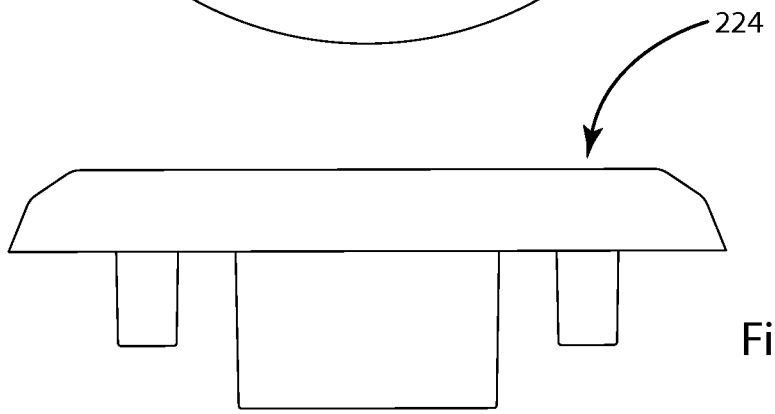
Figure 54F:
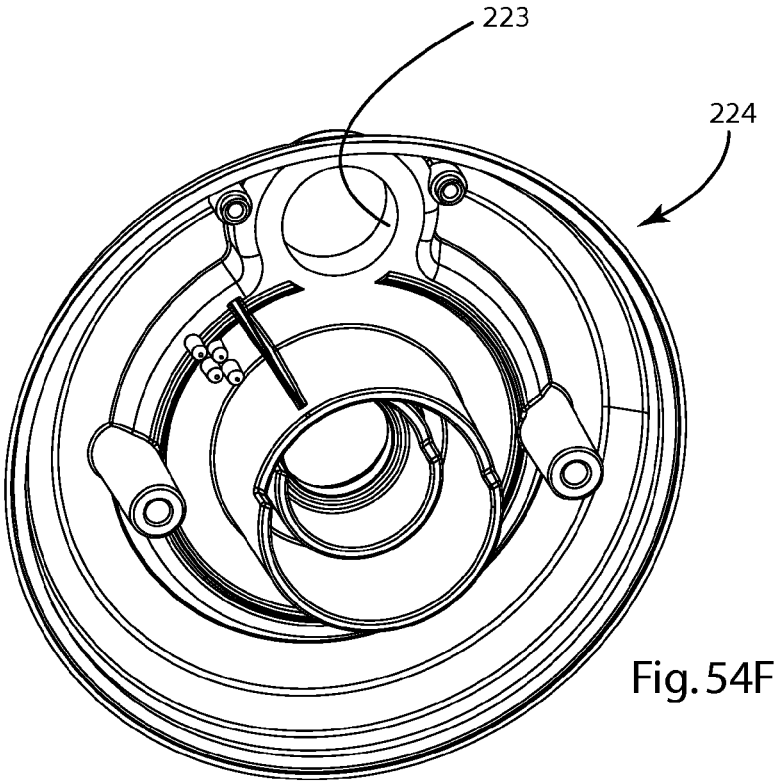
Figure 54G:
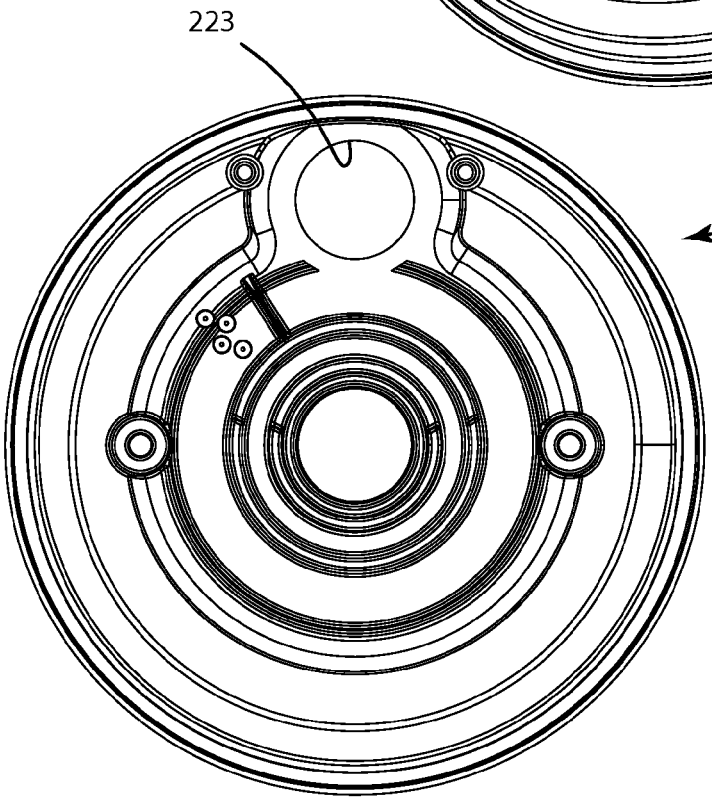
Figure 54H:
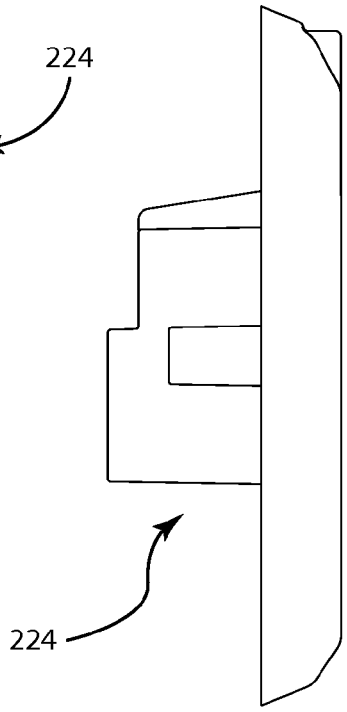
Figure 55A:
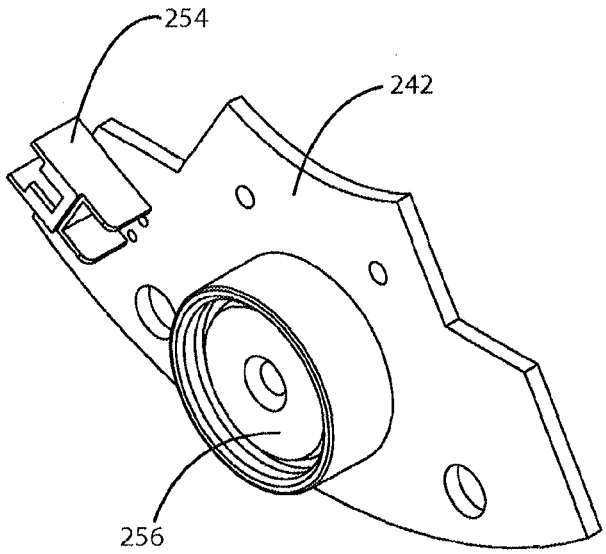
FIGS. 55A-55G are views of the printed circuit board (PCB) carrying the proximity sensor of the actuating mechanism of FIGS. 44A-44G.
Figure 55B:
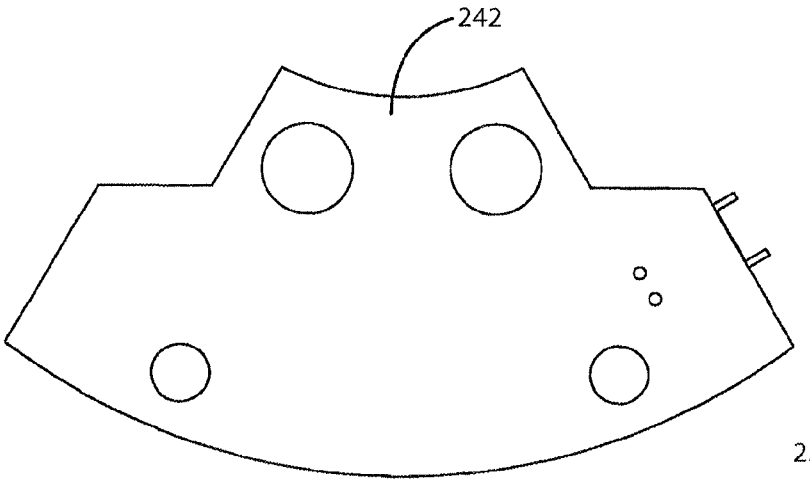
Figure 55C:
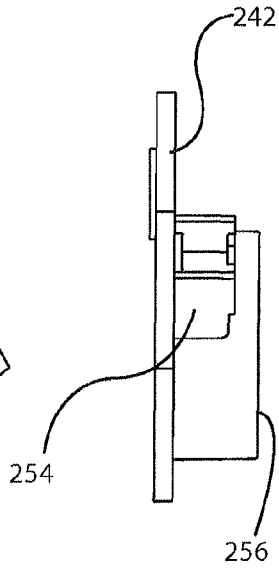
Figure 55D:
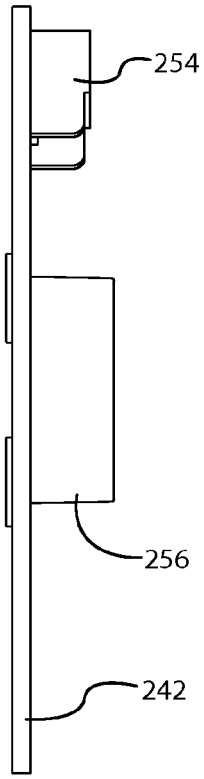
Figure 55E:
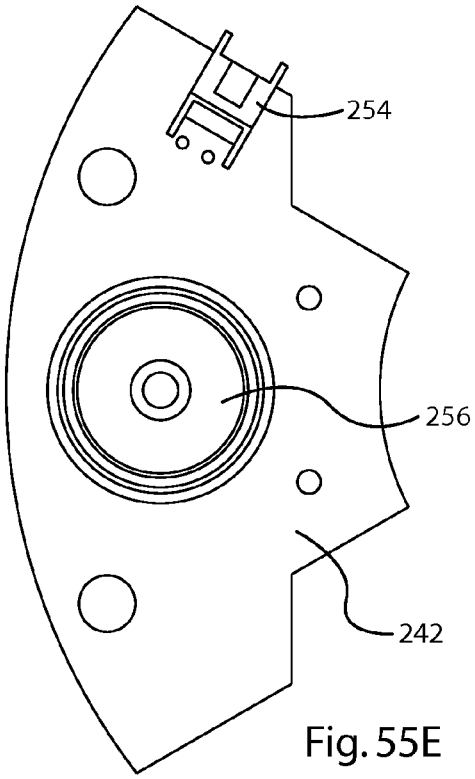
Figure 55F:
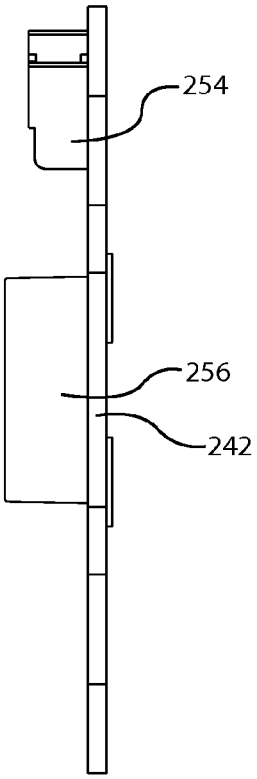
Figure 55G:
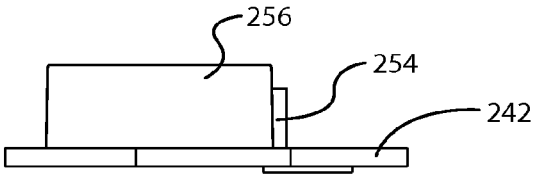
Figure 56A:
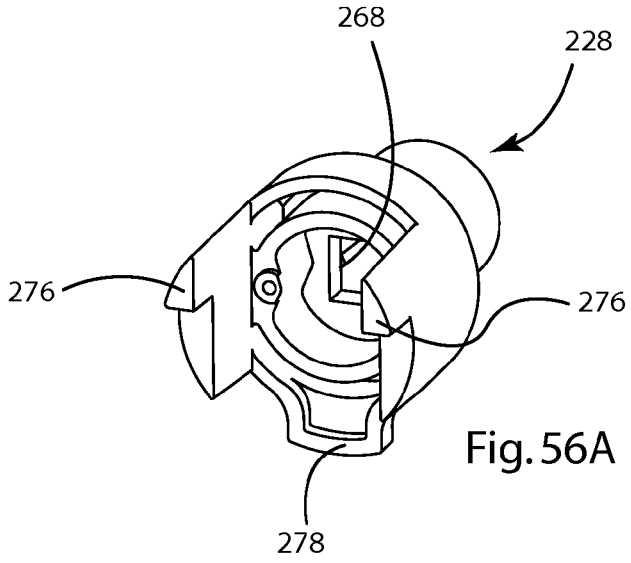
FIGS. 56A-56H are views of the inner cam of the actuating mechanism of FIGS. 44A-44G.
Figure 56B:
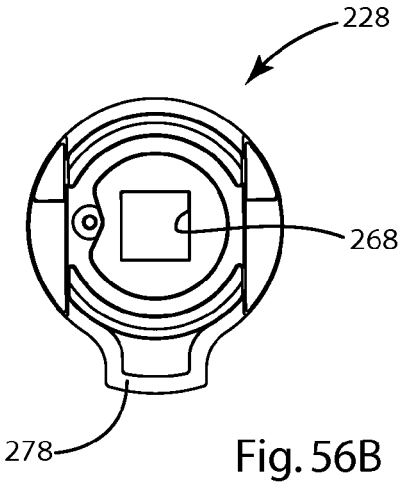
Figure 56C:
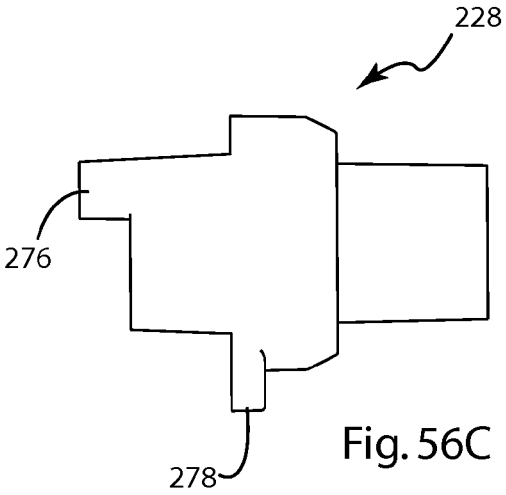
Figure 56D:
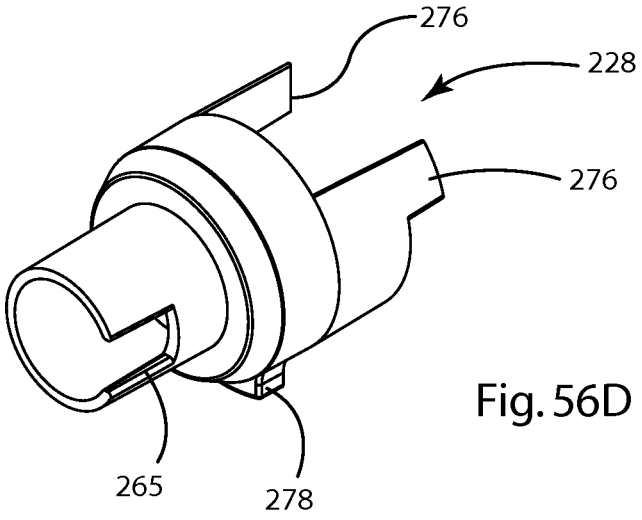
Figure 56E:
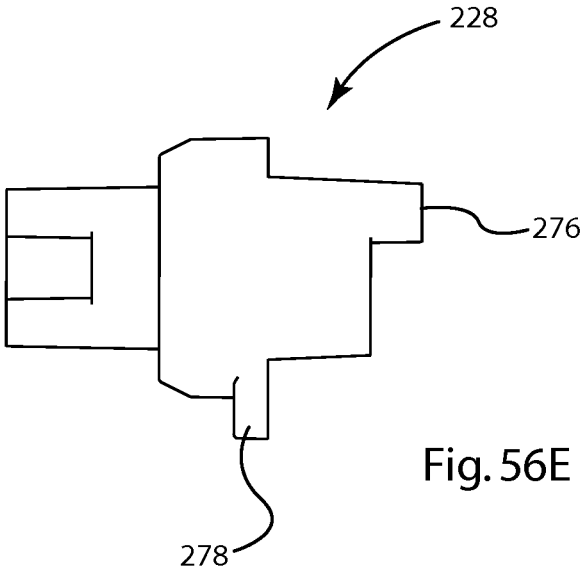
Figure 56H:
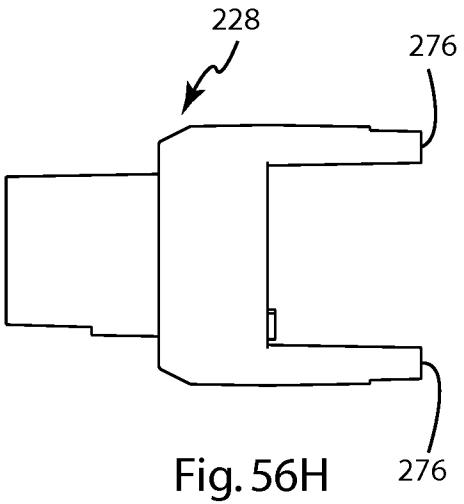
Figure 56G:
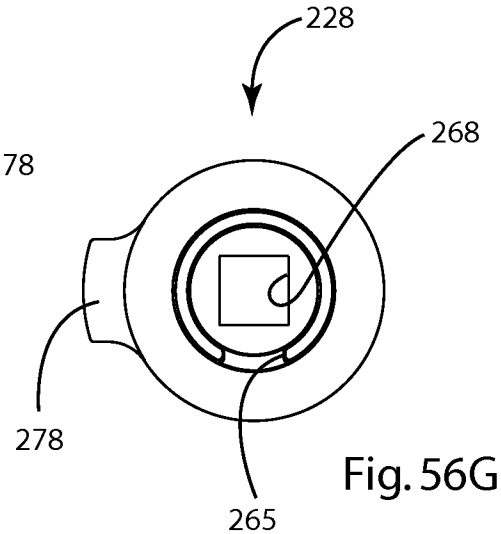
Figure 56F:
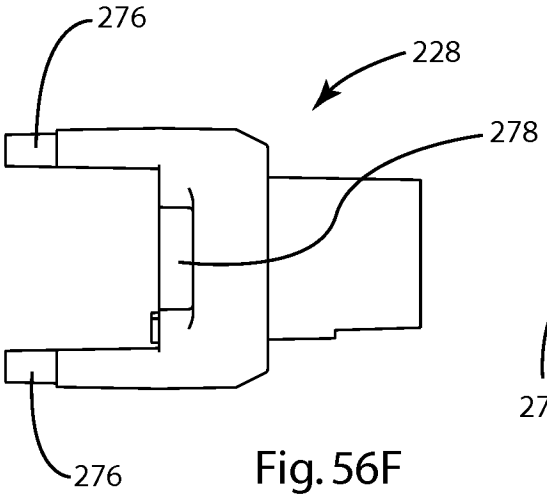
Figure 57A:
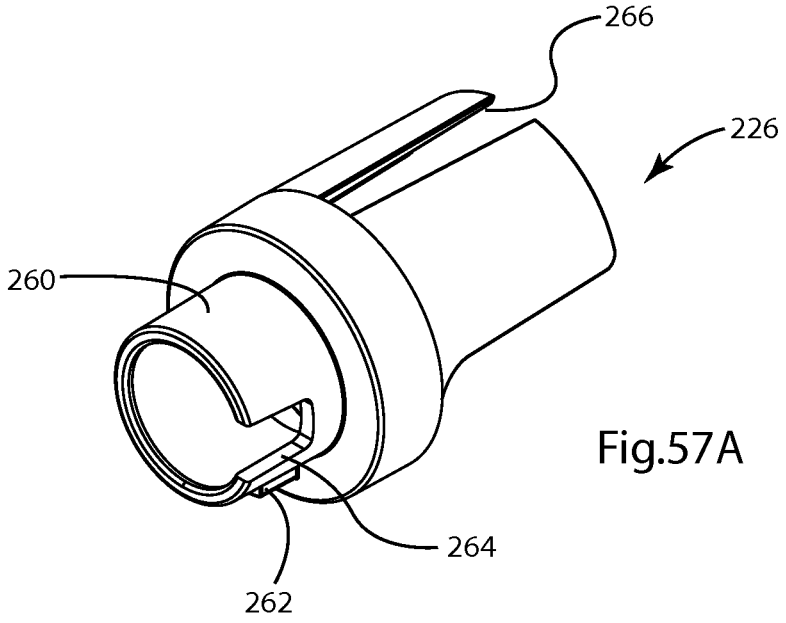
FIGS. 57A-57H are views of the outer cam of the actuating mechanism of FIGS. 44A-44G.
Figure 57B:
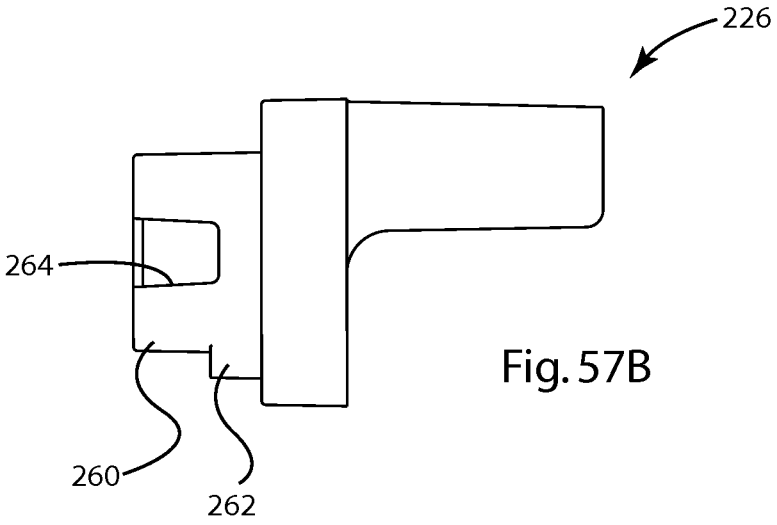
Figure 57C:
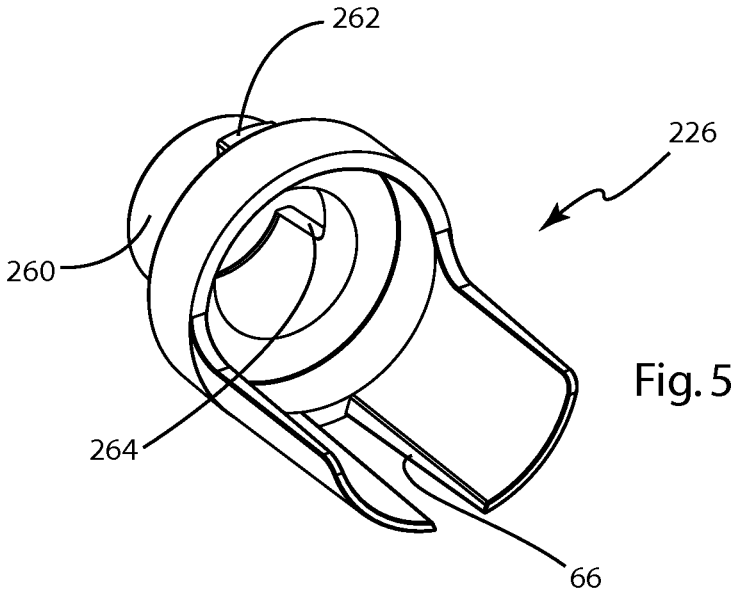
Figure 57D:
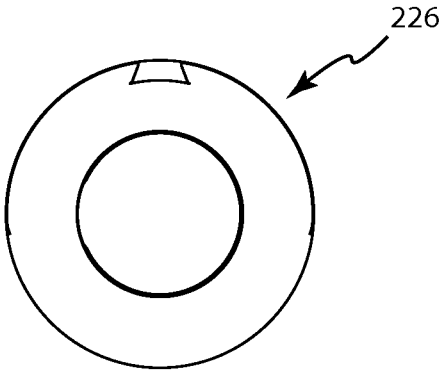
Figure 57E:
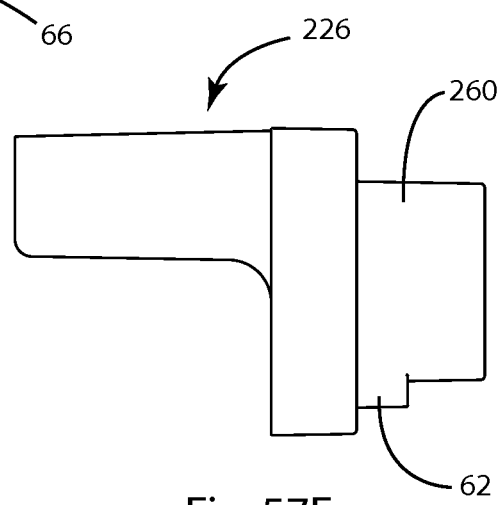
Figure 57H:
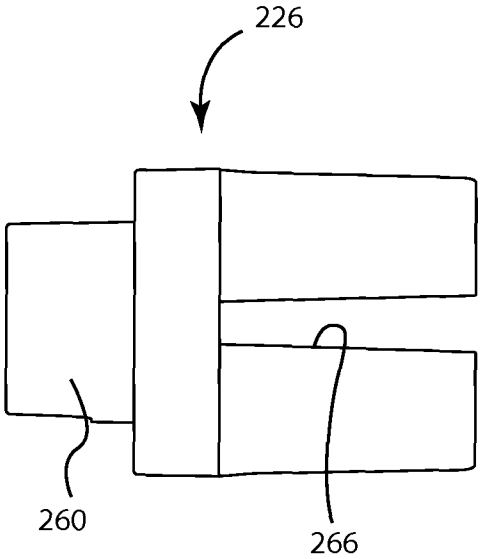
Figure 57G:
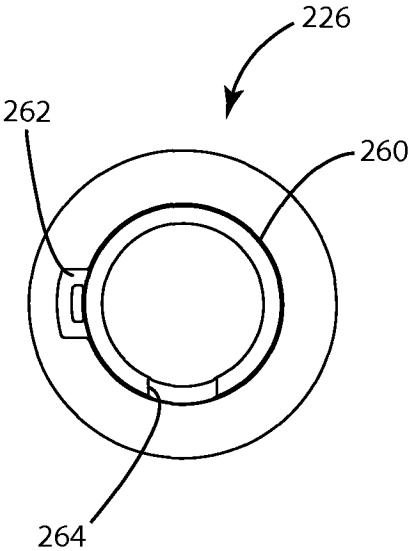
Figure 57F:
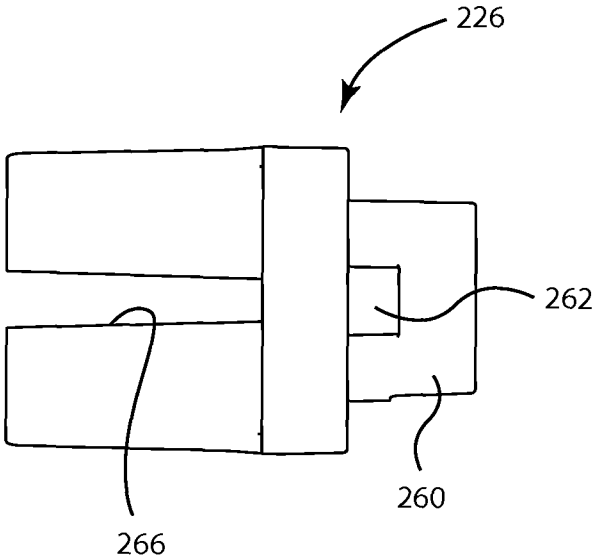
Figure 58A:
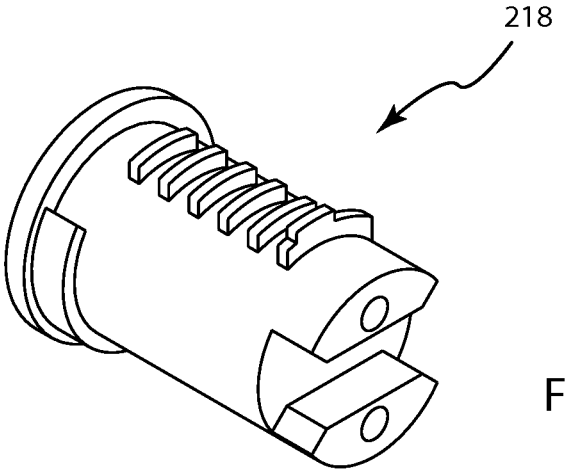
Figure 58B:
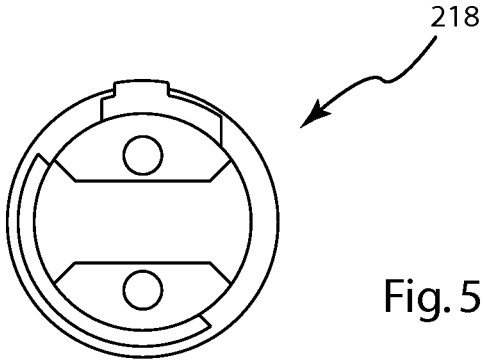
Figure 59A:
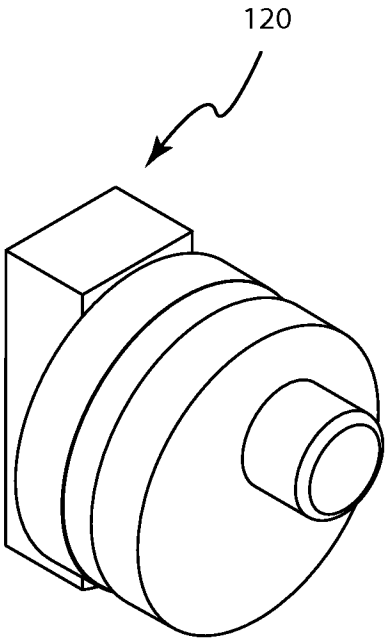
FIGS. 59A-59F are views of the eccentric cam of the actuating mechanism of FIGS. 44A-44G.
Figure 59B:
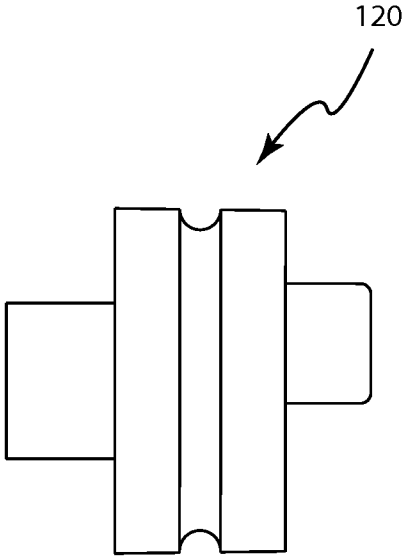
Figure 59E:
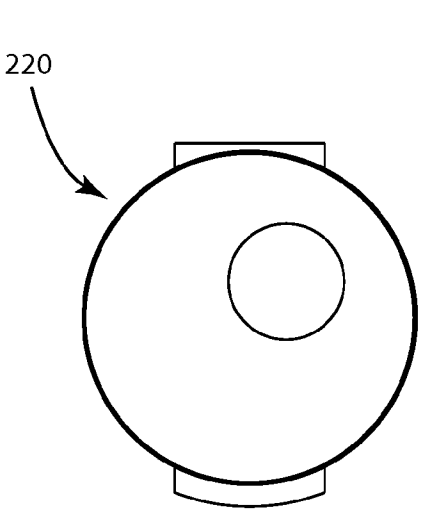
Figure 59D:
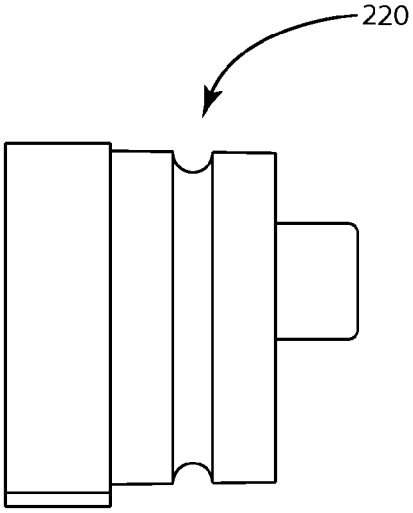
Figure 59F:
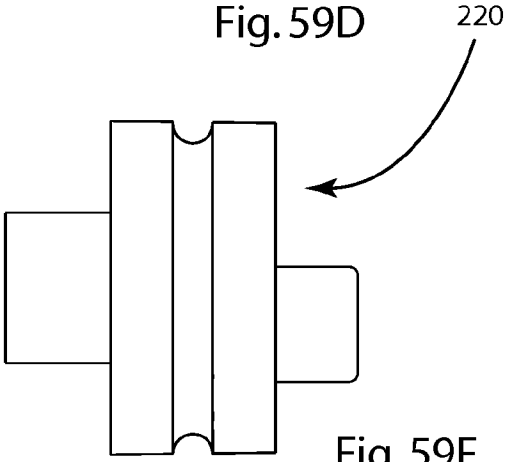
Figure 59C:
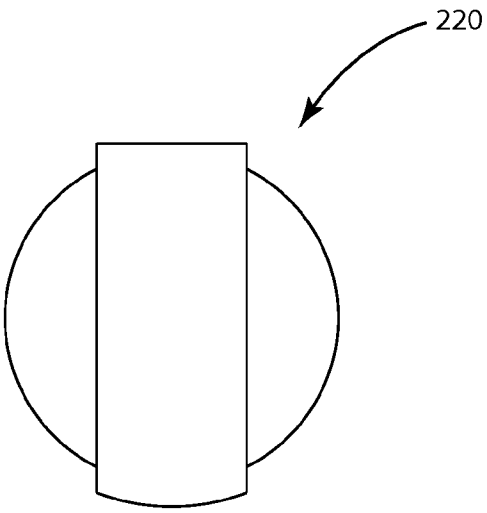
Figure 60A:
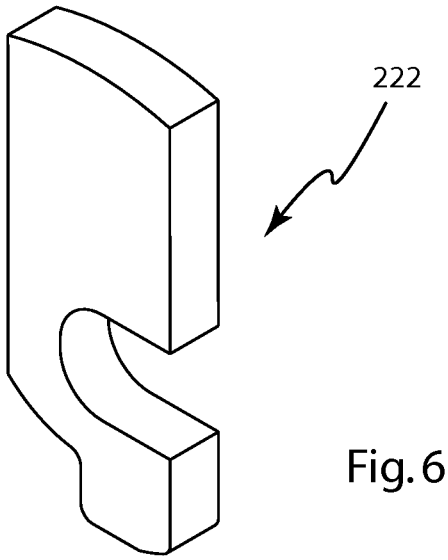
FIGS. 60A-60F are views of the lock bolt of the actuating mechanism of FIGS. 44A-44G.
Figure 60B:
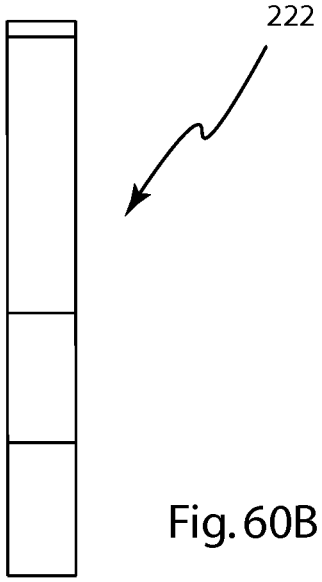
Figure 60C:
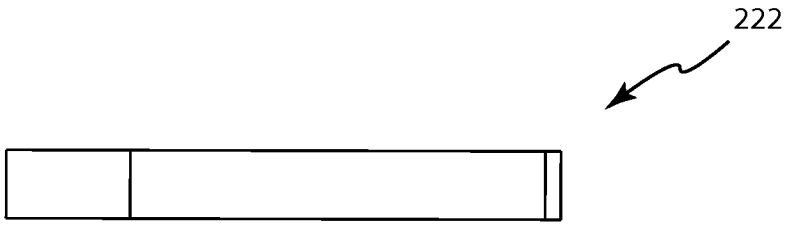
Figure 60F:
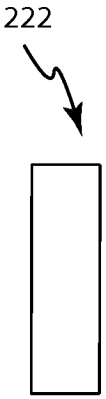
Figure 60E:
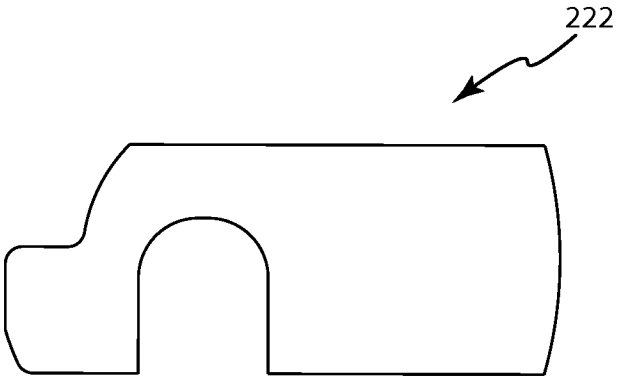
Figure 60D:
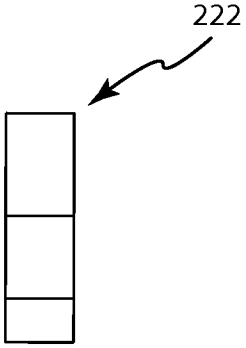
Figure 61B:
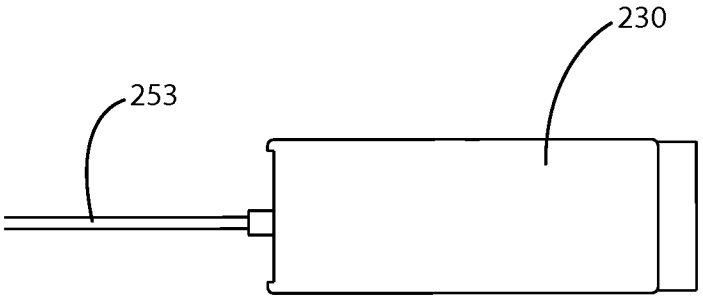
FIGS. 61A-61G are views of the motor of the actuating mechanism of FIGS. 44A-44G.
Figure 61A:
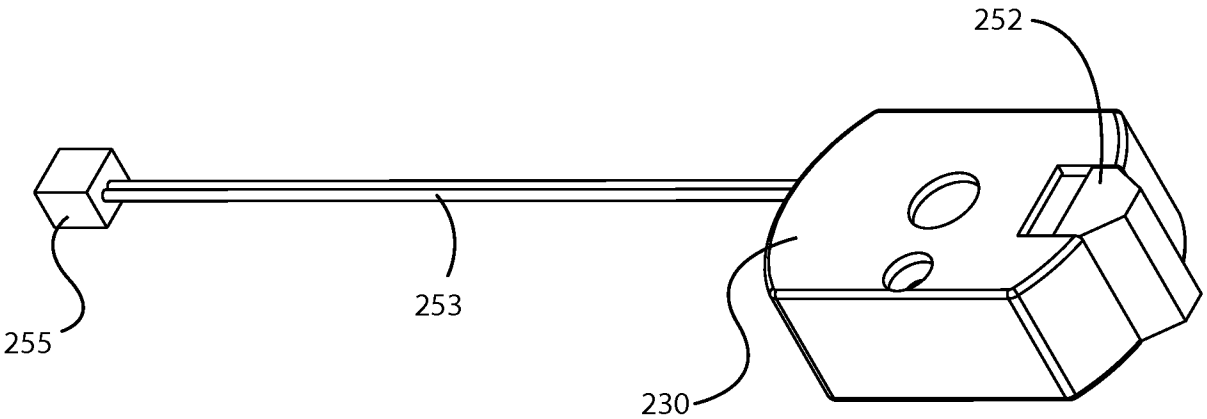
Figure 61C:
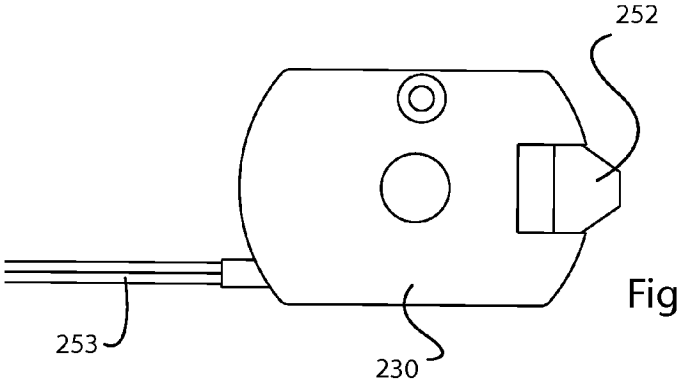
Figure 61D:
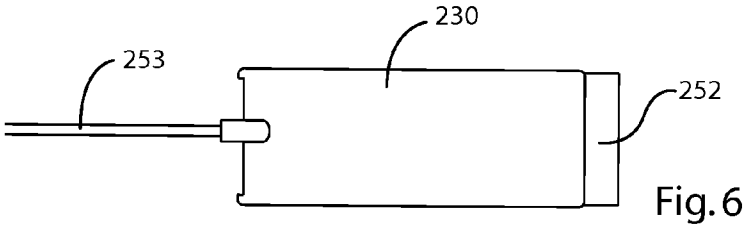
Figure 61F:
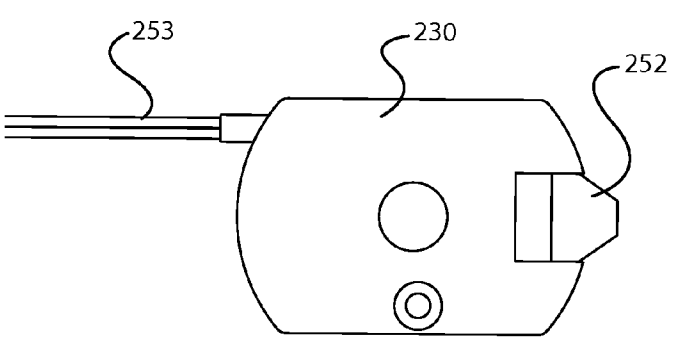
Figure 61G:
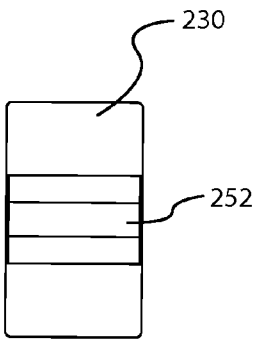
Figure 61E:
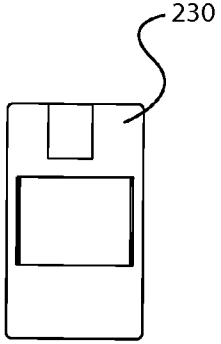
Figure 62A:
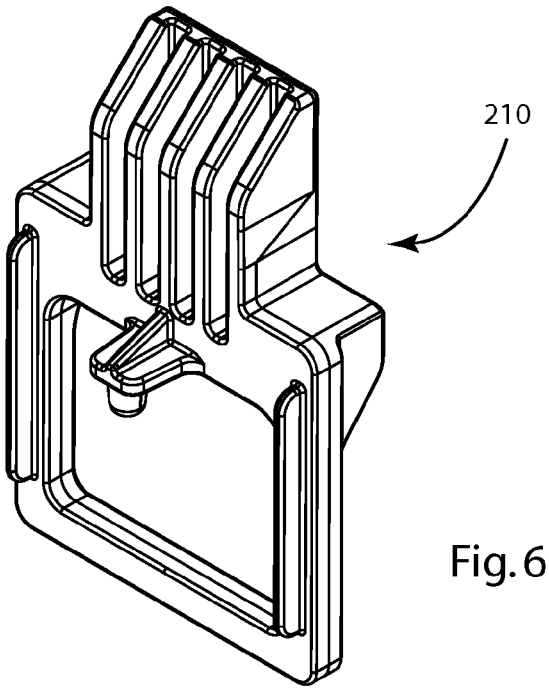
FIGS. 62A-62H are views of the latch pawl of the latch mechanism of FIGS. 45A-45G.
Figure 62C:
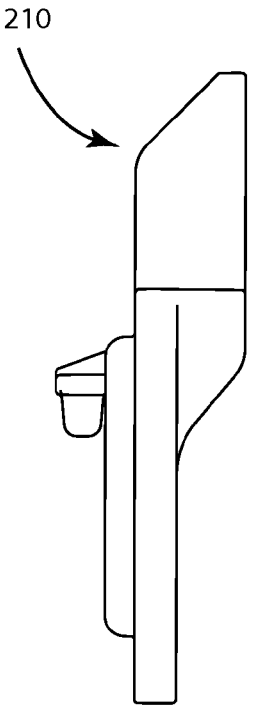
Figure 62B:
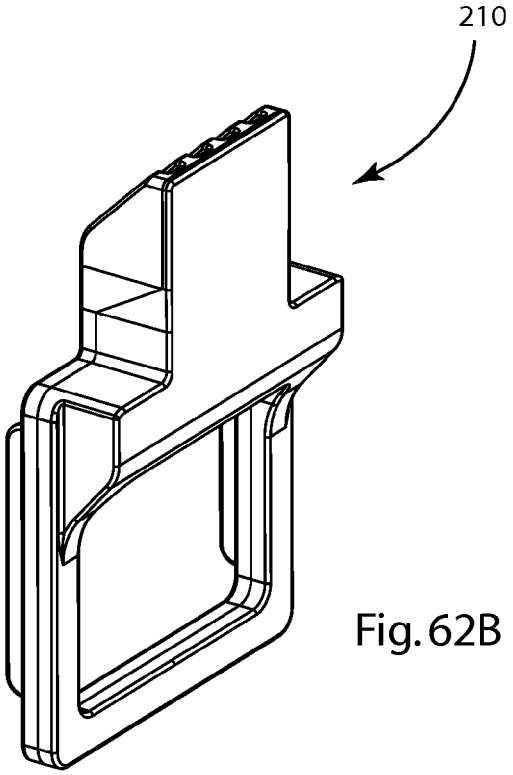
Figure 62D:
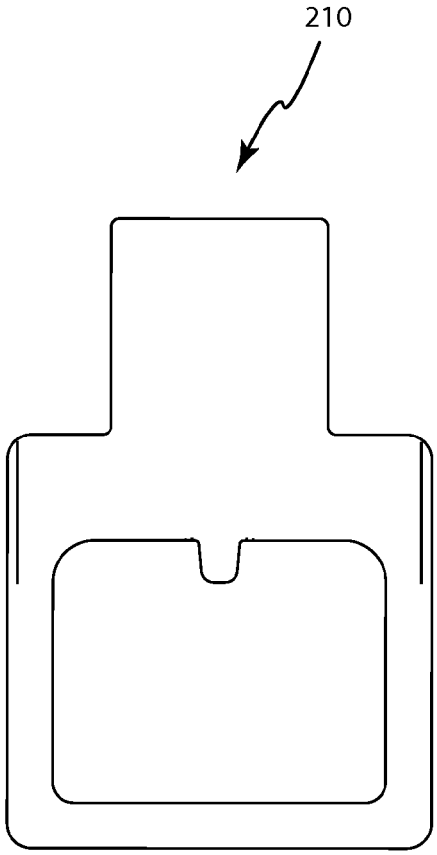
Figure 62E:
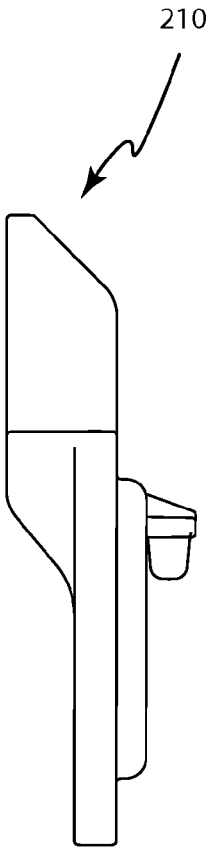
Figure 62F:
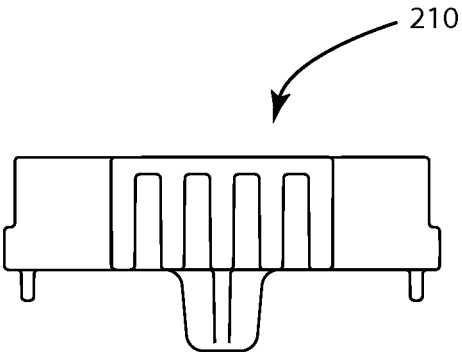
Figure 62G:
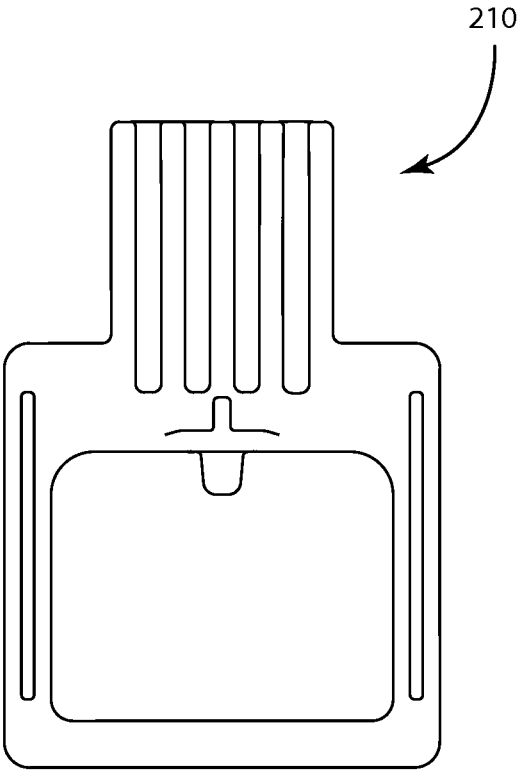
Figure 62H:
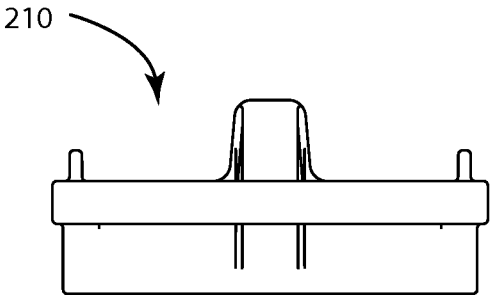
Figure 63A:
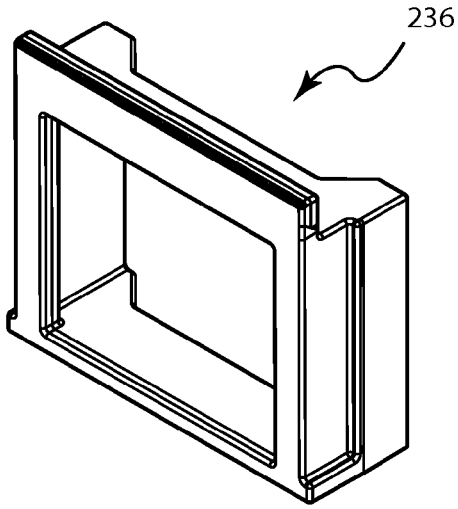
FIGS. 63A-63H are views of the return spring slide of the actuating mechanism of the latch of FIGS. 43A-43G.
Figure 63B:
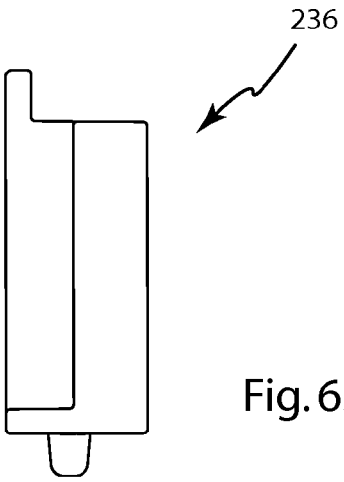
Figure 63C:
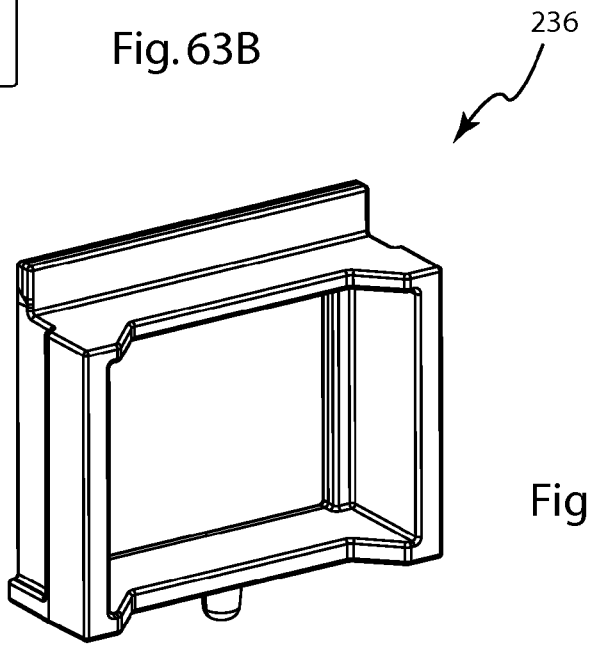
Figure 63D:
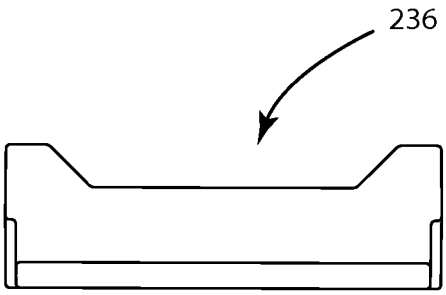
Figure 63E:
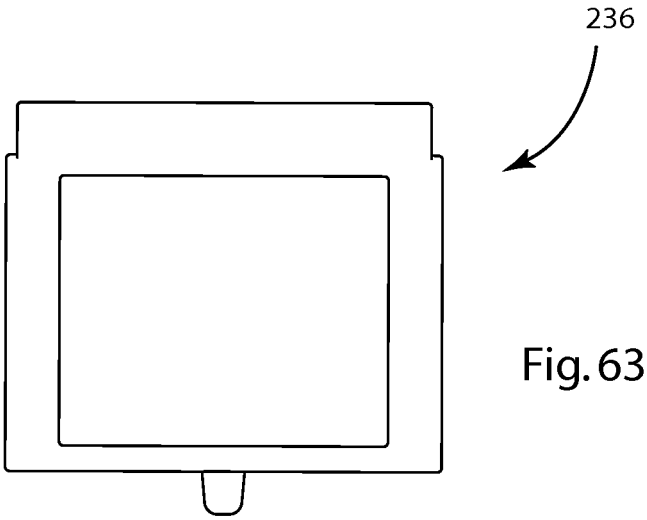
Figure 63F:
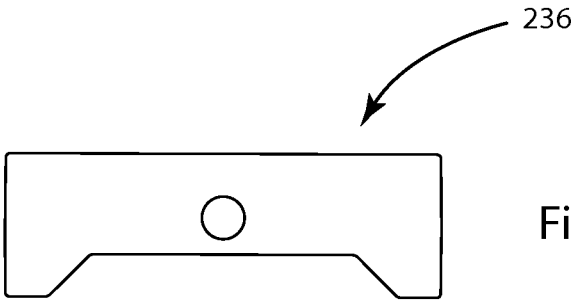
Figure 63G:
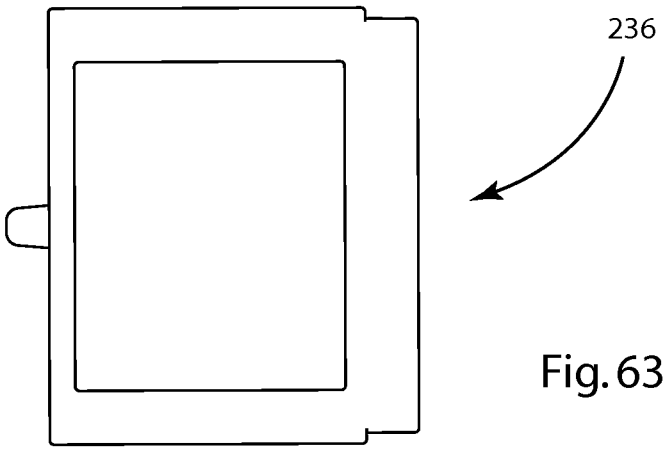
Figure 63H:
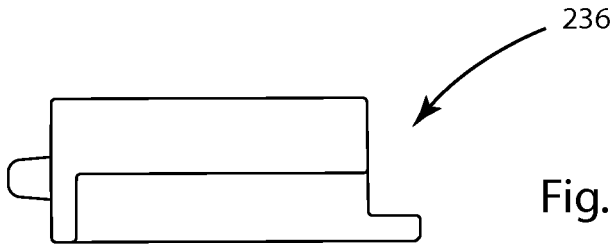
Figures 64A, 64B, 64C:
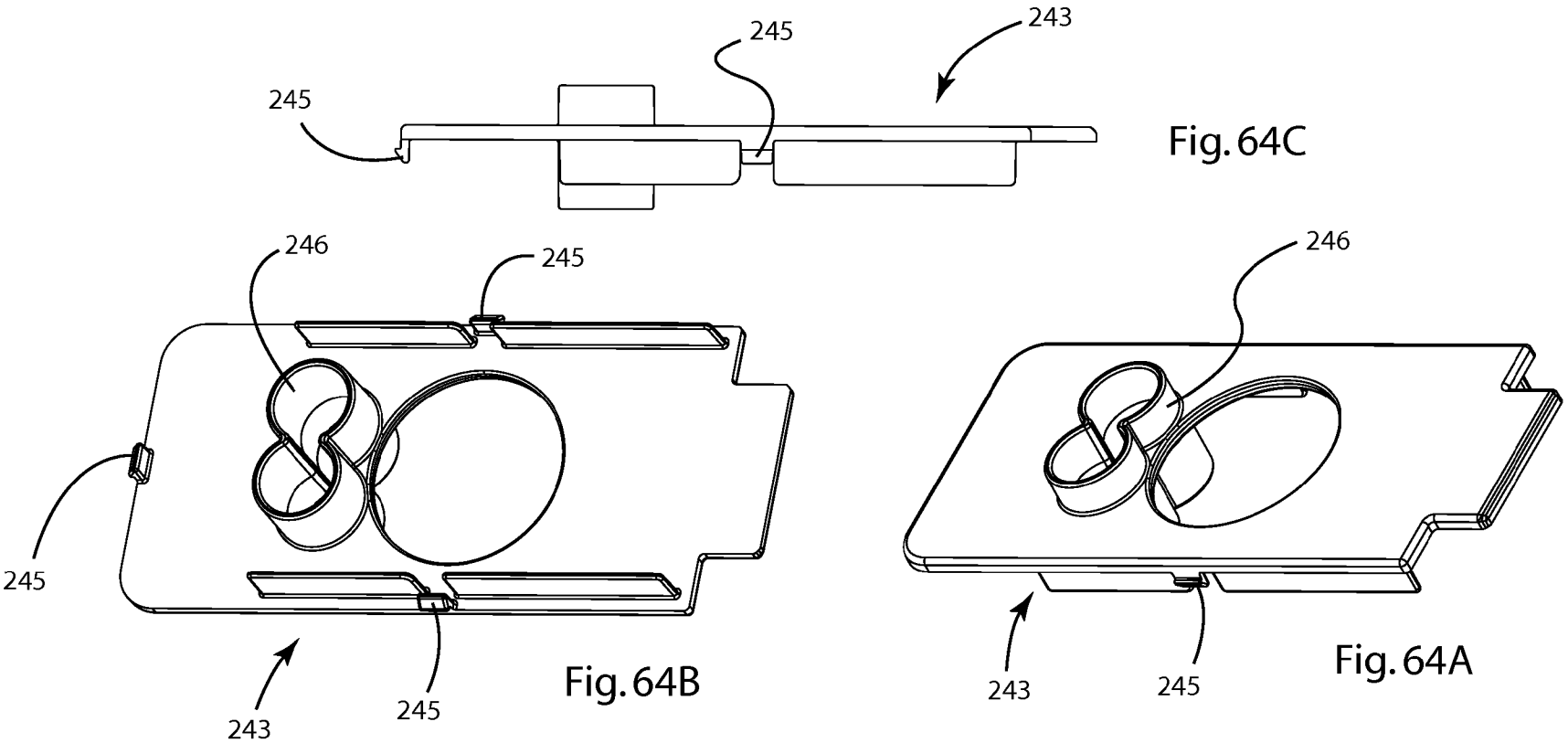
FIGS. 64A-64H are views of the back portion of the housing of the latch mechanism of FIGS. 45A-45H.
Figure 64D:
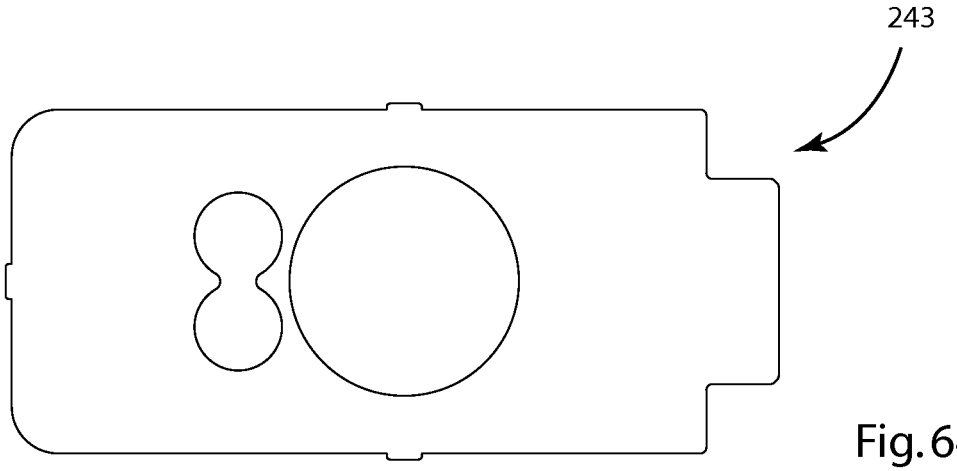
Figure 64E:
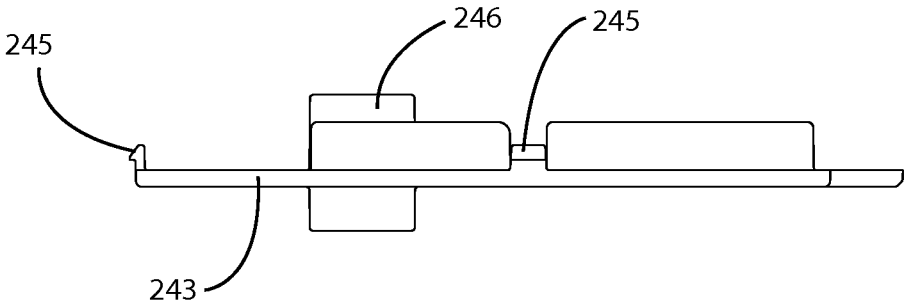
Figure 64F:
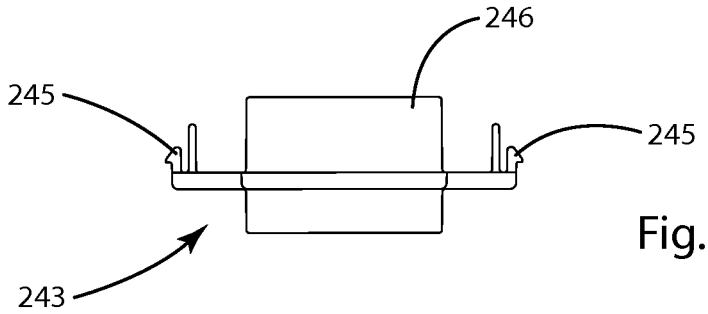
Figure 64G:
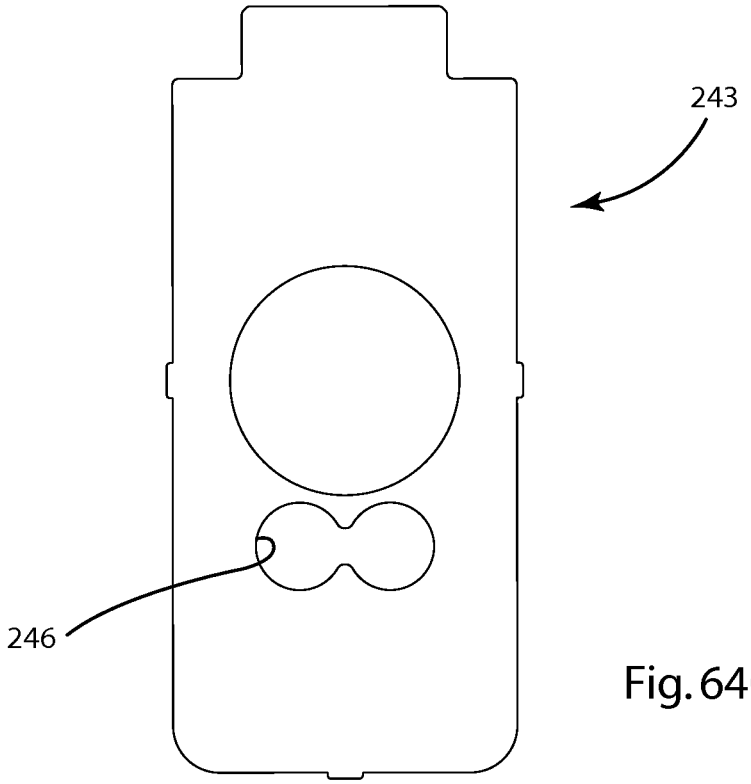
Figure 64H:
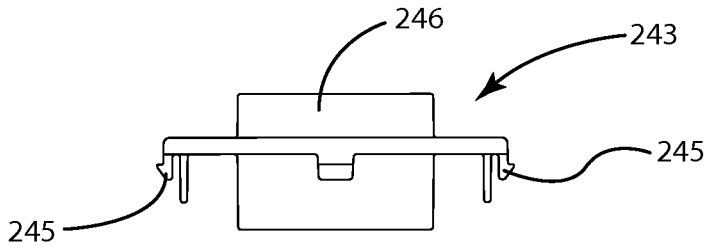
Figures 65A, 65B, 65C:
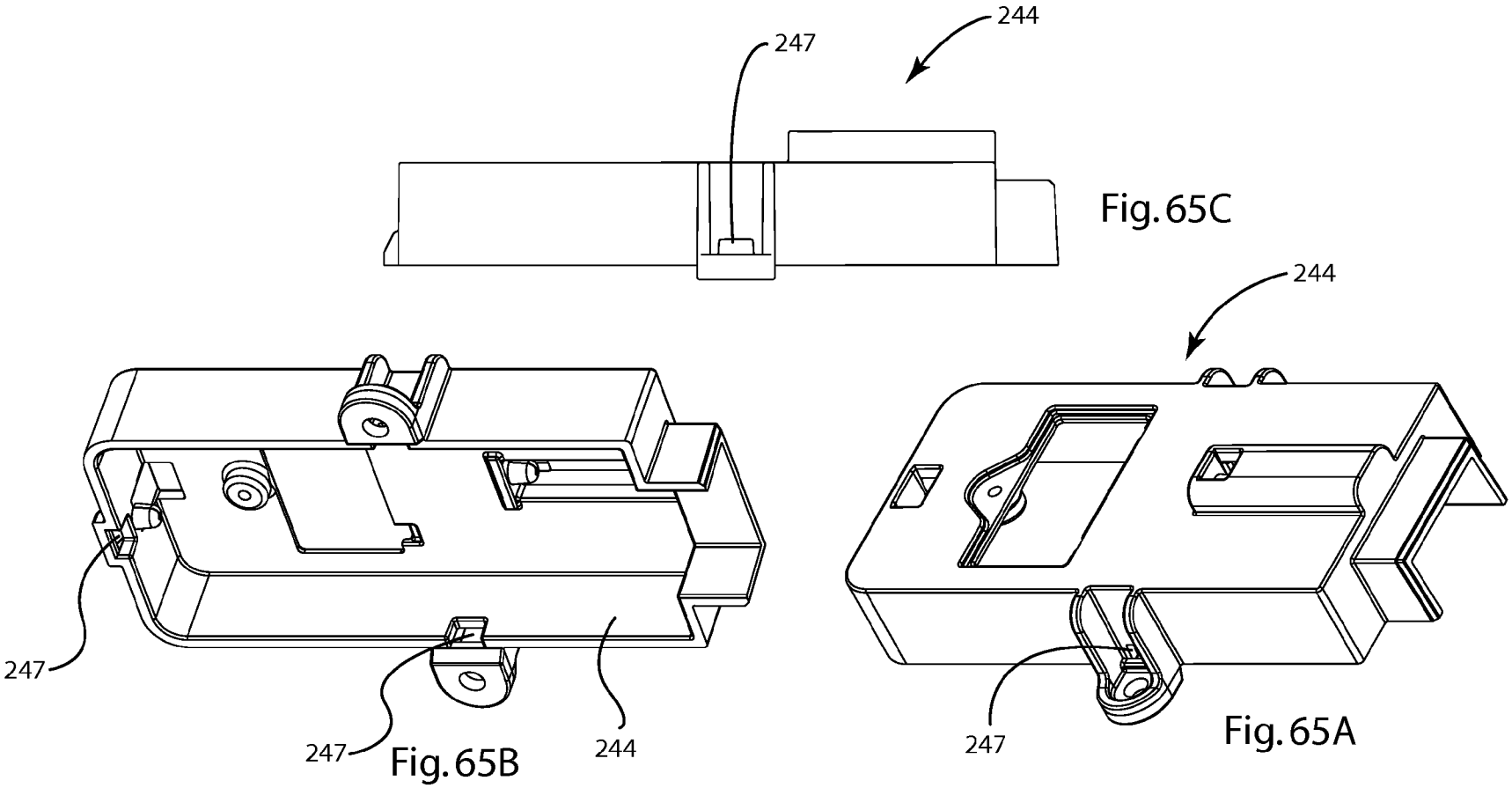
FIGS. 65A-65H are views of the front portion of the housing of the latch mechanism of FIGS. 45A-45H.
Figure 65D:
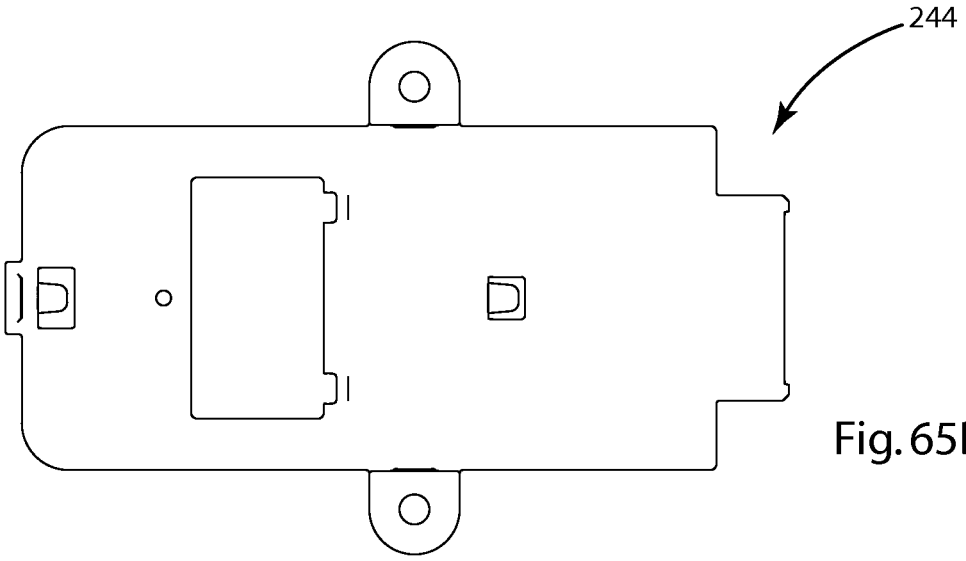
Figure 65E:
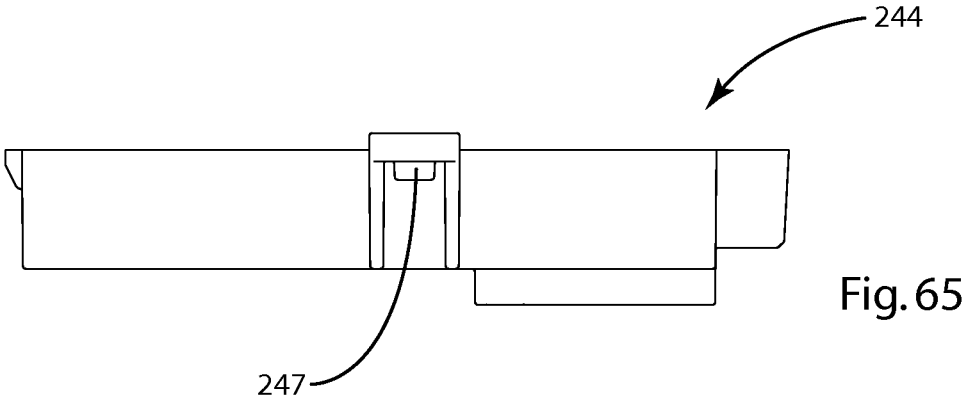
Figure 65F:
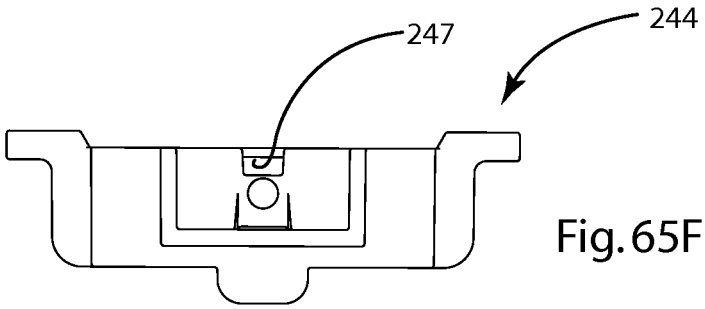
Figure 65G:
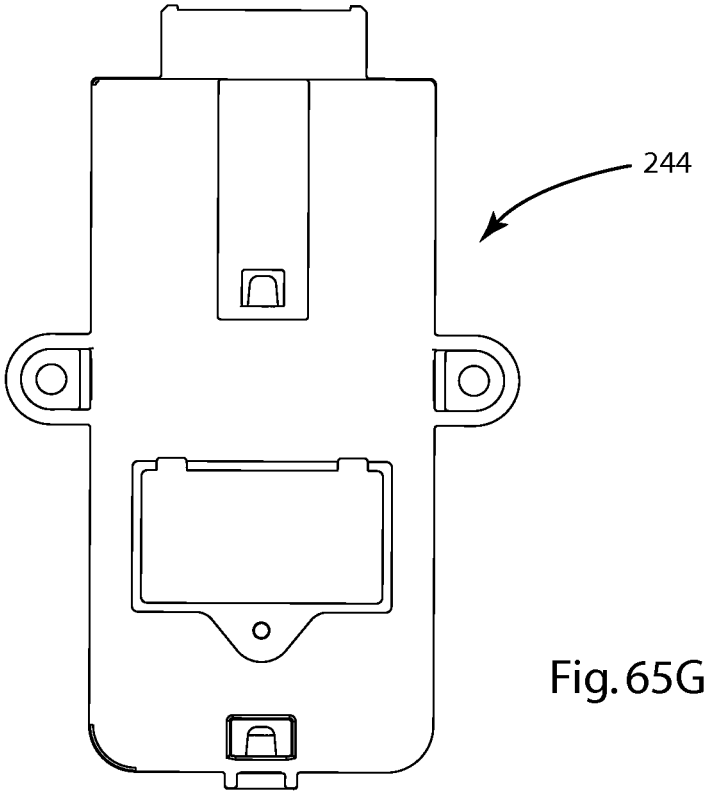
Figure 65H:
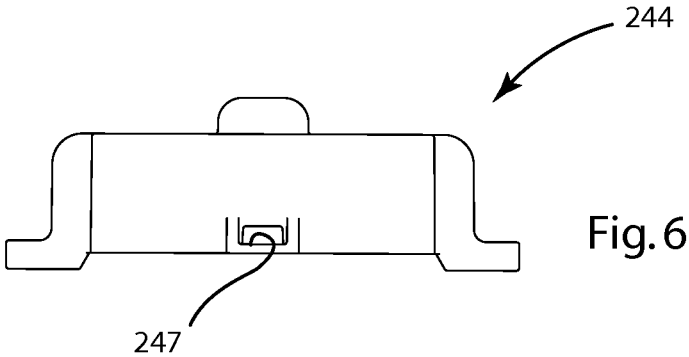

The actuating mechanism 208 includes a knob or handle 216 and is capable of selectively being placed in an engaged configuration (shown in FIGS. 39, 48B, and 53) and a disengaged configuration (shown in FIG. 47). The word "handle" as used herein should be understood to include all types of handles and knobs; however, the illustrated embodiment is provided with a T-shaped handle 216. The handle 216 is rotationally supported by the housing or bezel 224, which also supports the circuit board 242. In the illustrated embodiment, the circuit board 242 is shaped to fit inside the housing 224 and has an outer edge that follows a circular arc that is concentric with the outer circumference of the housing 224. The proximity sensor 256 is electrically connected to the circuit board 242. The proximity sensor 256 can be mechanically supported by the circuit board 242, the housing 224, or both. The housing 224 has an access opening 223 for the proximity sensor 256. A user can cause the actuating mechanism 208 to assume the engaged configuration either manually using an ordinary key (not shown) or electrically using an electronic key that is compatible with the proximity sensor 256. Once in the engaged configuration, the user can manually operate the actuating mechanism 208 to move the pawl 210 to the retracted position, which in turn allows the first member 202 to be moved to the open position. With the actuating mechanism 208 in the engaged configuration, rotating the handle causes rotation of a cam 226 that engages the pawl 210 and moves it to the retracted position.

The circuit board 242 also has a jumper or connector 254 to allow the motor 230 to be electrically connected to the circuit board 242 via wires 253. The end of the wires 253 is provided with a connector 255 that is compatible with the jumper 254 to allow the motor 230 to be electrically connected to the circuit board 242.

In the illustrated embodiment, the cam 226 constitutes an outer cam, and the actuating mechanism 208 also includes and inner cam 228 whose function is explained later. In the illustrated embodiment, the cam 226 has a pawl-engaging portion 258 that is roughly in the form of a cylindrical sleeve that has had one half of it cut away longitudinally. The cam 226 has a input portion 260 that receives torque input from the handle when the actuating mechanism 208 in one of two engaged configurations and that is roughly in the form of a cylindrical sleeve of a diameter smaller than the pawl-engaging portion 258. The outer cam 226 also includes a projection 262 and slots 264 and 266 whose functions are explained later. The pawl-engaging portion 258 of the outer cam 226 acts against an inner edge of the pawl opening 274 to pull the pawl 210 to the retracted position when the cam 226 is rotated. The projection 262 limits the range of rotation of the cam 226.

The inner cam 228 has a square center hole 268 that receives a square cross section portion 270 of the handle shaft 272, such that the handle 216 and the inner cam 228 rotate together as a unit. The screw 232 is used to secure the handle 216 to the inner cam 228 of the actuating mechanism 208. The inner cam 228 has a slot 265 to provide clearance for the lock bolt 222. The inner cam 228 has projections 276 that are too short to engage the inner edge 274 of the pawl opening. Accordingly, the inner cam 228 does not engage the pawl 210. The projections 276, however engage and act against the return spring slide 236 such that rotation of the inner cam 228 out of its closed position, corresponding to the closed position of the handle 216, causes the return spring slide 236 to compress the return spring 238 against the latch mechanism housing 214 when the actuating mechanism 208 is in the disengaged configuration. In the illustrated embodiment, one end of the spring 238 engages the return spring slide 236 and the other end of the spring 238 engages the front portion 244 of the latch housing 214. When the handle 216 is released, the compressed spring 238 acts against the cam 228, via the slide 236, to return the cam 228 and the handle 216 to their closed positions. Thus the slide 236 and spring 238 constitute a biasing means for biasing the handle 216 toward the closed position. The cam 228 had a projection 278 that limits the range of rotation of the cam 228 and thus the handle 216.

The handle 216 of the actuating mechanism 208 can be moved rotationally between a latched or closed position and an unlatched or open position. When the actuating mechanism 208 is in the disengaged configuration, the handle 216 can be rotated between the closed and open positions without moving the cam 226, and thus without moving the sliding pawl or bolt 210 of the latch. The handle 216 carries a lock cylinder 218 that can be rotated relative to the handle 216 using a key to rotate the lock cylinder 218 between locked and unlocked positions relative to the handle 216. The lock cylinder 218 operates a lock bolt 222 between retracted and extended positions, via an eccentric cam 220 that converts the rotation of the lock cylinder to the rectilinear motion of the lock bolt 222. When the lock bolt 222 is in the extended position, the actuating mechanism 208 is in a first engaged configuration and the handle 216 is locked to the cam 226, through the engagement of the lock bolt 222 with the slot 264 of the cam 226, such that rotating the handle 216 from the closed position to the open position moves the cam 226, and thus moves the sliding pawl 210 to the retracted position in order to allow the opening of, for example, a drawer secured by the latch 200.

In addition, the handle 216 carries an electrically-powered motor 230 that is attached to the handle 216, by being secured to the inner cam 228 using the screw 234, such that the motor 230 rotates with the handle 216 as the handle is rotated between the open position and the closed position. The motor 230 has a second bolt 252, also referred to as the motor bolt 252, which can move rectilinearly between retracted and extended positions. The motor bolt 252 is biased toward the extended position and has beveled sides. The motor bolt 252 projects into the slot 266 in the cam 226 when the handle 216 is in the closed position. When the motor 230 is not energized, the motor bolt 252 is free to move to the retracted position. When the motor 230 is not energized, the sides of the slot 266 in the cam 226 act on the beveled surfaces of the motor bolt 252 such that the motor bolt is moved to the retracted position as the handle 216 is rotated toward the open position with the result that the cam 226 will not rotate to the open position with the handle 216. When the motor 230 is energized the motor bolt 252 is prevented from moving out of the extended position, thus placing the actuating mechanism 208 in a second engaged configuration. When the motor bolt 252 is prevented from moving out of the extended position by the energized motor 230, the handle 216 is locked to the cam 226, by the engagement of the motor bolt 252 with the slot 266, such that rotating the handle 216 from the closed position to the open position moves the cam 226 from the closed position to the open position, and thus moves the sliding pawl 210 to the retracted position in order to allow the opening of, for example, a drawer secured by the latch 200. Thus, the lock cylinder 218 and the motor 230 provide two independent means of rotationally connecting the handle 216 to the cam 226 in order to allow the opening of a member secured by the latch 200.

In the second preferred embodiment, the actuating mechanism also includes a proximity sensor 256 operated by an electronic key (not shown). The motor 230 is energized, under control of electronic circuitry carried on circuit board 242, in response to a signal from the proximity sensor 256 that is generated when the proximity sensor 256 senses the presence of the electronic key held near to or touching the proximity sensor. The motor 230 and proximity sensor 256 allow relatively quick access to the contents of any compartment secured by the latch 200, for example a drawer, during emergencies. The cylinder lock 218 allows a manual override in the event of sensor, motor, or power failure. In the illustrated embodiment, the proximity sensor 256 is of the type that is touched by the corresponding electronic key for activation. The word near is understood to encompass a touching relationship within its ordinary meaning.

The actuating mechanism 208 consumes very little power, because the majority of the time, i.e. during periods when the actuating mechanism is in the disengaged configuration, the motor is not energized.

The latch 200 is mounted to the front of the drawer 202 using two screws 240. The front panel of the drawer 202 is provided with appropriate openings to allow the attachment of the actuating mechanism 208 to the latch mechanism 206 with portions of the front panel of the drawer 202 being captured between the actuating mechanism 208 and the latch mechanism 206. The two screws 240 are then engaged to the actuating mechanism 208 and to the latch mechanism 206 and tightened from the inside of the drawer in order to secure the actuating mechanism 208 to the latch mechanism 206; thus, the latch 200 is also secured to the front of the drawer 202. The back portion 243 has snap legs 245 that engage compatible features 247, such as openings, grooves, cavities, projecting ribs, etc., in the front portion 244 to attach the two portions of the latch mechanism housing 214 together. The back portion 243 also has incorporated therein a tubular battery housing 246 that supports the batteries 248 such that each battery 248 can directly contact a terminal on the circuit board 242 in the installed latch. Accordingly, the batteries 248 are oriented with their longitudinal axes parallel to the axis of rotation of the handle 216 in the installed latch 200. A cover 250 protects the batteries 248 and secures the batteries in place relative to the housing 214. If the batteries 248 are connected in series, contacts and conductors provided on the inner side of the cover 250 can connect together the terminals of the batteries 248 that are distal from the circuit board 242. The design of the illustrated embodiment 200 eliminates the need for any wires for the piezo-motor 230, for the proximity sensor 256, or for the batteries 248 to be passed through the face of the drawer to connect them to the circuit board 242. In this way the installation of the latch 200 is greatly simplified.

If the batteries 248 are to be connected in parallel as may be required in some applications, then the terminals of the batteries 248 that are distal from the circuit board 242 may have to be connected to the circuit board 242 by wires extending from contacts provided on the inner side of the cover 250 to the circuit board 242.

In this embodiment, the lock pawl is molded from plastic as opposed to being made from stamped steel. This type of construction eliminates the need for a secondary plating process to impart corrosion resistance or the use of stainless steel, which may have led to increased costs or potentially lesser strength. Also, by using a plastic component, multiple features could be incorporated into the part, thus reducing the need to assemble parts to form the lock pawl and thereby reducing assembly cost.

The Latch 200 is assembled to the front panel of a drawer and allows the end user to access the contents of the drawer via an electronic proximity sensor 256 or a traditional mechanical key. Once the latch 200 is unlocked, the user then rotates the handle 216 which retracts a sliding pawl 210 on the inside of the drawer 202 enabling the drawer to slide open.

In electronic access, the user places an electronic key against the proximity sensor 256, the electrical system on circuit board 242 checks to see whether the user is authorized for access. If access is granted, power is sent to piezo-motor 230 and a green LED will light up on the proximity sensor 256. This allows the outer cam 226 to engage with the handle 216. When the handle 216 is rotated, the outer cam 226 rotates as well and thereby retracts the sliding pawl 210. The system can be programmed to remain in the unlocked state for 5 seconds or more (in 5 second increments). If the user is not authorized for access, a red LED will light up on the sensor 256 and no power is sent to the piezo-motor 230. Without power to the piezo-motor 230, the handle 216 and outer cam 226 are NOT engaged; therefore the sliding pawl 210 will not retract. If there is a power failure or if the electronic key is not available, the system can be unlocked using a properly matched traditional key. By inserting an appropriate key into the lock plug 218 and rotating it, the lock bolt 222 extends out of the handle 216 and mechanically engages the outer cam 226 to the handle 216. The drawer 202 can now be opened by rotating the handle 216. The system stays in the unlocked state as long as the lock plug 218 remains in the un-locked position.

The printed circuit board (PCB) 242 is housed in the actuating mechanism 208. As previously mentioned, this eliminates the need for wires to have to pass through the front drawer panel, thus simplifying latch installation. This also frees up space inside the latch mechanism 206, thus allowing the battery pack to be positioned largely inside of the housing 214, thus minimizing the overall size of the latch.

An important benefit realized from this design of handle is that when it is in its locked mode, it is in a soft lockout condition whereby the handle 216 can still rotate, but turning it doesn't accomplish anything. No amount of torque, even excessive over torque, applied to the handle 216 can open the latch when the actuating mechanism 208 is in the disengaged configuration. The handle 216 will simply rotate ineffectually when the actuating mechanism 208 is in the disengaged configuration.

Additionally, the actuating mechanism 208 can be used in combination with various other latch mechanisms that can be actuated by a rotating member. This may require modification of the biasing means for the handle 216 by replacing the slide 236 and spring 238 with, for example, a torsion spring depending upon the required range of rotation. All the individual electronic components are off-the-shelf items or can be implemented using standard circuit design techniques and therefore it is not necessary to describe them here in detail. In the present embodiment, the actuating mechanism 208 is used to operate a slam latch, but it is within the scope of the invention for the actuating mechanism 208 to alternatively be used to operate various other types of latches, including well known types such as a simple rotating pawl latch or a compression latch of the type that outputs a combination of rotational and rectilinear movement in response to a rotational input.

The proximity sensor 256 is an off-the-shelf access controller using iButton® technology available from DALLAS SEMICONDUCTOR, and was chosen and used in combination with a circuit board design that uses low penlight battery power and also is normally "asleep" so it draws very little battery power until a user brings the electronic key into proximity with the sensor 256 on the latch. This technology uses the iButton® key that is contacted with the sensor 256 to unlock the latch 200. It is also intended for various other ways of controlling authorization to open the latch to be within the scope of the invention. The other ways include the use of electronic keypads, retina or fingerprint readers, radio frequency identification (RFID) tags, push button key chain fobs (like those used for locking/unlocking automobiles), or mechanical pushbutton or combination lock access.

The piezoelectric motor unit 230 also consumes very little power, being normally asleep, and is an off-the-shelf item available from SERVOCELL, Ltd. in the United Kingdom. The piezoelectric unit 230 has a slide or bolt 252 that is normally spring loaded to its extended position, but when energized a piezoelectric leaf-like member inside deforms into place to block the slide 252 from being retracted, thus locking the slide 252 into its extended position.

It is to be understood that the present invention is not limited to the embodiments disclosed above, but includes any and all embodiments within the scope of the appended claims.

The invention claimed is:

1. A latch actuating mechanism comprising:

a housing adapted for attachment to a first member;

a handle supported for rotational movement relative to said housing, said handle being movable between an open position and a closed position;

a cam supported for rotational movement relative to said housing, said cam being movable between an open position and a closed position, said cam being adapted to actuate a latch mechanism such that the latch mechanism is opened in response to said cam moving to said open position of said cam; and means for selectively rotationally connecting said handle to said cam such that said cam rotates from said closed position of said cam to said open position of said cam as said handle is rotated from said closed position of said handle to said open position of said handle, wherein said means for selectively rotationally connecting said handle to said cam comprises:

a motor attached for rotation with said handle; and a motor bolt that is movable rectilinearly between a retracted position and an extended position, wherein said motor bolt engages said cam and acts to move said cam from said closed position of said cam to said open position of said cam as said handle is rotated from said closed position of said handle to said open position of said handle when said motor is energized, wherein said handle is capable of being rotated toward said open position of said handle without rotating said cam toward said open position of said cam when said motor is not energized, and wherein said motor bolt has beveled surfaces, said motor bolt is biased toward the extended position, said motor bolt projects into a slot in said cam when said handle is in said closed position of said handle, said motor bolt is free to move to said retracted position when said motor is not energized, and said beveled surfaces are capable of engaging said slot in said cam to move said motor bolt to said retracted position of said motor bolt, such that said motor bolt cannot act to rotate said cam to said open position of said cam as said handle is rotated toward said open position of said handle when said motor is not energized.

2. The latch actuating mechanism according to claim 1, wherein said means for selectively rotationally connecting said handle to said cam further comprises:

a proximity sensor adapted for generating a signal in response to a user holding an electronic key near said proximity sensor; and means for energizing said motor in response to said signal from said proximity sensor.

3. The latch actuating mechanism according to claim 1, further comprising:

a cylinder lock supported by said handle such that it is capable of being selectively rotated relative to said handle using a key between a locked position and an unlocked position; and a lock bolt that is rectilinearly movable between a retracted position and an extended position, wherein said lock bolt is in engagement with said cam as said handle is rotated from said closed position of said handle to said open position of said handle so as to thereby move said cam from said closed position of said cam to said open position of said cam when said cylinder lock is in said unlocked position.

4. The latch actuating mechanism according to claim 3, wherein said means for selectively rotationally connecting said handle to said cam further comprises:

a proximity sensor adapted for generating a signal in response to a user holding an electronic key near said proximity sensor; and means for energizing said motor in response to said signal from said proximity sensor.

5. A latch comprising:

a latch mechanism;

a housing adapted for attachment to a first member;

a handle supported for rotational movement relative to said housing, said handle being movable between an open position and a closed position;

a cam supported for rotational movement relative to said housing, said cam being movable between an open position and a closed position, said cam being adapted to actuate said latch mechanism such that said latch mechanism is opened in response to said cam moving to said open position of said cam; and means for selectively rotationally connecting said handle to said cam such that said cam rotates from said closed position of said cam to said open position of said cam as said handle is rotated from said closed position of said handle to said open position of said handle, wherein said means for selectively rotationally connecting said handle to said cam comprises:

a motor attached for rotation with said handle; and a motor bolt that is movable rectilinearly between a retracted position and an extended position, wherein said motor bolt is in engagement with said cam and acts to move said cam from said closed position of said cam to said open position of said cam as said handle is rotated from said closed position of said handle to said open position of said handle when said motor is energized, wherein said handle is capable of being rotated toward said open position of said handle without rotating said cam toward said open position of said cam when said motor is not energized, and wherein said motor bolt has beveled surfaces, said motor bolt is biased toward the extended position, said motor bolt projects into a slot in said cam when said handle is in said closed position of said handle, said motor bolt is free to move to said retracted position when said motor is not energized, and said beveled surfaces are capable of engaging said slot in said cam to move said motor bolt to said retracted position of said motor bolt, such that said motor bolt cannot act to rotate said cam to said open position of said cam as said handle is rotated toward said open position of said handle when said motor is not energized.

6. The latch according to claim 5, wherein said means for selectively rotationally connecting said handle to said cam further comprises:

a proximity sensor adapted for generating a signal in response to a user holding an electronic key near said proximity sensor; and means for energizing said motor in response to said signal from said proximity sensor.

7. The latch according to claim 6, wherein said latch mechanism comprises:

a latch pawl that can move rectilinearly between a retracted position and an extended position, said latch pawl rectilinearly moving from said extended position of said latch pawl to said retracted position of said latch pawl as said cam is rotated from said closed position of said cam to said open position of said cam.

8. The latch according to claim 5, further comprising:

a cylinder lock supported by said handle such that it is capable of being selectively rotated relative to said handle using a key between a locked position and an unlocked position; and a lock bolt that is rectilinearly movable between a retracted position and an extended position, wherein said lock bolt is in engagement with said cam as said handle is rotated from said closed position of said handle to said open position of said handle so as to thereby move said cam from said closed position of said cam to said open position of said cam when said cylinder lock is in said unlocked position.

9. The latch according to claim 8, wherein said means for selectively rotationally connecting said handle to said cam further comprises:

a proximity sensor adapted for generating a signal in response to a user holding an electronic key near said proximity sensor; and means for energizing said motor in response to said signal from said proximity sensor.

10. The latch according to claim 9, wherein said latch mechanism comprises:

a latch pawl that can move rectilinearly between a retracted position and an extended position, said latch pawl rectilinearly moving from said extended position of said latch pawl to said retracted position of said latch pawl as said cam is rotated from said closed position of said cam to said open position of said cam.

11. The latch according to claim 7, wherein said cam is an outer cam and wherein said latch mechanism further comprises:

at least one latch pawl return spring biasing said latch pawl toward said extended position of said latch pawl;

an inner cam;

at least one handle return spring;

a handle return spring slide, said handle return spring biasing said handle return spring slide toward a first position corresponding to said handle being in said closed position such that, when said handle is not in its closed position and said motor is not energized, said handle return spring acts against said inner cam, via said handle return spring slide, to bias said handle toward its closed position.

12. The latch according to claim 10, wherein said cam is an outer cam and wherein said latch mechanism further comprises:

at least one latch pawl return spring biasing said latch pawl toward said extended position of said latch pawl;

an inner cam;

at least one handle return spring;

a handle return spring slide, said handle return spring biasing said handle return spring slide toward a first position corresponding to said handle being in said closed position such that, when said handle is not in its closed position and said motor is not energized, said handle return spring acts against said inner cam, via said handle return spring slide, to bias said handle toward its closed position.

13. The latch actuating mechanism according to claim 1, wherein said motor bolt is rectilinearly movable in a direction about perpendicular to an axis of rotation of said handle.

14. The latch according to claim 5, wherein said motor bolt is rectilinearly movable in a direction about perpendicular to an axis of rotation of said handle.

15. The latch actuating mechanism according to claim 1, wherein said motor is connected to said handle such that said motor rotates with said handle at all times.

* * * * *